US010319180B2

(12) United States Patent
Arnone et al.

(10) Patent No.: US 10,319,180 B2
(45) **Date of Patent: *Jun. 11, 2019**

(54) INTERACTIVE APPLICATION OF AN INTERLEAVED WAGERING SYSTEM

(71) Applicant: Gamblit Gaming, LLC, Glendale, CA (US)

(72) Inventors: Miles Arnone, Sherborn, MA (US); Frank Cire, Pasadena, CA (US); Clifford Kaylin, Los Angeles, CA (US); Eric Meyerhofer, Pasadena, CA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 468 days.

This patent is subject to a terminal disclaimer.

(21) Appl. No.: 14/868,364

(22) Filed: Sep. 28, 2015

(65) Prior Publication Data

US 2016/0019747 A1 Jan. 21, 2016

Related U.S. Application Data

(63) Continuation-in-part of application No. PCT/US2014/032432, filed on Mar. 31, 2014.

(60) Provisional application No. 62/056,409, filed on Sep. 26, 2014, provisional application No. 62/056,408, filed on Sep. 26, 2014.

(51) Int. Cl.
*G07F 17/32* (2006.01)

(52) U.S. Cl.
CPC ..... *G07F 17/3227* (2013.01); *G07F 17/3204* (2013.01); *G07F 17/3244* (2013.01); *G07F 17/3295* (2013.01); *G07F 17/3213* (2013.01); *G07F 17/3225* (2013.01); *G07F 17/3276* (2013.01)

(58) Field of Classification Search
CPC ..... G07F 17/3213; G07F 17/3295; G07F 17/3227; G07F 17/3244
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat |
| 6,267,669 | B1 | 7/2001 | Luciano |

(Continued)

OTHER PUBLICATIONS

U.S. Appl. No. 14/205,303 Arnone, et al., filed Mar. 11, 2014.

(Continued)

*Primary Examiner* — William H McCulloch, Jr.
(74) *Attorney, Agent, or Firm* — Frank Cire; Caitlyn Ross

(57) ABSTRACT

Interactive applications of an interleaved wagering system are disclosed. The interleaved wagering system includes an interactive controller that provides an interactive application as an entertainment game to a user, a wager controller that provides gambling games to one or more users, and an application controller that monitors the entertainment game and provides gambling games when appropriate.

4 Claims, 24 Drawing Sheets

(56) References Cited

U.S. PATENT DOCUMENTS 6,428,412 B1 * 8/2002 Anderson ..... G07F 17/32 463/16
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,475,266 B2 7/2013 Arnone
8,480,470 B2 7/2013 Napolitano et al.
8,622,809 B1 1/2014 Arora et al.
9,196,125 B2 * 11/2015 De Viveiros Ortiz ..... G07F 17/3267
9,317,998 B2 * 4/2016 Fine ..... G07F 17/3244
9,576,427 B2 * 2/2017 Arnone ..... G07F 17/3244
9,691,223 B2 * 6/2017 Arnone ..... G07F 17/3225
9,691,224 B2 * 6/2017 Arnone ..... G07F 17/3244
9,691,226 B2 * 6/2017 Arnone ..... G07F 17/3279
9,721,424 B2 * 8/2017 Arnone ..... G07F 17/3225
9,741,201 B2 * 8/2017 Arnone ..... G07F 17/3223
9,747,747 B2 * 8/2017 Arnone ..... G07F 17/3244
9,761,085 B2 * 9/2017 Arnone ..... G07F 17/3244
9,792,763 B2 * 10/2017 Arnone ..... G07F 17/3244
9,805,552 B2 * 10/2017 Arnone ..... G07F 17/3225
9,811,974 B2 * 11/2017 Arnone ..... G07F 17/38
9,842,465 B2 * 12/2017 Arnone ..... G07F 17/3244
9,858,758 B2 * 1/2018 Arnone ..... G07F 17/3267
9,881,452 B2 * 1/2018 Arnone ..... G07F 17/3244
9,881,454 B2 * 1/2018 Arnone ..... G07F 17/3244
9,881,458 B2 * 1/2018 Arnone ..... G07F 17/3262
9,892,595 B2 * 2/2018 Arnone ..... G07F 17/3267
9,911,283 B2 * 3/2018 Arnone ..... G07F 17/3288
9,922,495 B2 * 3/2018 Arnone ..... G07F 17/3223
9,953,487 B2 * 4/2018 Arnone ..... G07F 17/3267
10,002,495 B2 * 6/2018 Arnone ..... G07F 17/3244
10,062,239 B2 * 8/2018 Arnone ..... G07F 17/3267
10,068,427 B2 * 9/2018 Arnone ..... G07F 17/3244
10,074,243 B2 * 9/2018 Arnone ..... G07F 17/3244
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 * 9/2005 Friedman ..... G07F 17/32 463/25
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 * 5/2008 Oberberger ..... G07F 17/32 463/16
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman

(56) References Cited

U.S. PATENT DOCUMENTS

2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1* 3/2009 Popovich ..... G07F 17/32 463/25
2009/0061997 A1* 3/2009 Popovich ..... G07F 17/32 463/26
2009/0061998 A1* 3/2009 Popovich ..... G07F 17/32 463/26
2009/0061999 A1* 3/2009 Popovich ..... G07F 17/32 463/26
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181769 A1* 7/2009 Thomas ..... G07F 17/3211 463/32
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1* 5/2011 Filipour ..... G07F 17/32 463/27
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1* 9/2011 Thomas ..... G07F 17/32 463/25
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0034968 A1* 2/2012 Watkins ..... G07F 17/3211 463/20
2012/0058814 A1 3/2012 Lutnick
2012/0077569 A1* 3/2012 Watkins ..... G07F 17/3267 463/25
2012/0108323 A1 5/2012 Kelly
2012/0115581 A1* 5/2012 Englman ..... G07F 17/3258 463/25
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0260869 A1 10/2013 Leandro et al.
2013/0324222 A1* 12/2013 De Viveiros Ortiz ..... G07F 17/3267 463/25
2014/0087801 A1 3/2014 Nicely et al.
2014/0087808 A1 3/2014 Leandro et al.
2014/0087809 A1 3/2014 Leupp et al.
2014/0274263 A1* 9/2014 Fine ..... G07F 17/3288 463/16
2014/0357350 A1 12/2014 Weingardt et al.
2015/0213686 A1* 7/2015 Arnone ..... G07F 17/3244 463/25
2015/0243127 A1* 8/2015 Arnone ..... G07F 17/3244 463/25
2015/0287264 A1* 10/2015 De Viveiros Ortiz ..... G07F 17/3244 463/25
2015/0310700 A1* 10/2015 Arnone ..... G07F 17/326 463/16
2016/0019747 A1* 1/2016 Arnone ..... G07F 17/3295 463/10
2017/0243446 A1* 8/2017 Arnone ..... G07F 17/34
2017/0249803 A1* 8/2017 Arnone ..... G07F 17/3244
2017/0278343 A1* 9/2017 Arnone ..... G07F 17/3227
2017/0278355 A1* 9/2017 Meyerhofer ..... G07F 17/3295
2017/0365128 A1* 12/2017 Arnone ..... G07F 17/34
2018/0025579 A1* 1/2018 Arnone ..... G07F 17/3269

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.

(56) References Cited

OTHER PUBLICATIONS

U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.

(56) References Cited

OTHER PUBLICATIONS

U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.

* cited by examiner

2500

INTERACTIVE APPLICATION OF AN INTERLEAVED WAGERING SYSTEM

CROSS-REFERENCE TO RELATED APPLICATIONS

The current application is a continuation in part of Patent Cooperation Treaty Application No. PCT/US14/32432, filed Mar. 31, 2014, which claims the benefit of U.S. Provisional Application No. 61/817,807, filed Apr. 30, 2013, and U.S. Provisional Application No. 61/806,579, filed Mar. 29, 2013, the disclosures of each of which are incorporated herein by reference as if set forth herewith. This application claims the benefit of U.S. Provisional Application No. 62/056,409 filed Sep. 26, 2014, and U.S. Provisional Application No. 62/056,408 filed Sep. 26, 2014, the disclosure of each of which are incorporated by reference as if set forth herewith.

FIELD OF THE INVENTION

Embodiments of the present invention are generally related to communications within data processing systems. More particularly, the present invention relates to the communication and processing of wagering data.

BACKGROUND

The gaming industry has traditionally developed electronic gaming machines that present simple wagering games to a user. The communication and processing needs for these simple wagering games are easily met using conventional processing systems. However, more complicated wagering games need communication and processing systems that are better suited for implementing these more complicated wagering games. Various aspects of embodiments of the present invention meet such a need.

SUMMARY OF THE INVENTION

Systems and methods in accordance with embodiments of the invention provide a communication and data processing system constructed for an interleaved wagering system.

DETAILED DESCRIPTION

Figure 1:
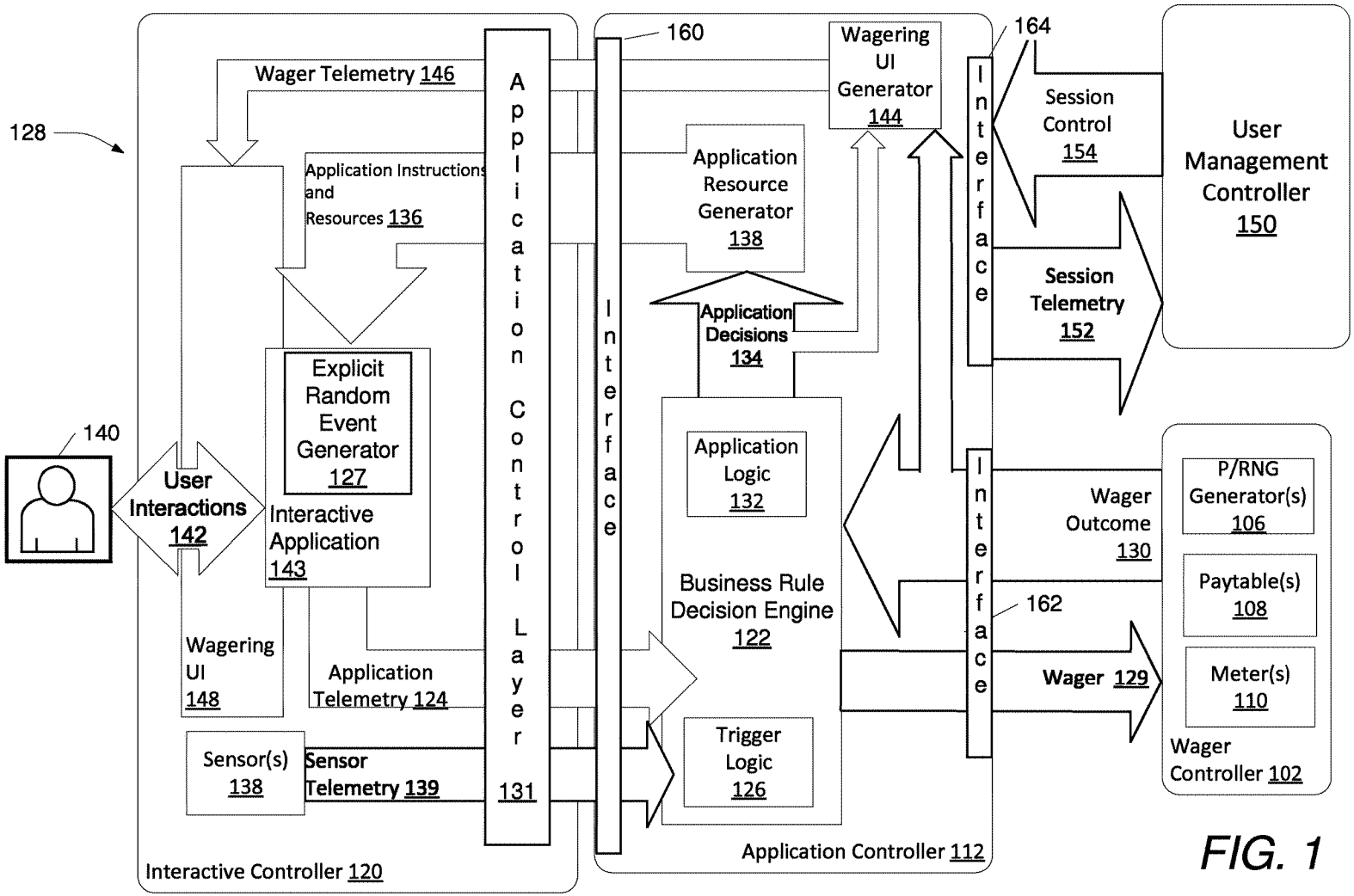
FIG. 1 is a diagram of a structure of an interleaved wagering system in accordance with various embodiments of the invention.

An interleaved wagering system interleaves wagering with non-wagering activities. In some embodiments of an interleaved wagering system an interactive application executed by an interactive controller provides non-wagering components of the interleaved wagering system. The interactive controller is operatively connected to an application controller that manages and configures the interactive application of the interactive controller and determines when wagers should be interleaved with the operations of the interactive application. The application controller is further operatively connected to a wager controller that provides one or more wagering propositions for one or more wagers.

In some embodiments, the interactive controller also includes a wagering user interface that is used to display data about a wagering process, including but not limited a wager outcome of a wager made in accordance with a wagering proposition. The content of the wagering user interface is controlled by the application controller and includes content provided by the wager controller.

In several embodiments, a user or user interactions are represented in an interleaved wagering system by the electronic representation of interactions between the user and the interactive application, typically received via a user interface of the interactive application, and a user profile of the interleaved wagering system associated with the user.

Many different types of interactive applications may be utilized with the interleaved wagering system. In some embodiments, the interactive application reacts to the physical activity of the user. In these embodiments, the user interacts with the interactive application through one or more sensors that monitor the user's physical activities.

Such sensors may include, but are not limited to, physiological sensors that monitor the physiology of the user, environmental sensors that monitor the physical environment of the user, accelerometers that monitor changes in motion of the user, and location sensors that monitor the location of the user such as global positioning sensors.

In some embodiments, the interactive application is a skill-based interactive game that is played by the user.

In some embodiments, the interactive application is a tool used by the user to achieve some useful goal.

In operation, a user interacts with the interactive application using various types of elements of the interactive application in an interactive application environment. Elements are interactive application resources utilized by the user within the interactive application environment to provide an interactive experience for the user. Wagers of credits are made in accordance with a wagering proposition as triggered by the user's use of one or more of the elements of the interactive application. Wager outcomes of wagers of credits made in accordance with the wagering proposition can cause consumption, loss or accrual of credits.

In accordance with some embodiments, wager outcomes of wagering events can influence elements in the interactive application such as, but not limited to, providing one or more new elements, restoring one or more consumed elements, causing the loss of one or more elements, and restoration or placement of one or more fixed elements.

In various embodiments, the wagers may be made using real world credit (RC). In some embodiments, RC can be one or more credits that are purchased using, and redeemed in, a real world currency having a real world value.

In many embodiments, RC can be one or more credits in a virtual currency. Virtual currency can be thought of as a form of alternate currency that can be acquired, purchased or transferred in unit or in bulk by or to a user but does not necessarily directly correlate to a real currency. In many such embodiments, RC are allowed to be purchased using a real world currency but are prevented from being redeemed in a real world currency having a real world value.

In several embodiments, during interaction with the interactive application using the elements, a user can optionally consume and/or accrue application environment credit (AC) within the interactive application as a result of the user's use of the interactive application. AC can be in the form of, but is not limited to, application environment credits, experience points, and points generally.

In various embodiments, when the interactive application is a skill-based interactive game, AC is awarded to a player of the skill-based interactive game on the basis of the player's skillful play of the skill-based interactive game. In such embodiments, AC may be analogous to the score in a typical video game. The skill-based interactive game can have one or more scoring criteria, embedded within an application controller and/or an interactive controller that provides the skill-based interactive game that reflect user performance against goal(s) of the skill-based interactive game.

In many embodiments, AC can be used to purchase in-game items, including but not limited to, elements that have particular properties, power ups for existing items, and other item enhancements. In many embodiments, AC may be used to earn entrance into a sweepstakes drawing, to earn entrance in a tournament with prizes, to score in the tournament, and/or to participate and/or score in any other game event. In many embodiments, AC can be stored on a user-tracking card or in a network-based user tracking system where the AC is attributed to a specific user.

In many embodiments, a wagering proposition includes a wager of AC for a wager outcome of a randomly generated payout of interactive application AC, elements, and/or objects in accordance with a wagering proposition.

In a number of embodiments, a wager of an amount of RC results in a wager outcome of a payout of AC, elements, and/or objects that have an RC value if cashed out.

In some embodiments, in a case that an interactive application is a skill-based interactive game, interactive application objects include in-game objects that may be used by a player of the skill-based interactive game to enhance the player's gameplay of the skill-based interactive game. Such objects include, but are not limited to, power-ups, enhanced in-game items, and the like. In some embodiments, the interactive application objects include objects that are detrimental to the player's play of the skill-based interactive game such as, but not limited to, obstructions in the game space, a temporary player handicap, an enhanced opponent, and the like.

In some embodiments, elements in an interactive application include, but are not limited to, enabling elements (EE) that are interactive application environment resources utilized during the user's use of the interactive application and whose utilization by the user while using the interactive application triggers execution of a wager in accordance with a wagering proposition. In another embodiment, elements in an interactive application include, but are not limited to, a reserve enabling element (REE), that is an element that converts into one or more enabling elements upon occurrence of a release event during an interactive session. In yet another embodiment, elements in an interactive application include, but are not limited to, an actionable element (AE) that is an element that is acted upon during use of the interactive application to trigger a wager in accordance with a wagering proposition and may or may not be restorable during normal play of the interactive application. In yet another embodiment, elements in an interactive application include, but are not limited to, a common enabling element (CEE) that is an element that may be shared by two or more users and causes a wagering event and associated wager to be triggered in accordance with the wagering proposition when used by one of the users during use of the interactive application. In some embodiments, in progressing through interactive application use, a user can utilize elements during interactions with a controlled entity (CE). A CE is a character, entity, inanimate object, device or other object under control of a user.

In accordance with some embodiments of an interleaved wagering system, the triggering of the wagering event and/or wager can be dependent upon an interactive application environment variable such as, but not limited to, a required object (RO), a required environmental condition (REC), or a controlled entity characteristic (CEO). A RO is a specific interactive application object in an interactive application acted upon for an AE to be completed. A non-limiting example of an RO is a specific key needed to open a door. An REC is an interactive application state present within an interactive application for an AE to be completed. A non-limiting example of an REC is daylight whose presence enables a character to walk through woods. A CEO is a status of the CE within an interactive application for an AE to be completed. A non-limiting example of a CEO is requirement that a CE have full health points before entering battle. Although various interactive application resources such as, but not limited to, the types of interactive application elements as discussed herein may be used to trigger a wager in accordance with a wagering proposition, one skilled in the art will recognize that any interactive application resource can be utilized in an interleaved wagering system to trigger of a wager as appropriate to the specification of a specific application in accordance with various embodiments of the invention.

In several embodiments, an interleaved wagering system can utilize an application controller to monitor use of the interactive application executed by an interactive controller for detecting a trigger of a wagering event. The trigger for the wagering event can be detected by the application controller from the utilization of the interactive application in accordance with at least one wagering event occurrence rule. The trigger of the wagering event can be communicated to a wager controller. In response to notification of the trigger, the wager controller executes a wager in accordance with a wagering proposition. In addition, use of an interactive application in an interleaved wagering system can be modified by the application controller based upon the wager outcome.

In several embodiments, a wagering event occurrence can be determined from one or more application environment variables within an interactive application that are used to trigger a wager and/or associated wager in accordance with a wagering proposition. Application environment variables can include, but are not limited to, passage of a period of time during interleaved wagering system interactive application use, a result from an interleaved wagering system interactive application session (such as, but not limited to, achieving a goal or a particular score), a user action that is a consumption of an element, or a user action that achieves a combination of elements to be associated with a user profile.

In numerous embodiments, an interactive application instruction is an instruction to an interactive controller and/or an interactive application to modify an interactive application state or modify one or more interactive application resources. In some embodiments, the interactive application instructions may be based upon one or more of a wager outcome and application environment variables. An interactive application instruction can modify any aspect of an interactive application, such as, but not limited to, an addition of a period of time available for a current interactive application session for the interactive application of interleaved wagering system, an addition of a period of time available for a future interleaved wagering system interactive application session or any other modification to the interactive application elements that can be utilized during interactive application use. In some embodiments, an interactive application instruction can modify a type of element whose consumption triggers a wagering event occurrence. In many embodiments, an interactive application instruction can modify a type of element whose consumption is not required in a wagering event occurrence.

In a number of embodiments, a user interface can be utilized that depicts a status of the interactive application in the interleaved wagering system. A user interface can depict any aspect of an interactive application including, but not limited to, an illustration of interleaved wagering system interactive application use advancement as a user uses the interleaved wagering system.

In some embodiments, an interleaved wagering system including an application controller operatively connected to a wager controller and operatively connected to an interactive controller may provide for interleaving entertainment content from an interactive application. The interleaved wagering system provides for random wager outcomes in accordance with the wagering proposition that are independent of user skill while providing an interactive experience to the user that may be shaped by the user's skill.

In several embodiments, an application controller of an interleaved wagering system may provide for a communications interface for asynchronous communications between a wager controller and an interactive application provided by an interactive controller, by operatively connecting the interactive controller, and thus the interactive controller's interactive application, with the wager controller. In some embodiments, asynchronous communications provided for by an interleaved wagering system may reduce an amount of idle waiting time by an interactive controller of the interleaved wagering system, thus increasing an amount of processing resources that the interactive controller may provide to an interactive application or other processes of the interactive controller. In many embodiments, asynchronous communications provided for by an interleaved wagering system reduces an amount of idle waiting time by a wager controller, thus increasing an amount of processing resources that the wager controller may provide to execution of wagers to determine wager outcomes, and other processes provided by the wager controller. In some embodiments, a wager controller of an interleaved wagering system may be operatively connected to a plurality of interactive controllers through one or more application controllers and the asynchronous communications provided for by the one or more application controllers allows the wager controller to operate more efficiently and provide wager outcomes to a larger number of interactive controllers than would be achievable without the one or more application controllers of the interleaved wagering system.

In some embodiments, an interleaved wagering system including an application controller operatively connected to a wager controller and operatively connected to an interactive controller may provide for simplified communication protocols for communications of the interactive controller as the interactive controller may communicate user interactions with an interactive application provided by the interactive controller to the application controller without regard to a nature of a wagering proposition to be interleaved with processes of the interactive application.

In various embodiments, an interleaved wagering system including an application controller operatively connected to a wager controller and operatively connected to an interactive controller may provide for simplified communication protocols for communications of the wager controller as the wager controller may receive wager requests and communicate wager outcomes without regard to a nature of an interactive application provided by the interactive controller.

Various types interleaved wagering systems are discussed in Patent Cooperation Treaty Application No. PCT/US11/26768, filed Mar. 1, 2011, Patent Cooperation Treaty Application No. PCT/US11/63587, filed Dec. 6, 2011, and Patent Cooperation Treaty Application No. PCT/US12/58156, filed Sep. 29, 2012, the contents of each of which are hereby incorporated by reference in their entirety.

Wagering Interleaved Systems

FIG. 1 is a diagram of a structure of an interleaved wagering system in accordance with various embodiments of the invention. The interleaved wagering system 128 includes an interactive controller 120, an application controller 112, and a wager controller 102. The interactive controller 120 is operatively connected to, and communicates with, the application controller 112. The application controller 112 is also operatively connected to, and communicates with, the wager controller 102.

In several embodiments, the wager controller 102 is a controller for providing one or more wagering propositions provided by the interleaved wagering system 128 and executes wagers in accordance with the wagering propositions. Types of value of a wager can be one or more of several different types. Types of value of a wager can include, but are not limited to, a wager of an amount of RC corresponding to a real currency or a virtual currency, a wager of an amount of AC earned by the player through use of an interactive application, a wager of an amount of elements of an interactive application, and a wager of an amount of objects used in an interactive application. A wager outcome determined for a wager in accordance with a wagering proposition can increase or decrease an amount of the type of value used in the wager, such as, but not limited to, increasing an amount of RC for a wager of RC. In various embodiments, a wager outcome determined for a wager in accordance with a wagering proposition can increase or decrease an amount of a type of value that is different than a type of value of the wager, such as, but not limited to, increasing an amount of an object of an interactive application for a wager of RC.

In many embodiments, the wager controller 120 includes one or more pseudo random or random number generators (P/RNG) 106 for generating random results, one or more paytables 108 for determining a wager outcome from the random results, and one or more credit or value meters 110 for storing amounts of wagered and won credits.

The one or more P/RNG generators 106 execute processes that can generate random or pseudo random results. The one or more paytables 108 are tables that can be used in conjunction with the random or pseudo random results to determine a wager outcome including an amount of RC, AC, elements or objects won as a function of interleaved wagering system use. There can be one or more paytables 108 in the wager controller 102. The paytables 108 are used to implement one or more wagering propositions in conjunction with a random output of the random or pseudo random results.

In some embodiments, selection of a paytable to use to execute a wager can be based on factors including, but not limited to, interactive application progress a user has achieved through use of the interactive application, user identification, and eligibility of the user for bonus rounds.

In various embodiments, the interactive controller 120 provides an interactive application 143 and provides human input devices (HIDs) and output devices for interacting with the user 140. The interactive controller 120 provides for user interactions 142 with the interactive application 143 by receiving input from a user through the HIDs and providing outputs such as video, audio and/or other sensory output to the user using the output devices.

The interactive controller 120 is operatively connected to, and communicates with, the application controller 112. The interactive controller communicates application telemetry data 124 to the application controller 112 and receives application instructions and resources 136 from the application controller 112. Via the communication of application instructions and resources 136, the application controller 112 can communicate certain interactive application resources including control parameters to the interactive application 143 to affect the interactive application's execution by the interactive controller 120. In various embodiments, these interactive application control parameters can be based on a wager outcome of a wager that was triggered by an element in the interactive application being utilized or acted upon by the user.

In some embodiments, execution of the skill-based interactive game by the interactive controller 120 communicates user interactions with interactive application to the application controller 112. The application telemetry data 124 includes, but is not limited to, the user's utilization of the elements in the interactive application.

In some embodiments, the interactive application 143 is a skill-based interactive game. In such embodiments, execution of the skill-based interactive game by the interactive controller 120 is based on the user's skillful play of the skill-based interactive game. The interactive controller 120 can also communicate user choices made in the skill-based interactive game to the application controller 112 included in the application telemetry data 124 such as, but not limited to, the user's utilization of the elements of the skill-based interactive game during the user's skillful play of the skill-based interactive game. In such an embodiment, the application controller is interfaced to the interactive controller 120 in order to allow the coupling of the skill-based interactive game to wagers made in accordance with a wagering proposition.

In some embodiments, the interactive controller 120 includes one or more sensors 138 that sense various aspects of the physical environment of the interactive controller 120. Examples of sensors include, but are not limited to: global positioning sensors (GPSs) for sensing communications from a GPS system to determine a position or location of the interactive controller; temperature sensors; accelerometers; pressure sensors; and the like. Sensor telemetry data 128 is communicated by the interactive controller to the application controller 112. The application controller 112 receives the sensor telemetry data 128 and uses the sensory telemetry data to make wager decisions.

In many embodiments, the interactive controller includes a wagering user interface 148 used to display wagering data to the user.

In various embodiments, an application control layer 131 resident in the interactive controller 120 provides an interface between the interactive controller 120 and the application controller 112.

In many embodiments, application controller 112 provides an interface between the interactive application 143 provided by the interactive controller 120 and a wagering proposition provided by the wager controller 102.

In some embodiments, the application controller 112 includes an interactive controller interface 160 to an interactive controller. The interactive controller interface 160 provides for the communication of data between the interactive controller and the application controller, including but not limited to wager telemetry data 146, application instructions and resources 136, application telemetry data 124, and sensor telemetry data 128.

In various embodiments, the application controller 112 includes a wager controller interface 162 to a wager controller. The wager controller interface 162 provides for communication of data between the application controller 112 and the wager controller, including but not limited to wager outcome data 130 and wager data 129.

In some embodiments, the application controller 112 includes a user management controller interface 164 to a user management controller. The user management controller interface 164 provides for communication of data between the application controller 112 and the user management controller, including but not limited to session control data 154 and session telemetry data 152.

The application controller 112 includes a business rule decision engine 122 that receives telemetry data, such as application telemetry data 124 and sensor telemetry data 128, from the interactive controller 120. The business rule decision engine 122 uses the telemetry data, along with trigger logic 126 to generate wager data 129 used to trigger a wager in the wager controller 102.

In some embodiments, the application telemetry data 124 includes, but is not limited to, application environment variables that indicate the state of the interactive application 143 being used by a user 140, interactive controller data indicating the state of the interactive controller, and user actions and interactions 142 between the user and the interactive application 143 provided by the interactive controller 120. The wagering and/or wager data 129 may include, but is not limited to, an amount and type of the wager, a trigger of the wager, and a selection of a paytable 108 to be used when executing the wager.

In some embodiments, the business rule decision engine 122 also receives wager outcome data 130 from the wager controller 102. The decision engine 122 uses the wager outcome data 130, in conjunction with the telemetry data and application logic 132 to generate application decisions 134 communicated to an application resource generator 138. The application resource generator 138 receives the application decisions and uses the application decisions to generate application instructions and application resources 136 to be communicated to the interactive application 143.

In many embodiments, the application controller 112 includes a pseudo random or random result generator used to generate random results that are communicated to the application resource generator 138. The application resource generator 138 uses the random results to generate application instructions and application resources 136 to be communicated to the interactive application 143.

In various embodiments, the business rule decision engine 122 also determines an amount of AC to award to the user 140 based at least in part on the user's use of the interactive application of the interleaved wagering system as determined from the application telemetry data 124. In some embodiments, wager outcome data 130 may also be used to determine the amount of AC that should be awarded to the user.

In numerous embodiments, the interactive application is a skill-based game and the AC is awarded to the user for the user's skillful play of the skill-based game.

In some embodiments, the application decisions 134 and wager outcome data 130 are communicated to a wagering user interface generator 144. The wagering user interface generator 144 receives the application decisions 134 and wager outcome data 130 and generates wager telemetry data 146 describing the state of wagering and credit accumulation and loss for the interleaved wagering system. In some embodiments, the wager telemetry data 146 may include, but is not limited to, amounts of AC and elements earned, lost or accumulated by the user through use of the interactive application as determined from the application decisions, and RC amounts won, lost or accumulated as determined from the wager outcome data 130 and the one or more meters 110.

In some embodiments, the wager outcome data 130 also includes data about one or more game states of a gambling game executed in accordance with a wagering proposition by the wager controller 102. In various such embodiments, the wagering user interface generator 144 generates a gambling game process display and/or gambling game state display using the one or more game states of the gambling game. The gambling game process display and/or gambling game state display is included in the wager telemetry data 146 that is communicated to the interactive controller 120. The gambling game process display and/or a gambling game state display is displayed by the wagering user interface 148 to the user 140. In other such embodiments, the one or more game states of the gambling game are communicated to the interactive controller 120 and the wagering user interface 148 generates the gambling game process display and/or gambling game state display using the one or more game states of the gambling game for display to the user 140.

The application controller 112 can further operatively connect to the wager controller 102 to determine an amount of credit or elements available and other wagering metrics of a wagering proposition. Thus, the application controller 112 may potentially affect an amount of RC in play for participation in the wagering events of a wagering game provided by the wager controller 102 in some embodiments. The application controller 112 may additionally include various audit logs and activity meters. In some embodiments, the application controller 112 can also couple to a centralized server for exchanging various data related to the user and the activities of the user during game play of an interleaved wagering system.

In many embodiments, one or more users can be engaged in using the interactive application executed by the interactive controller 120. In various embodiments, an interleaved wagering system can include an interactive application that provides a skill-based interactive game that includes head-to-head play between a single user and a computing device, between two or more users against one another, or multiple users playing against a computer device and/or each other. In some embodiments, the interactive application can be a skill-based interactive game where the user is not skillfully playing against the computer or any other user such as skill-based interactive games where the user is effectively skillfully playing against himself or herself.

In some embodiments, the operation of the application controller 112 does not affect the provision of a wagering proposition by the wager controller 102 except for user choice parameters that are allowable in accordance with the wagering proposition. Examples of user choice parameters include, but are not limited to: wager terms such as but not limited to a wager amount; speed of game play (for example, by pressing a button or pulling a handle of a slot machine); and/or agreement to wager into a bonus round.

In various embodiments, wager outcome data 130 communicated from the wager controller 102 can also be used to convey a status operation of the wager controller 102.

In a number of embodiments, communication of the wager data 129 between the wager controller 102 and the application controller 112 can further be used to communicate various wagering control factors that the wager controller 102 uses as input. Examples of wagering control factors include, but are not limited to, an amount of RC, AC, elements, or objects consumed per wagering event, and/or the user's election to enter a jackpot round.

In some embodiments, the application controller 112 utilizes the wagering user interface 148 to communicate certain interactive application data to the user, including but not limited to, club points, user status, control of the selection of choices, and messages which a user can find useful in order to adjust the interactive application experience or understand the wagering status of the user in accordance with the wagering proposition in the wager controller 102.

In some embodiments, the application controller 112 utilizes the wagering user interface 148 to communicate aspects of a wagering proposition to the user including, but not limited to, odds of certain wager outcomes, amount of RC, AC, elements, or objects in play, and amounts of RC, AC, elements, or objects available.

In a number of embodiments, the wager controller 102 can accept wager proposition factors including, but not limited to, modifications in the amount of RC, AC, elements, or objects wagered on each individual wagering event, a number of wagering events per minute the wager controller 102 can resolve, entrance into a bonus round, and other factors. An example of a varying wager amount that the user can choose can include, but is not limited to, using a more difficult interactive application level associated with an amount of a wager. These factors can increase or decrease an amount wagered per individual wagering proposition in the same manner that a standard slot machine player can decide to wager more or less credits for each pull of the handle. In several embodiments, the wager controller 102 can communicate a number of factors back and forth to the application controller 112, via an interface, such that an increase/decrease in a wagered amount can be related to the change in user profile of the user in the interactive application. In this manner, a user can control a wager amount per wagering event in accordance with the wagering proposition with the change mapping to a parameter or component that is applicable to the interactive application experience.

In some embodiments, a user management controller 150 is used to authorize an interleaved wagering system gaming session. The user management controller receives game session data 152, that may include, but is not limited to, user, interactive controller, application controller and wager controller data from the application controller 112. The user management controller 150 uses the user, interactive controller, application controller and wager controller data to regulate an interleaved wagering system gaming session. In some embodiments, the user management controller may also assert control of an interleaved wagering system game session 154. Such control may include, but is not limited to, ending an interleaved wagering system game session, initiating wagering in an interleaved wagering system game session, ending wagering in an interleaved wagering system game session but not ending a user's play of the interactive application portion of the interleaved wagering system game, and changing from real credit wagering in an interleaved wagering system to virtual credit wagering, or vice versa.

Interleaved Wagering System Controllers

Figure 2A:
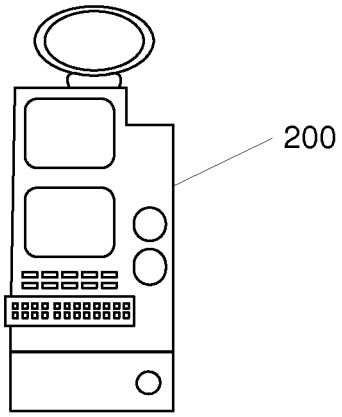
FIGS. 2A, 2B, 2C, and 2D are illustrations of interactive controllers of an interleaved wagering system in accordance with various embodiments of the invention.
Figure 2B:
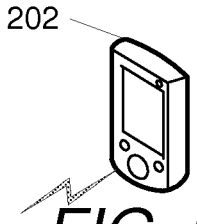
Figure 2C:
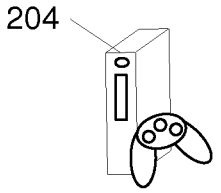
Figure 2D:
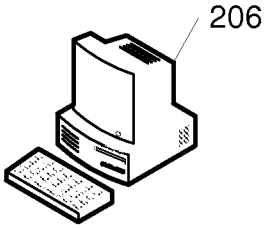

FIGS. 2A, 2B, 2C, and 2D are illustrations of interactive controllers of an interleaved wagering system in accordance with various embodiments of the invention. An interactive controller, such as interactive controller 120 of FIG. 1, may be constructed using one or more processing devices configured to perform the operations of the interactive controller. An interactive controller may be constructed from an electronic gaming machine 200 as shown in FIG. 2A. The electronic gaming machine 200 may be physically located in various types of gaming establishments. An interactive controller may be constructed from a portable device 202 as shown in FIG. 2B. The portable device 202 is a device that may wirelessly connect to a network. Examples of portable devices include, but are not limited to, a tablet computer, a personal digital assistant, and a smartphone. An interactive controller may be constructed from a gaming console 204 as shown in FIG. 2C. An interactive controller may be constructed from a personal computer 206 as shown in FIG. 2D. Indeed, an interactive controller in an interleaved wagering system may be constructed from any processing device including sufficient processing and communication capabilities that may be configured to perform the processes of an interactive controller in accordance with various embodiments of the invention.

Some interleaved wagering systems in accordance with many embodiments of the invention can operate with their components being network connected or can communicate with other interleaved wagering systems. In many embodiments, operations associated with components of an interleaved wagering system can be performed on a single device or across multiple devices. These multiple devices can be constructed using a single server or a plurality of servers such that an interleaved wagering system is executed as a system in a virtualized space such as, but not limited to, where a wager controller and an application controller are large scale centralized servers in the cloud operatively connected to widely distributed interactive controllers via a wide area network such as the Internet or a local area network. In such embodiments, the components of an interleaved wagering system may communicate using a networking protocol or other type of device-to-device communications protocol.

In many embodiments, a centralized wager controller is operatively connected to, and communicates with, one or more application controllers via a network. The centralized wager controller can generate wager outcomes for wagers in accordance with one or more wagering propositions. The centralized wager controller can execute a number of simultaneous or pseudo-simultaneous wagers in order to generate wager outcomes for a variety of wagering propositions that one or more networked interleaved wagering systems can use.

In several embodiments, a centralized application controller is operatively connected to one or more interactive controllers and one or more wager controllers via a network. The centralized application controller can perform the functionality of an application controller across various interleaved wagering systems.

In a variety of embodiments, management of user profile data can be performed by a user management controller operatively connected to, and communicating with, one or more application controllers, wager controllers and interactive controllers via a network. A user management controller can manage data related to a user profile. The managed data in the user profile may include, but is not limited to, data concerning controlled entities (characters) in interactive application use, user performance metrics for a type or class of interactive application, interactive application elements acquired by a user; RC and AC associated with a particular user, and tournament reservations.

Although a user management controller is discussed as being separate from an application controller server, a centralized application controller server may also perform the functions of a user management controller in some embodiments.

In a number of embodiments, an application controller of an interleaved wagering system can communicate data to a user management controller. The data communicated by the application controller to the user management controller may include, but is not limited to, AC and RC used in an interactive application; user profile data; user interaction activity; profile data for users; synchronization data between a wager controller and an interactive application; and data about other aspects of an interleaved wagering system. In several embodiments, a user management controller can communicate user data to an application controller of an interleaved wagering system. The user data may include, but is not limited to, interactive application title and type;

tournament data; special offers; character or profile setup and synchronization data between a wagering game and an interactive application; and data about any other aspect of an interleaved wagering system.

In numerous embodiments, an interactive application server provides a host for managing head-to-head play operating over a network of interactive controllers connected to the interactive application server via a network. The interactive application server provides an environment where users can compete directly with one another and interact with other users.

Processing devices connected via a network to construct interleaved wagering systems in accordance with many embodiments of the invention can communicate with each other to provide services utilized by an interleaved wagering system. In several embodiments, a wager controller can communicate with an application controller over a network. In some embodiments, the wager controller can communicate with an application controller to communicate any type of data as appropriate for a specific application. Examples of the data that may be communicated include, but are not limited to, data used to configure the various simultaneous or pseudo simultaneous wager controllers executing in parallel within the wager controller to accomplish interleaved wagering system functionalities; data used to determine metrics of wager controller performance such as wagers run and/or wager outcomes for tracking system performance; data used to perform audits and/or provide operator reports; and data used to request the results of a wager outcome for use in one or more function(s) operating within the application controller such as, but not limited to, automatic drawings for prizes that are a function of interactive controller performance.

In several embodiments, an application controller can communicate with an interactive application server via a network when the interactive application server is also communicating with one or more interactive controllers over a network. An application controller can communicate with an interactive application server to communicate any type of data as appropriate for a specific application. The data that may be communicated between an application controller and an interactive application server includes, but is not limited to, the data for management of an interactive application server by an application controller server during an interleaved wagering system tournament. For example, an application controller may not be aware of the relationship of the application controller to the rest of a tournament since the actual tournament play may be managed by the interactive application server. Therefore, management of an interleaved wagering system can include, but is not limited to tasks including, but not limited to, conducting tournaments according to system programming that can be coordinated by an operator of the interleaved wagering system; allowing entry of a particular user into a tournament; communicating the number of users in a tournament; and the status of the tournament (such as, but not limited to the amount of surviving users, the status of each surviving user within the game, and time remaining on the tournament); communicating the performance of users within the tournament; communicating the scores of the various users in the tournament; and providing a synchronizing link to connect the application controllers in a tournament with their respective interactive controllers.

In several embodiments, an application controller can communicate with a user management controller via a network. An application controller can communicate with a user management controller to communicate any type of data as appropriate for a specific application. Examples of data communicated between an application controller and a user management controller include, but are not limited to, data for configuring tournaments according to system programming conducted by an operator of an interleaved wagering system; data for exchange of data used to link a user's user profile to an ability to participate in various forms of interleaved wagering system use (such as but not limited to the difficulty of play set by the application controller server for an interactive application that is a skill-based interactive game); data for determining a user's ability to participate in a tournament as a function of a user's characteristics (such as but not limited to a user's prowess or other metrics used for tournament screening); data for configuring application controller and interactive controller performance to suit preferences of a user on a particular interleaved wagering system; and data for determining a user's use and wagering performance for the purposes of marketing intelligence; and data for logging secondary drawing awards, tournament prizes, RC and/or AC into the user profile.

In many embodiments, the actual location of where various process are executed can be located either on a single device (wager controller, application controller, interactive controller), on servers (wager controller, application controller, or interactive application server), or a combination of both devices and servers. In a number of embodiments, certain functions of a wager controller, application controller, user management controller and/or interactive application server can operate on a local wager controller, application controller and/or interactive controller used to construct an interleaved wagering system being provided locally on a device. In some embodiments, a controller or server can be part of a server system including multiple servers, where applications can be run on one or more physical devices. Similarly, in particular embodiments, multiple servers can be combined on a single physical device.

Figure 3A:
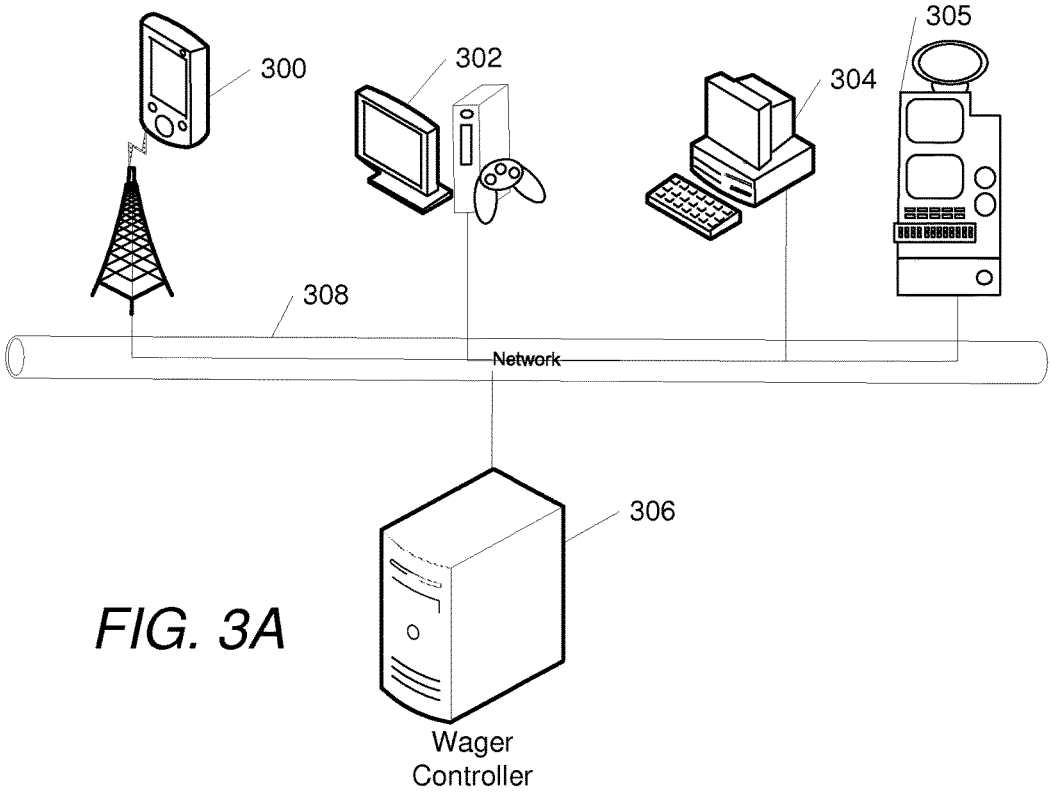
FIGS. 3A, 3B and 3C are network diagrams of distributed interleaved wagering systems in accordance with various embodiments of the invention.
Figure 3B:
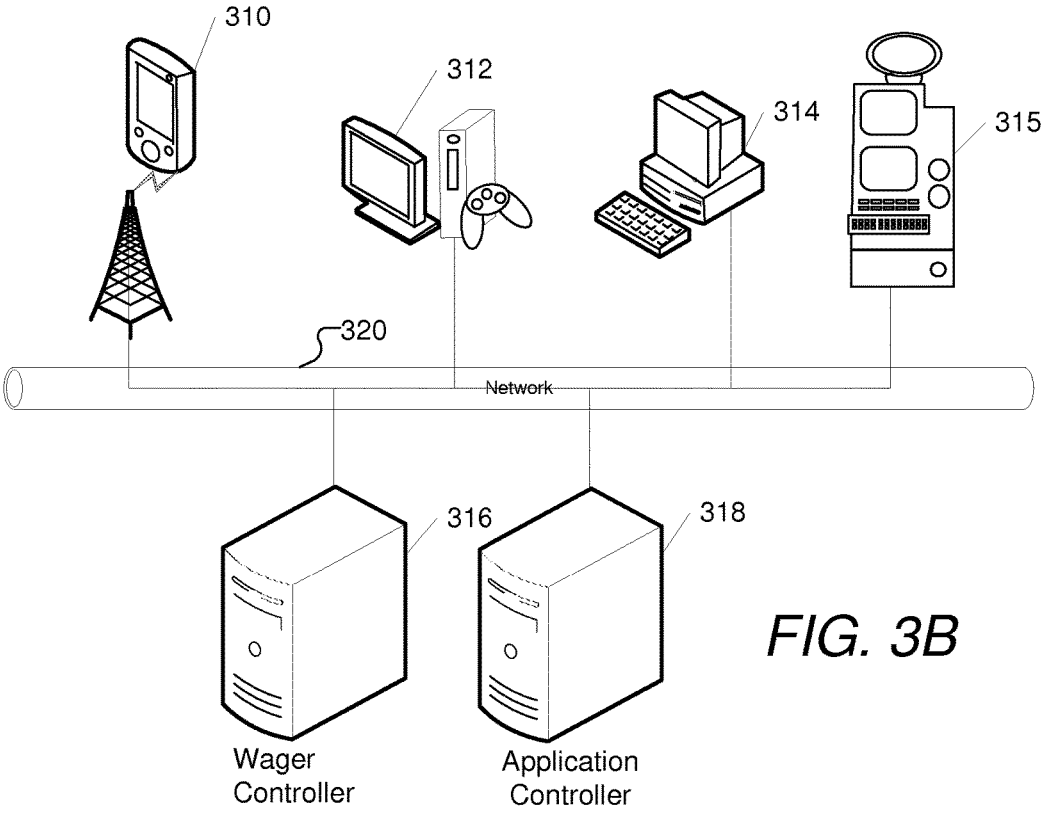
Figure 3C:
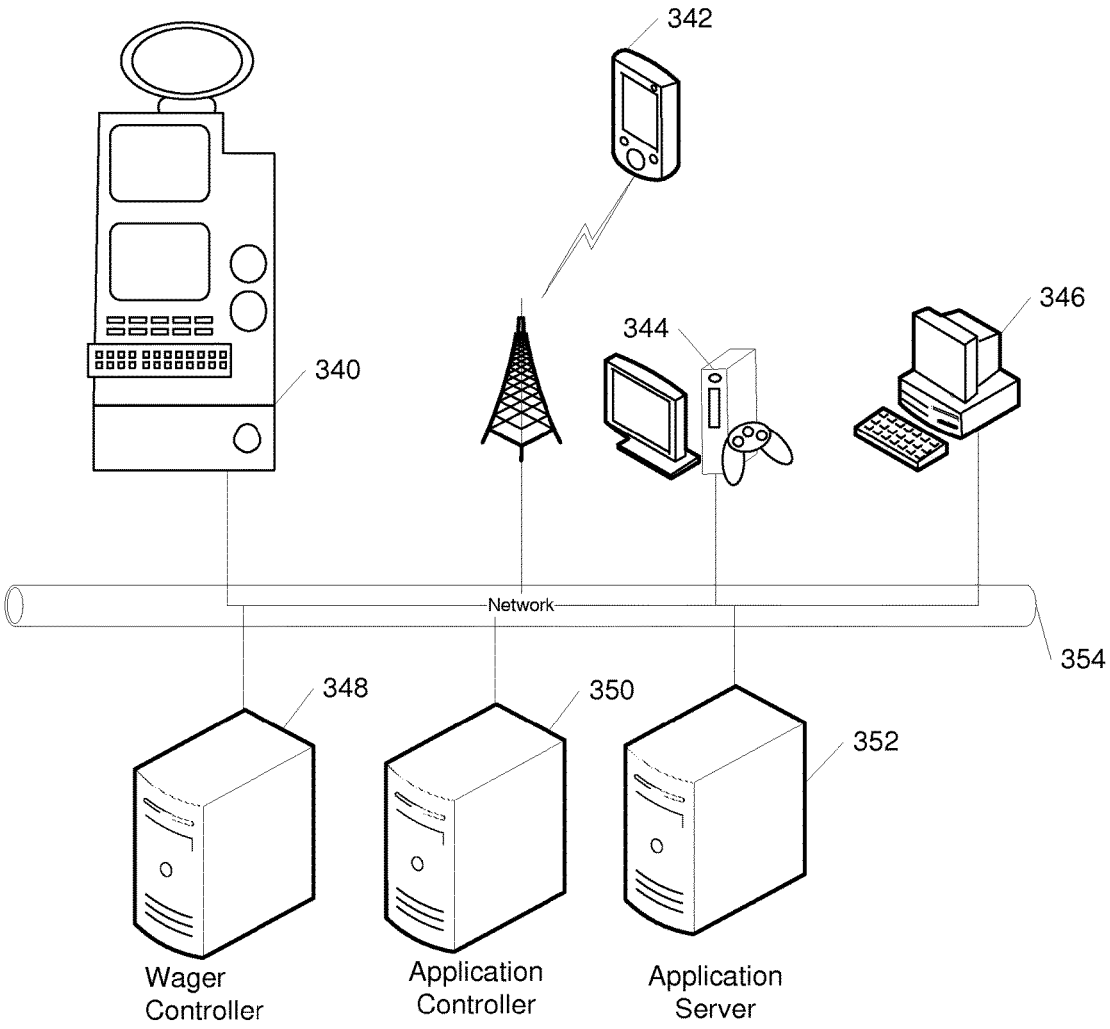

Some interleaved wagering systems in accordance with many embodiments of the invention can be distributed across a network in various configurations. FIGS. 3A, 3B and 3C are network diagrams of distributed interleaved wagering systems in accordance with various embodiments of the invention. As illustrated, one or more interactive controllers, suitable for use as interactive controller 120 of FIG. 1, of networked interleaved wagering systems, such as but not limited to, a mobile device 300, a gaming console 302, a personal computer 304, and an electronic gaming machine 305 are operatively connected with a wager controller 306 over a network 308. Network 308 is a communications network that allows processing systems communicate with each other and to share data. Examples of the network 308 can include, but are not limited to, a Local Area Network (LAN) and a Wide Area Network (WAN). In some embodiments, the processes of interactive controller 120 of FIG. 1 and application controller 112 of FIG. 1 as described herein are executed on the individual interactive controllers 300, 302, 304 and 305 while the processes of wager controller 102 of FIG. 1 as described herein can be executed by the wager controller 306.

A networked interleaved wagering system in accordance with another embodiment of the invention is illustrated in FIG. 3B. As illustrated, one or more interactive controllers, suitable for use as interactive controller 120 of FIG. 1, of networked interleaved wagering systems, such as but not limited to, a mobile device 310, a gaming console 312, a personal computer 314, and an electronic gaming machine 315, are operatively connected with a wager controller server 316 and an application controller 318 over a network 320. Network 320 is a communications network that allows processing systems to communicate and share data. Examples of the network 320 can include, but are not limited to, a Local Area Network (LAN) and a Wide Area Network (WAN). In some embodiments, the processes of interactive controller 120 of FIG. 1 as described herein are executed on the individual interactive controllers 310, 312, 314 and 315. The processes of wager controller 102 of FIG. 1 as described herein are executed by the wager controller 316 and the processes of application controller 112 of FIG. 1 as described herein are executed by the application controller 318.

A networked interleaved wagering systems in accordance with still another embodiment of the invention is illustrated in FIG. 3C. As illustrated, one or more interactive controllers, suitable for use as interactive controller 120 of FIG. 1, of networked interleaved wagering systems, such as but not limited to, a mobile device 342, a gaming console 344, a personal computer 346, and an electronic gaming machine 340 are operatively connected with a wager controller 348 and an application controller 350, and an interactive application server 352 over a network 354. Network 354 is a communications network that allows processing systems communicate and to share data. Examples of the network 354 can include, but are not limited to, a Local Area Network (LAN) and a Wide Area Network (WAN). In some embodiments, the processes of a display and user interface of an interactive controller as described herein are executed on the individual interactive controllers 340, 342, 344 and 346. The processes of a wager controller, such as wager controller 102 of FIG. 1, as described herein can be executed by the wager controller server 348. The processes of an application controller, such as application controller 112 of FIG. 1, as described herein can be executed by the application controller server 350 and the processes of an interactive controller excluding the display and user interfaces can be executed by the interactive application server 352.

In various embodiments, a user management controller may be operatively connected to components of an interleaved wagering system via a network. In other embodiments, a number of other peripheral systems, such as a user management system, a gaming establishment management system, a regulatory system, and/or hosting servers are also operatively connected with the interleaved wagering systems over a network within a firewall of an operator. Also, other servers can reside outside the bounds of a network within a firewall of the operator to provide additional services for network connected interleaved wagering systems.

Although various networked interleaved wagering systems are discussed herein, interleaved wagering systems can be networked in any configuration as appropriate to the specification of a specific application in accordance with embodiments of the invention. In some embodiments, components of a networked interleaved wagering system, such as an application controller, wager controller, interactive controller, or other servers that perform services for an application controller, wager controller and/or interactive controller, can be networked in different configurations for a specific networked interleaved wagering system application.

Figure 4A:
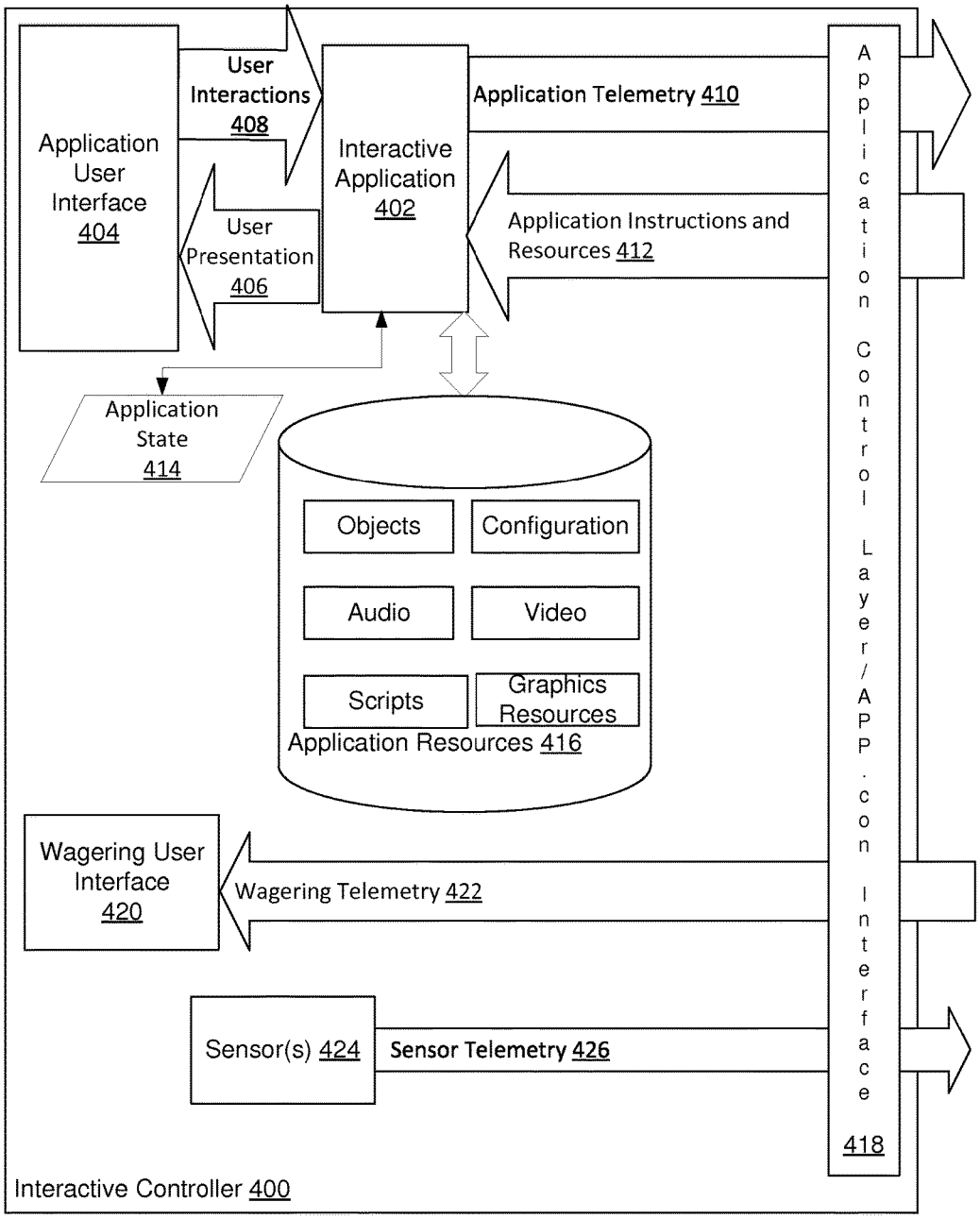
FIGS. 4A and 4B are diagrams of a structure of an interactive controller of an interleaved wagering system in accordance with various embodiments of the invention.
Figure 4B:
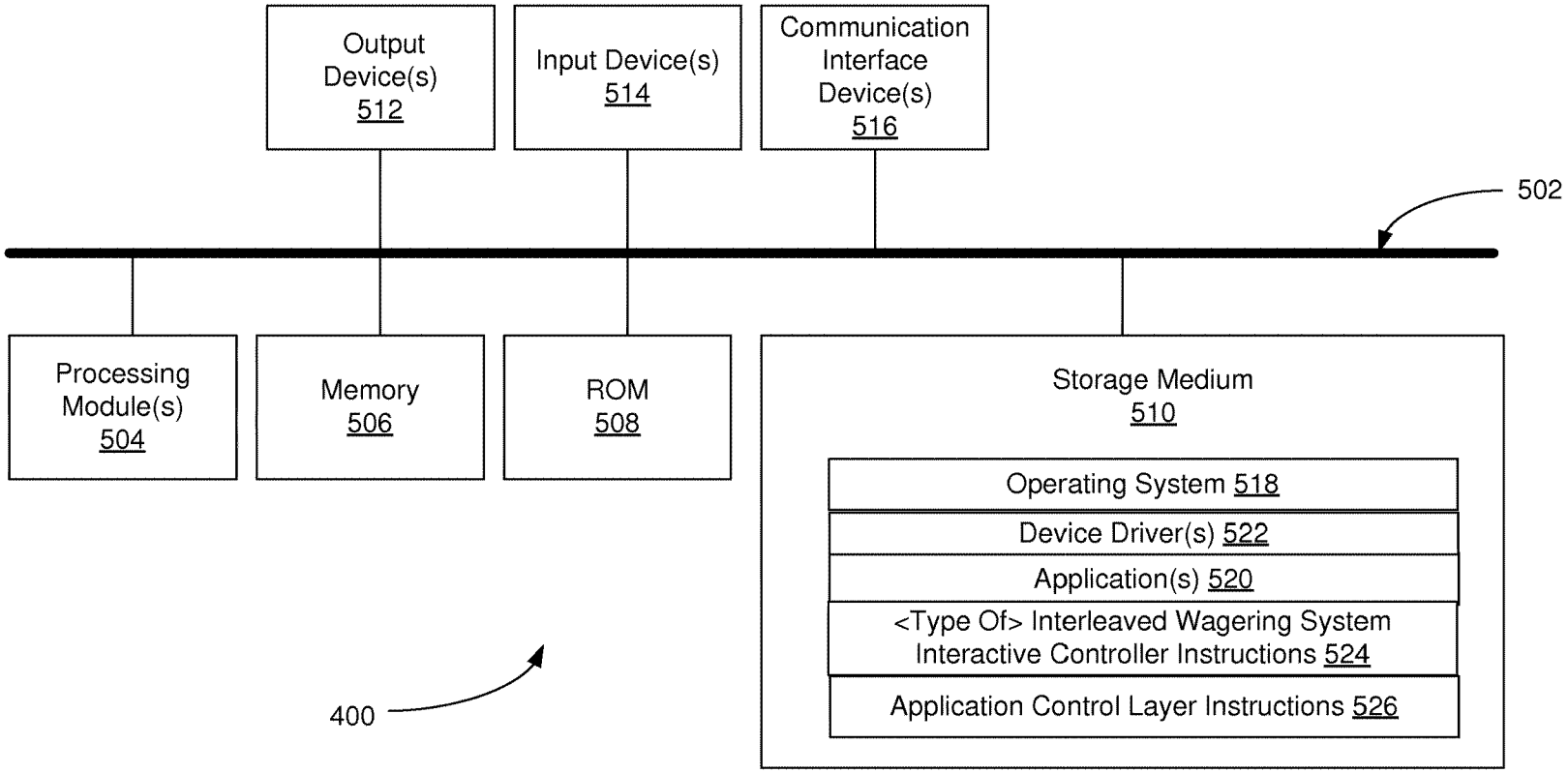

FIGS. 4A and 4B are diagrams of a structure of an interactive controller of an interleaved wagering system in accordance with various embodiments of the invention. An interactive controller may be constructed from one or more processing devices configured to perform the operations of the interactive controller. In many embodiments, an interactive controller can be constructed from various types of processing devices including, but not limited to, a mobile device such as a smartphone, a personal digital assistant, a wireless device such as a tablet computer or the like, an electronic gaming machine, a personal computer, a gaming console, a set-top box, a computing device, a controller, and the like.

Referring now to FIG. 4A, an interactive controller 400, suitable for use as interactive controller 120 of FIG. 1, provides an execution environment for an interactive application 402 of an interleaved wagering system. In several embodiments, an interactive controller 400 of an interleaved wagering system provides an interactive application 402 that generates an application user interface 404 for interaction with by a user. The interactive application 402 generates a user presentation 406 that is presented to the user through the application user interface 404. The user presentation may include audio features, visual features or tactile features, or any combination of these features. The application user interface 404 further includes one or more human input devices (HIDs) that the user can use to interact with the interleaved wagering system. The user's interactions 408 are included by the interactive application 402 in application telemetry data 410 that is communicated by interactive controller 400 to various other components of an interleaved wagering system as described herein. The interactive application 402 receives application instructions and resources 412 communicated from various other components of an interleaved wagering system as described herein.

Various components of the interactive application 402 can read data from an application state 414 in order to provide the features of the interactive application. In some embodiments, components of the interactive application 402 can include, but are not limited to, a physics engine, a rules engine, and/or a graphics engine. The physics engine is used to simulate physical interactions between virtual objects in the interactive application 402. The rules engine implements the rules of the interactive application and a P/RNG that may be used for influencing or determining certain variables and/or outcomes to provide a randomizing influence on the operations of the interactive application. The graphics engine is used to generate a visual representation of the interactive application state to the user. Furthermore, the components may also include an audio engine to generate audio outputs for the user interface.

During operation, the interactive application reads and writes application resources 416 stored on a data store of the interactive controller host. The game resources 416 may include game objects having graphics and/or control logic used to provide application environment objects of the interactive application. In various embodiments, the game resources may also include, but are not limited to, video files that are used to generate a portion of the user presentation 406; audio files used to generate music, sound effects, etc. within the interactive application; configuration files used to configure the features of the interactive application; scripts or other types of control code used to provide various features of the interactive application; and graphics resources such as textures, objects, etc. that are used by a graphics engine to render objects displayed in an interactive application.

In operation, components of the interactive application 402 read portions of the application state 414 and generate the user presentation 406 for the user that is presented to the user using the user interface 212. The user perceives the user presentation and provides user interactions 408 using the HIDs. The corresponding user interactions are received as user actions or inputs by various components of the interactive application 402. The interactive application 402 translates the user actions into interactions with the virtual objects of the application environment stored in the application state 414. Components of the interactive application use the user interactions with the virtual objects of the interactive application and the interactive application state 414 to update the application state 414 and update the user presentation 406 presented to the user. The process loops in a loop continuously while the user interacts with the interactive application of the interleaved wagering system.

The interactive controller 400 provides one or more interfaces 418 between the interactive controller 400 and other components of an interleaved wagering system, such as, but not limited to, an application controller. The interactive controller 400 and the other interleaved wagering system components communicate with each other using the interfaces. The interface may be used to pass various types of data; and to communicate and receive messages, status data, commands and the like. In certain embodiments, the interactive controller 400 and an application controller communicate application instructions and environment resources 412 and application telemetry data 410. In some embodiments, the communications include requests by the application controller that the interactive controller 400 update the application state 414 using data provided by the application controller. In many embodiments, a communication by the application controller requests that the interactive controller 400 update one or more resources 416 using data provided by the application controller. In a number of embodiments, the interactive controller 400 provides all or a portion of the application state to an application 430. In some embodiments, the interactive controller 400 may also provide data about one or more of the application resources 416 to the application controller. In some embodiments, the communication includes user interactions that the interactive controller 400 communicates to the application controller. The user interactions may be low level user interactions with the user interface 404, such as manipulation of a HID, or may be high level interactions with game objects as determined by the interactive application. The user interactions may also include resultant actions such as modifications to the application state 414 or game resources 416 resulting from the user's interactions taken in the interleaved wagering system interactive application. In some embodiments, user interactions include, but are not limited to, actions taken by entities such as non-player characters (NPC) of the interactive application that act on behalf of or under the control of the user.

In some embodiments, the interactive controller 400 includes an interleaved wagering system user interface 420 used to communicate interleaved wagering system telemetry data 422 to and from the user. The interleaved wagering system telemetry data 422 from the interleaved wagering system include, but are not limited to, data used by the user to configure RC, AC and element wagers, and data about the wagering game RC, AC and element wagers such as, but not limited to, RC, AC and element balances and RC, AC and element amounts wagered.

In some embodiments, the interactive controller includes one or more sensors 424. Such sensors may include, but are not limited to, physiological sensors that monitor the physiology of the user, environmental sensors that monitor the physical environment of the interactive controller, accelerometers that monitor changes in motion of the interactive controller, and location sensors that monitor the location of the interactive controller such as global positioning sensors (GPSs). The interactive controller 400 communicates sensor telemetry data 426 to one or more components of the interleaved wagering system.

Referring now to FIG. 4B, interactive controller 400 includes a bus 502 that provides an interface for one or more processing modules 504, random access memory (RAM) 506, read only memory (ROM) 508, machine-readable storage medium 510, one or more user output devices 512, one or more user input devices 514, and one or more communication interface devices 516.

The one or more processing modules 504 may take many forms, such as, but not limited to: one or more processors; a central processing unit (CPU); a multi-processor unit (MPU); an ARM processor; a controller; a programmable logic device; or the like.

Examples of output devices 512 include, but are not limited to, display screens; light panels; and/or lighted displays. In accordance with particular embodiments, the one or more processing modules 504 are operatively connected to audio output devices such as, but not limited to: speakers; and/or sound amplifiers. In accordance with many of these embodiments, the one or more processing modules 504 are operatively connected to tactile output devices like vibrators, and/or manipulators.

Examples of user input devices 514 include, but are not limited to: tactile devices including but not limited to, keyboards, keypads, foot pads, touch screens, and/or trackballs; non-contact devices such as audio input devices; motion sensors and motion capture devices that the interactive controller can use to receive inputs from a user when the user interacts with the interactive controller; physiological sensors that monitor the physiology of the user; environmental sensors that monitor the physical environment of the interactive controller; accelerometers that monitor changes in motion of the interactive controller; and location sensors that monitor the location of the interactive controller such as global positioning sensors.

The one or more communication interface devices 516 provide one or more wired or wireless interfaces for communicating data and commands between the interactive controller 400 and other devices that may be included in an interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a POTS, cellular or satellite telephone network; and the like.

The machine-readable storage medium 510 stores machine-executable instructions for various components of the interactive controller, such as but not limited to: an operating system 518; one or more device drivers 522; one or more application programs 520 including but not limited to an interactive application; and interleaved wagering system interactive controller instructions 524 for use by the one or more processing modules 504 to provide the features of an interactive controller as described herein. In some embodiments, the machine-executable instructions further include application control layer/application control interface instructions 526 for use by the one or more processing modules 504 to provide the features of an application control layer/application control interface as described herein.

In various embodiments, the machine-readable storage medium 510 is one of a (or a combination of two or more of) a hard drive, a flash drive, a DVD, a CD, a flash storage, a solid state drive, a ROM, an EEPROM, and the like.

In operation, the machine-executable instructions are loaded into memory 506 from the machine-readable storage medium 510, the ROM 508 or any other storage location. The respective machine-executable instructions are accessed by the one or more processing modules 504 via the bus 502, and then executed by the one or more processing modules 504. Data used by the one or more processing modules 504 are also stored in memory 506, and the one or more processing modules 504 access such data during execution of the machine-executable instructions. Execution of the machine-executable instructions causes the one or more processing modules 504 to control the interactive controller 400 to provide the features of an interleaved wagering system interactive controller as described herein Although the interactive controller is described herein as being constructed from one or more processing modules and instructions stored and executed by hardware components, the interactive controller can be constructed of only hardware components in accordance with other embodiments. In addition, although the storage medium 510 is described as being operatively connected to the one or more processing modules through a bus, those skilled in the art of interactive controllers will understand that the storage medium can include removable media such as, but not limited to, a USB memory device, an optical CD ROM, magnetic media such as tape and disks. In some embodiments, the storage medium 510 can be accessed by the one or more processing modules 504 through one of the communication interface devices 516 or over a network. Furthermore, any of the user input devices or user output devices can be operatively connected to the one or more processing modules 504 via one of the communication interface devices 516 or over a network.

In some embodiments, the interactive controller 400 can be distributed across a plurality of different devices. In many such embodiments, an interactive controller of an interleaved wagering system includes an interactive application server operatively connected to an interactive client over a network. The interactive application server and interactive application client cooperate to provide the features of an interactive controller as described herein.

In various embodiments, the interactive controller 400 may be used to construct other components of an interleaved wagering system as described herein.

In some embodiments, components of an interactive controller and an application controller of an wagering interleaved system may be constructed from a single device using processes that communicate using an interprocess communication protocol. In other such embodiments, the components of an interactive controller and an application controller of an wagering interleaved system may communicate by passing messages, parameters or the like.

In some embodiments, components of an interactive controller, an application controller and a wager controller of an wagering interleaved system may be constructed using a single device using processes that communicate using an interprocess communication protocol. In other such embodiments, the components of an interactive controller, an application controller and a wager controller of an wagering interleaved system may communicate by passing messages, parameters or the like.

Figure 5A:
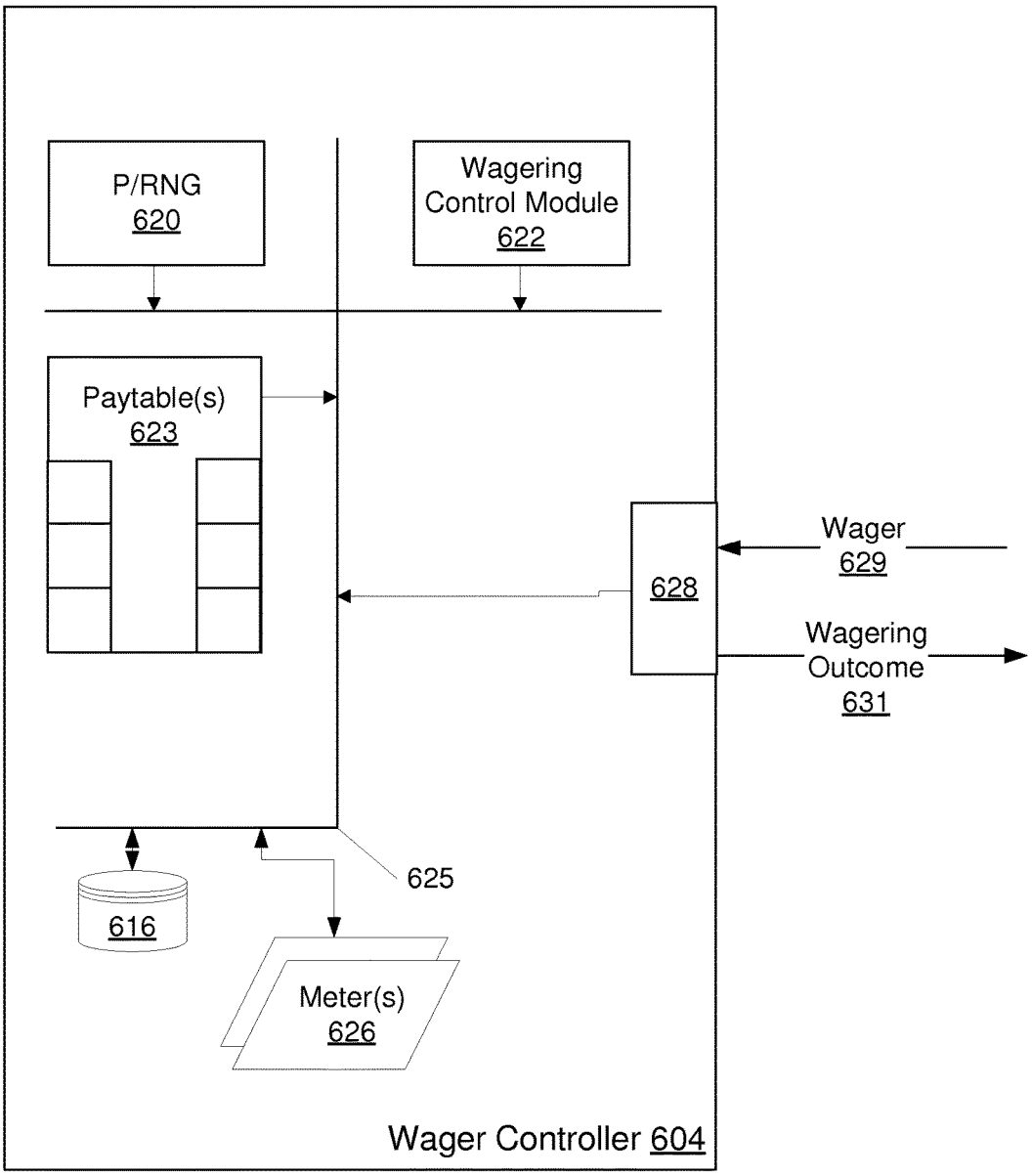
FIGS. 5A and 5B are diagrams of a structure of a wager controller of an interleaved wagering system in accordance with various embodiments of the invention.
Figure 5B:
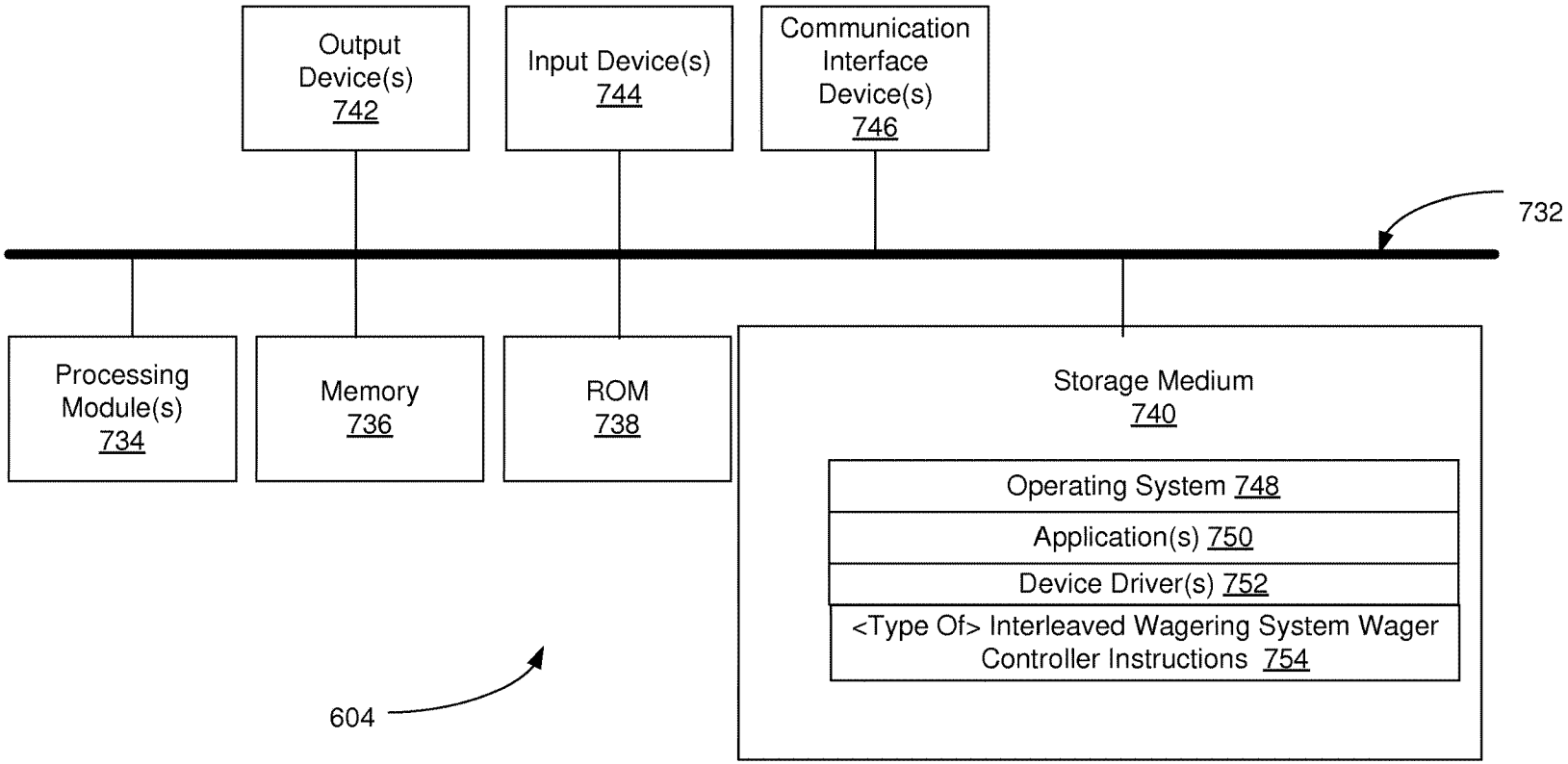

FIGS. 5A and 5B are diagrams of a structure of a wager controller of an interleaved wagering system in accordance with various embodiments of the invention. A wager controller may be constructed from one or more processing devices configured to perform the operations of the wager controller. In many embodiments, a wager controller can be constructed from various types of processing devices including, but not limited to, a mobile device such as a smartphone, a personal digital assistant, a wireless device such as a tablet computer or the like, an electronic gaming machine, a personal computer, a gaming console, a set-top box, a computing device, a controller, or the like.

In various embodiments, a wager controller 604, suitable for use as wager controller 102 of interleaved wagering system 128 (both of FIG. 1), includes a pseudorandom or random number generator (P/RNG) 620 to produce random results or pseudo random results; one or more paytables 623 which includes a plurality of factors indexed by the random result to be multiplied with an amount of RC, AC, elements, or objects committed in a wager; and a wagering control module 622 whose processes may include, but are not limited to, pulling random results, looking up factors in the paytables, multiplying the factors by an amount of RC, AC, elements, or objects wagered, and administering one or more RC, AC, element, or object meters 626. The various wager controller components can interface with each other via an internal bus 625 and/or other appropriate communication mechanism.

An interface 628 allows the wager controller 604 to operatively connect to an external device, such as one or more application controllers as described herein. The interface 628 provides for receiving of wager data 629 from the external device that is used to specify wager parameters and/or trigger execution of a wager by the wager controller 604. The interface 628 may also provide for communicating wager outcome data 631 to an external device. In numerous embodiments, the interface between the wager controller 604 and other systems/devices may be a wide area network (WAN) such as the Internet. However, other methods of communication may be used including, but not limited to, a local area network (LAN), a universal serial bus (USB) interface, and/or some other method by which two electronic devices could communicate with each other.

In various embodiments, a wager controller 604 may use a P/RNG provided by an external system. The external system may be connected to the wager controller 604 by a local area network (LAN) or a wide area network (WAN). In some embodiments, the external P/RNG is a central deterministic system that provides random or pseudo random results to one or more connected wager controllers.

During operation of the wager controller, the external system communicates wager data 629 to the wager controller 604. The wager controller 604 receives the wager data and uses the wager data to trigger execution of a wager in accordance with a wagering proposition. The wager controller 604 executes the wager and determines a wager outcome for the wager. The wager controller communicates wager outcome data 631 of the wager outcome to the external system.

In some embodiments, the wager controller uses the wager data to select a paytable 628 to use and/or an amount of RC, AC, elements, or objects to wager.

In some embodiments, the wager outcome data may include, but is not limited to, an amount of RC, AC, elements, or objects won in the wager.

In various embodiments, the wager outcome data may include, but is not limited to, an amount of RC, AC, elements, or objects in one or more meters 626.

In some embodiments, the wager outcome data includes state data for the wagering proposition of the executed wager. The state data may correspond to one or more game states of a gambling game that is associated with the wagering proposition. Examples of state data include, but are not limited to, reel strips in an operation state or a final state for a reel-based gambling game, one or more final dice positions for a dice-based gambling game, positions of a roulette wheel and roulette ball, position of a wheel of fortune, or the like.

In various embodiments, the wagering control module 622 determines an amount of a wager and a paytable to use from the one or more paytables 623. In such embodiments, in response to the wager data triggering execution of the wager, the wager control module 622 executes the wager by requesting a P/RNG result from the P/RNG 620; retrieving a paytable from the one or more paytables 623; adjusting the one or more credit meters 626 for an amount of the wager; applying the P/RNG result to the retrieved paytable; multiplying the resultant factor from the paytable by an amount wagered to determine a wager outcome; updating the one or more meters 626 based on the wager outcome; and communicating the wager outcome to the external device.

In various embodiments, an external system communicates a request for a P/RNG result from the wager controller 604. In response, the wager controller 604 returns a P/RNG result as a function of an internal P/RNG or a P/RNG external to the external system to which the wager controller 604 is operatively connected.

In some embodiments, a communication exchange between the wager controller 604 and an external system relate to the external system support for coupling a P/RNG result to a particular paytable contained in the wager controller 604. In such an exchange, the external system communicates to the wager controller 604 as to which of the one or more paytables 623 to use, and requests a result whereby the P/RNG result would be associated with the requested paytable 623. The result of the coupling is returned to the external system. In such an exchange, no actual RC, AC, element, or object wager is conducted, but might be useful in coupling certain non-value wagering interactive application behaviors and propositions to the same final resultant wagering return which is understood for the interleaved wagering system to conduct wagering.

In some embodiments, the wager controller 604 may also include storage for statuses, wagers, wager outcomes, meters and other historical events in a storage device 616.

In some embodiments, an authorization access module provides a process to permit access and command exchange with the wager controller 604 and access to the one or more credit meters 626 for the amount of RC, AC, elements, or objects being wagered by the user in the interleaved wagering system.

In numerous embodiments, communication occurs between various types of a wager controller and an external system 630, such as application controller. In some of these embodiments, the purpose of the wager controller is to allocate wagers to pools, detect occurrences of one or more events upon which the wagers were made, and determine the wager outcomes for each individual wager based on the number of winning wagers and the amount paid into the pool.

In some embodiments, the wager controller manages accounts for individual users wherein the users make deposits into the accounts, amounts are deducted from the accounts, and amounts are credited to the users' accounts based on the wager outcomes.

In some embodiments a wager controller is a pari-mutuel wagering system such as used for wagering on an events such as horse races, greyhound races, sporting events and the like. In a pari-mutuel wagering system, user's wagers on the outcome of an event are allocated to a pool. When the event occurs, wager outcomes are calculated by sharing the pool among all winning wagers.

In various embodiments, a wager controller is a central determination system, such as but not limited to a central determination system for a Class II wagering system or a wagering system in support of a "scratch off" style lottery. In such a wagering system, a player plays against other players and competes for a common prize. In a given set of wager outcomes, there are a certain number of wins and losses. Once a certain wager outcome has been determined, the same wager outcome cannot occur again until a new set of wager outcomes is generated.

In numerous embodiments, communication occurs between various components of a wager controller 604 and an external system, such as an application controller. In some of these embodiments, the purpose of the wager controller 604 is to manage wagering on wagering events and to provide random (or pseudo random) outcomes from a P/RNG.

Referring now to FIG. 5B, wager controller 604 includes a bus 732 that provides an interface for one or more processing modules 734, random access memory (RAM) 736, read only memory (ROM) 738, machine-readable storage medium 740, one or more user output devices 742, one or more user input devices 744, and one or more network interface devices 746.

The one or more processing modules 734 may take many forms, such as, but not limited to: one or more processors; a central processing unit (CPU); a multi-processor unit (MPU); an ARM processor; a controller; a programmable logic device or the like.

Examples of output devices 742 include, but are not limited to, display screens, light panels, and/or lighted displays. In accordance with particular embodiments, the one or more processing modules 734 are operatively connected to audio output devices such as, but not limited to speakers, and/or sound amplifiers. In accordance with many of these embodiments, the one or more processing modules 734 are operatively connected to tactile output devices like vibrators, and/or manipulators.

Examples of user input devices 734 include, but are not limited to, tactile devices including but not limited to, keyboards, keypads, touch screens, and/or trackballs; non-contact devices such as audio input devices; motion sensors and motion capture devices that the wager controller can use to receive inputs from a user when the user interacts with the wager controller 604.

The one or more network interface devices 746 provide one or more wired or wireless interfaces for exchanging data and commands between the wager controller 604 and other devices that may be included in an interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a POTS, cellular or satellite telephone network; and the like.

The machine-readable storage medium 740 stores machine-executable instructions for various components of a wager controller, such as but not limited to: an operating system 748; one or more application programs 750; one or more device drivers 752; and interleaved wagering system wager controller instructions 754 for use by the one or more processing modules 734 to provide the features of an interleaved wagering system wager controller as described herein.

In various embodiments, the machine-readable storage medium 740 is one of a (or a combination of two or more of)

a hard drive, a flash drive, a DVD, a CD, a flash storage, a solid state drive, a ROM, an EEPROM, and the like.

In operation, the machine-executable instructions are loaded into memory 736 from the machine-readable storage medium 740, the ROM 738 or any other storage location. The respective machine-executable instructions are accessed by the one or more processing modules 734 via the bus 732, and then executed by the one or more processing modules 734. Data used by the one or more processing modules 734 are also stored in memory 736, and the one or more processing modules 734 access such data during execution of the machine-executable instructions. Execution of the machine-executable instructions causes the one or more processing modules 734 to control the wager controller 604 to provide the features of an interleaved wagering system wager controller as described herein Although the wager controller 604 is described herein as being constructed from one or more processing modules and machine-executable instructions stored and executed by hardware components, the wager controller can be composed of only hardware components in accordance with other embodiments. In addition, although the storage medium 740 is described as being operatively connected to the one or more processing modules through a bus, those skilled in the art of processing devices will understand that the storage medium can include removable media such as, but not limited to, a USB memory device, an optical CD ROM, magnetic media such as tape and disks. In some embodiments, the storage medium 740 can be accessed by the one or more processing modules 734 through one of the interfaces or over a network. Furthermore, any of the user input devices or user output devices can be operatively connected to the one or more processing modules 734 via one of the interfaces or over a network.

In various embodiments, the wager controller 604 may be used to construct other components of an interleaved wagering system as described herein.

In some embodiments, components of a wager controller and an application controller of an wagering interleaved system may be constructed from a single device using processes that communicate using an interprocess communication protocol. In other such embodiments, the components of a wager controller and an application controller of an wagering interleaved system may communicate by passing messages, parameters or the like.

It should be understood that there may be many embodiments of a wager controller 604 which could be possible, including forms where many modules and components of the wager controller are located in various servers and locations, so the foregoing is not meant to be exhaustive or all inclusive, but rather provide data on various embodiments of a wager controller 604.

Figure 6A:
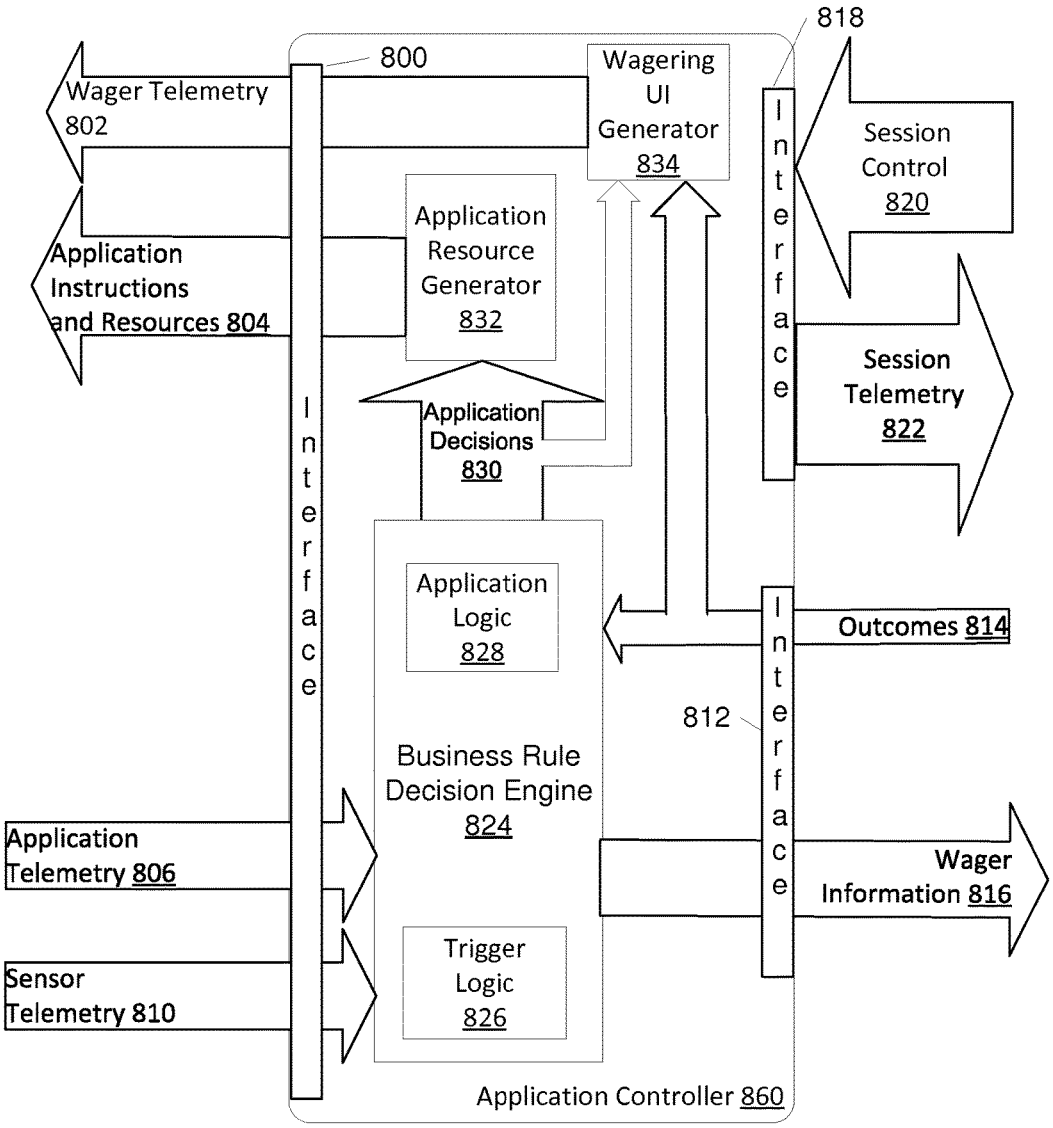
FIGS. 6A and 6B are diagrams of a structure of an application controller of an interleaved wagering system in accordance with various embodiments of the invention.
Figure 6B:
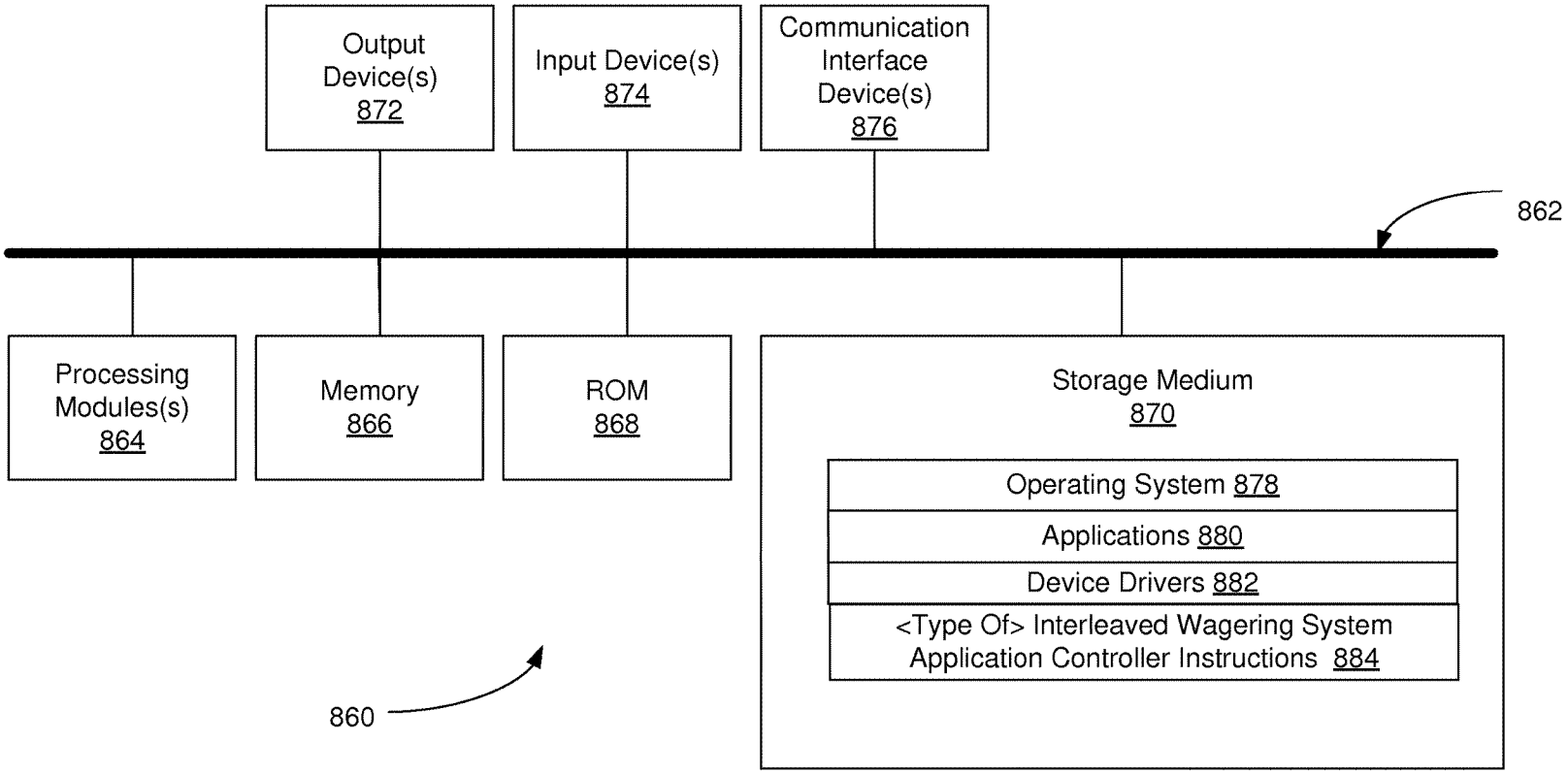

FIGS. 6A and 6B are diagrams of a structure of an application controller of an interleaved wagering system in accordance with various embodiments of the invention. An application controller may be constructed from one or more processing devices configured to perform the operations of the application controller. In many embodiments, an application controller can be constructed from various types of processing devices including, but not limited to, a mobile device such as a smartphone, a personal digital assistant, a wireless device such as a tablet computer or the like, an electronic gaming machine, a personal computer, a gaming console, a set-top box, a computing device, a controller, or the like.

Referring now to FIG. 6A, in many embodiments, an application controller 860, suitable for use as application controller 112 of FIG. 1, manages operation of an interleaved wagering system, with a wager controller and an interactive controller being support units to the application controller 860. The application controller 860 provides an interface between the interactive application, provided by an interactive controller, and a wagering proposition, provided by a wager controller.

In some embodiments, the application controller 860 includes an interactive controller interface 800 to an interactive controller. The interactive controller interface 800 provides for communication of data between an interactive controller and the application controller 860, including but not limited to wager telemetry data 802, application instructions and resources 804, application telemetry data 806, and sensor telemetry data 810.

In various embodiments, the application controller 860 includes a wager controller interface 812 to a wager controller. The wager controller interface 812 provides for communication of data between the application controller 860 and a wager controller, including but not limited to wager outcomes 814 and wager data 816.

In some embodiments, the application controller 860 includes a user management controller interface 818 to a user management controller. The user management controller interface 818 provides for communication of data between the application controller 860 and a user management controller, including but not limited to session control data 820 and session telemetry data 822.

The application controller 860 includes a business rule decision engine 824 that receives telemetry data, such as application telemetry data and sensor telemetry data, from an interactive controller. The business rule decision engine 824 uses the telemetry data, along with trigger logic 826 to generate wager data used to trigger a wager in a wager controller.

In some embodiments, the application telemetry data includes, but is not limited to, application environment variables that indicate the state of an interactive application being used by a user, interactive controller data indicating a state of an interactive controller, and user actions and interactions between a user and an interactive application provided by an interactive controller. The wagering and/or wager data may include, but is not limited to, an amount and type of the wager, a trigger of the wager, and a selection of a paytable to be used when executing the wager.

In some embodiments, the business rule decision engine 824 also receives wager outcome data from a wager controller. The decision engine 824 uses the wager outcome data, in conjunction with telemetry data and application logic 828 to generate application decisions 830 communicated to an application resource generator 832. The application resource generator 832 receives the application decisions and uses the application decisions to generate application instructions and application resources to be communicated to an interactive application.

In many embodiments, the application controller 860 includes a pseudo random or random result generator used to generate random results that are communicated to the application resource generator 832. The application resource generator uses the random results to generate application instructions and application resources to be communicated to an interactive controller for use by an interactive application.

In various embodiments, the business rule decision engine 824 also determines an amount of AC to award to a user based at least in part on the user's use of an interactive application of the interleaved wagering system as determined from application telemetry data. In some embodiments, wager outcome data may also be used to determine the amount of AC that should be awarded to the user.

In numerous embodiments, an interactive application is a skill-based game and the AC is awarded to the user for the user's skillful play of the skill-based game.

In some embodiments, the application decisions and wager outcome data are communicated to a wagering user interface generator 834. The wagering user interface generator 834 receives the application decisions and wager outcome data and generates wager telemetry data describing the state of wagering and credit accumulation and loss for the interleaved wagering system. In some embodiments, the wager telemetry data 146 may include, but is not limited to, amounts of AC and elements earned, lost or accumulated by the user through use of the interactive application as determined from the application decisions, and RC amounts won, lost or accumulated as determined from the wager outcome data and the one or more credit meters.

In some embodiments, the wager outcome data 814 also includes data about one or more game states of a gambling game executed in accordance with a wagering proposition by a wager controller. In various such embodiments, the wagering user interface generator 834 generates a gambling game process display and/or gambling game state display using the one or more game states of the gambling game. The gambling game process display and/or gambling game state display is included in wager telemetry data that is communicated to an interactive controller. The gambling game process display and/or a gambling game state display is displayed by a wagering user interface of the interactive controller to a user. In other such embodiments, the one or more game states of the gambling game are communicated to an interactive controller and a wagering user interface of the interactive controller generates a gambling game process display and/or gambling game state display using the one or more game states of the gambling game for display to a user.

The application controller 860 can further operatively connect to a wager controller to determine an amount of credit or elements available and other wagering metrics of a wagering proposition. Thus, the application controller 860 may potentially affect an amount of RC in play for participation in the wagering events of a wagering game provided by the wager controller. The application controller 860 may additionally include various audit logs and activity meters. In some embodiments, the application controller 860 can also couple to a centralized server for exchanging various data related to the user and the activities of the user during game play of an interleaved wagering system.

In some embodiments, the operation of the application controller 860 does not affect the provision of a wagering proposition by a wager controller except for user choice parameters that are allowable in accordance with the wagering proposition. Examples of user choice parameters include, but are not limited to: wager terms such as but not limited to a wager amount; speed of game play (for example, by pressing a button or pulling a handle of a slot machine); and/or agreement to wager into a bonus round.

In a number of embodiments, communication of wager data between a wager controller and the application controller 860 can further be used to communicate various wagering control factors that the wager controller uses as input. Examples of wagering control factors include, but are not limited to, an amount of RC, AC, elements, or objects consumed per wagering event, and/or the user's election to enter a jackpot round.

In some embodiments, the application controller 860 utilizes a wagering user interface to communicate certain interactive application data to the user, including but not limited to, club points, user status, control of the selection of user choices, and messages which a user can find useful in order to adjust the interactive application experience or understand the wagering status of the user in accordance with the wagering proposition in the wager controller.

In some embodiments, the application controller 860 utilizes a wagering user interface to communicate aspects of a wagering proposition to the user including, but not limited to, odds of certain wager outcomes, amount of RC, AC, elements, or objects in play, and amounts of RC, AC, elements, or objects available.

In a number of embodiments, a wager controller can accept wager proposition factors including, but not limited to, modifications in the amount of RC, AC, elements, or objects wagered on each individual wagering event, a number of wagering events per minute the wager controller can resolve, entrance into a bonus round, and other factors. In several embodiments, the application controller 860 can communicate a number of factors back and forth to the wager controller, such that an increase/decrease in a wagered amount can be related to the change in user profile of the user in the interactive application. In this manner, a user can control a wager amount per wagering event in accordance with the wagering proposition with the change mapping to a parameter or component that is applicable to the interactive application experience.

Referring now to FIG. 6B, application controller 860 includes a bus 862 providing an interface for one or more processing modules 864, random access memory (RAM) 866, read only memory (ROM) 868, machine-readable storage medium 870, one or more user output devices 872, one or more user input devices 874, and one or more network interface devices 876.

The one or more processing modules 864 may take many forms, such as, but not limited to: one or more processors; a central processing unit (CPU); a multi-processor unit (MPU); an ARM processor; a programmable logic device; or the like.

Examples of output devices 872 include, include, but are not limited to: display screens; light panels; and/or lighted displays. In accordance with particular embodiments, the one or more processing modules 864 are operatively connected to audio output devices such as, but not limited to: speakers; and/or sound amplifiers. In accordance with many of these embodiments, the one or more processing modules 864 are operatively connected to tactile output devices like vibrators, and/or manipulators.

Examples of user input devices 874 include, but are not limited to: tactile devices including but not limited to, keyboards, keypads, foot pads, touch screens, and/or trackballs; non-contact devices such as audio input devices; motion sensors and motion capture devices that the application controller can use to receive inputs from a user when the user interacts with the application controller 860.

The one or more network interface devices 876 provide one or more wired or wireless interfaces for exchanging data and commands between the application controller 860 and other devices that may be included in an interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a POTS, cellular or satellite telephone network; and the like.

The machine-readable storage medium 870 stores machine-executable instructions for various components of the application controller 860 such as, but not limited to: an operating system 878; one or more applications 880; one or more device drivers 882; and interleaved wagering system wager controller instructions 854 for use by the one or more processing modules 864 to provide the features of a wager controller as described herein.

In various embodiments, the machine-readable storage medium 870 is one of a (or a combination of two or more of) a hard drive, a flash drive, a DVD, a CD, a flash storage, a solid state drive, a ROM, an EEPROM, and the like.

In operation, the machine-executable instructions are loaded into memory 866 from the machine-readable storage medium 870, the ROM 868 or any other storage location. The respective machine-executable instructions are accessed by the one or more processing modules 864 via the bus 862, and then executed by the one or more processing modules 864. Data used by the one or more processing modules 864 are also stored in memory 866, and the one or more processing modules 864 access such data during execution of the machine-executable instructions. Execution of the machine-executable instructions causes the one or more processing modules 864 to control the application controller 860 to provide the features of an interleaved wagering system application controller as described herein.

Although the application controller 860 is described herein as being constructed from one or more processing modules and instructions stored and executed by hardware components, the application controller can be composed of only hardware components in accordance with other embodiments. In addition, although the storage medium 870 is described as being operatively connected to the one or more processing modules through a bus, those skilled in the art of application controllers will understand that the storage medium can include removable media such as, but not limited to, a USB memory device, an optical CD ROM, magnetic media such as tape and disks. Also, the storage medium 870 can be accessed by processor 864 through one of the interfaces or over a network. Furthermore, any of the user input devices or user output devices can be operatively connected to the one or more processing modules 864 via one of the interfaces or over a network.

In various embodiments, the application controller 860 may be used to construct other components of an interleaved wagering system as described herein.

In some embodiments, components of wager controller and an application controller of an wagering interleaved system may be constructed using a single device using processes that communicate using an interprocess communication protocol. In other such embodiments, the components of a wager controller and an application controller of an wagering interleaved system may communicate by passing messages, parameters or the like.

In numerous embodiments, any of a wager controller, an application controller, or an interactive controller as described herein can be constructed using multiple processing devices, whether dedicated, shared, or distributed in any combination thereof, or can be constructed using a single processing device. In addition, while certain aspects and features of interleaved wagering system processes described herein have been attributed to a wager controller, an application controller, or an interactive controller, these aspects and features can be provided in a distributed form where any of the features or aspects can be provided by any of a wager controller, an application controller, and/or an interactive controller within an interleaved wagering system without deviating from the spirit of the invention.

Although various components of interleaved wagering systems are discussed herein, interleaved wagering systems can be configured with any component as appropriate to the specification of a specific application in accordance with embodiments of the invention. In certain embodiments, components of an interleaved wagering system, such as an application controller, a wager controller, and/or an interactive controller, can be configured in different ways for a specific interleaved wagering system.

Operation of Wagering Interleaved Systems

Figure 7:
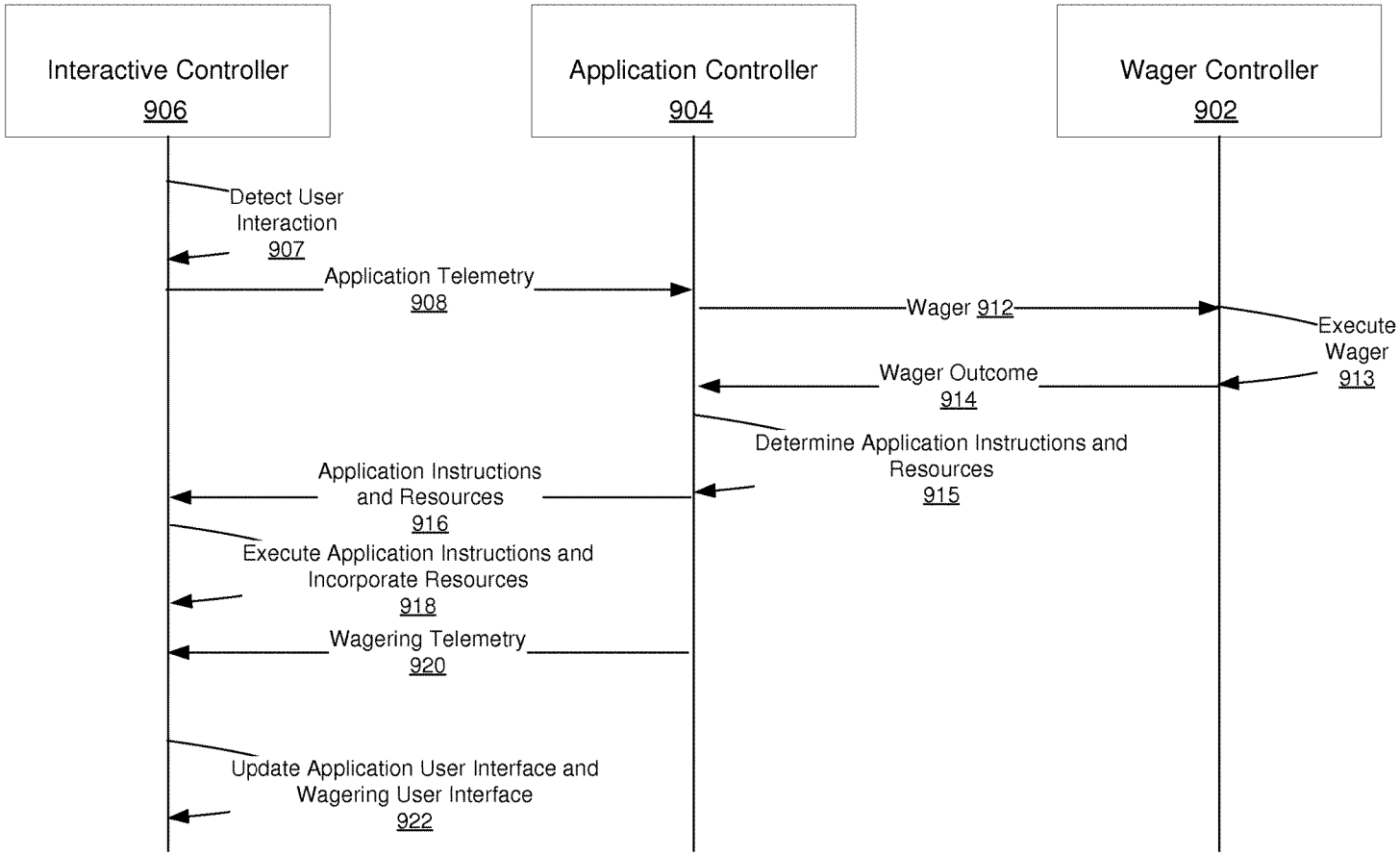
FIG. 7 is a sequence diagram of interactions between components of an interleaved wagering system in accordance with various embodiments of the invention.

FIG. 7 is a sequence diagram of interactions between components of an interleaved wagering system in accordance with various embodiment of the invention. The components of the interleaved wagering system include a wager controller 902, such as wager controller 102 of FIG. 1, an application controller 904, such as application controller 112 of FIG. 1, and an interactive controller 906, such as interactive controller 120 of FIG. 1. The process begins with the interactive controller 906 detecting a user performing a user interaction in a user interface of an interactive application provided by the interactive controller 906. The interactive controller 906 communicates application telemetry data 908 to the application controller 904. The application telemetry data includes, but is not limited to, the user interaction detected by the interactive controller 906.

The application controller 904 receives the application telemetry data 908. Upon determination by the application controller 904 that the user interaction indicates a wagering event, the application controller 904 communicates wager data 912 including a wager request to the wager controller 902. The request for a wager event may include wager terms associated with a wagering proposition.

The wager controller receives the wager data and uses the wager data to execute (913) a wager in accordance with a wagering proposition. The wager controller 902 communicates a wager outcome 914 of the executed wager to the application controller 904.

The application controller 904 receives the wager outcome and determines (915) interactive application instructions and resources 916 for the interactive application. The application controller 904 communicates the interactive application instructions and resources 916 to the interactive controller 906. The application controller also communicates wagering telemetry data 920 including the wager outcome to the interactive controller 906.

The interactive controller 906 receives the interactive application instructions and resources 916 and wagering telemetry data 918. The interactive controller 906 incorporates the received interactive application resources and executes the received interactive application instructions (918). The interactive controller updates (922) an application user interface of the interactive application provided by the interactive controller using the interactive application instructions and the resources, and updates (922) a wagering user interface using the wagering telemetry data.

In several embodiments, a user can interact with an interleaved wagering system by using RC for wagering in accordance with a wagering proposition along with AC and elements in interactions with an interactive application. Wagering can be executed by a wager controller while an interactive application can be executed by an interactive controller and managed with an application controller.

Figure 8:
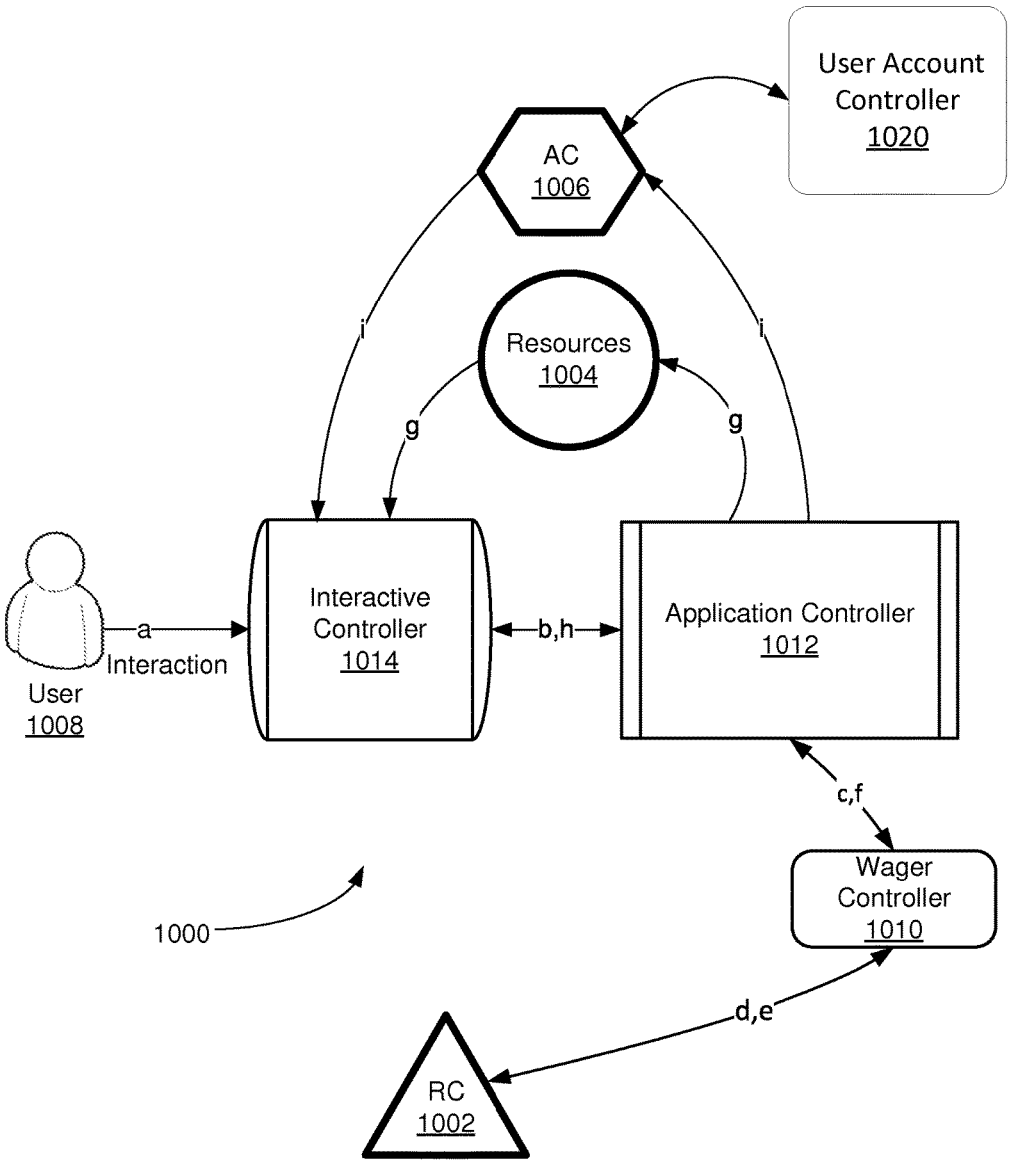
FIG. 8 is a collaboration diagram for components of an interleaved wagering system in accordance with various embodiments of the invention.

FIG. 8 is a collaboration diagram that illustrates how resources such as AC, RC, elements, and objects are utilized in an interleaved wagering system in accordance with various embodiments of the invention. The collaboration diagram 1000 illustrates that RC 1002, interactive application resources including elements and objects 1004 and AC 1006 can be utilized by a user 1008 in interactions with a wager controller 1010, such as wager controller 102 of FIG. 1, an application controller 1012, such as wager controller 112 of FIG. 1, and an interactive controller 1014, such as interactive controller 120 of FIG. 1, of an interleaved wagering system. The contribution of elements and objects such as included in resources 1004, can be linked to a user's access to credits, such as RC 1002 and/or AC 1006. Electronic receipt of these credits can come via a smart card, voucher or other portable media, or as received over a network from a server. In some embodiments, these credits can be drawn on demand from a user profile located in a database locally on an interleaved wagering system or in a remote server.

A user's actions and/or decisions can affect an interactive application of interactive controller 1014 that consume and/or accumulate AC 1004 and/or resources 1004 in an interactive application executed by an interactive controller 1014, a wager controller 101 and an application controller 1012. The application controller 1012 can monitor the activities taking place within an interactive application executed by an interactive controller 1014 for wagering event occurrences. The application controller 1012 can also communicate the wagering event occurrences to the wager controller 1010 that triggers a wager of RC 1002 in accordance with a wagering proposition executed by the wager controller 1010.

In several embodiments, the user commences interaction with the interleaved wagering system by contributing credit to an interleaved wagering system such as, but not limited to, RC 1002 that may be credit in a real currency or may be credit in a virtual currency that is not fungible with a real currency, AC 1006 that may be application environment credits, and specified types of interactive application elements and/or objects 1004. One or more of these contributions may be provided directly as currency and/or transferred in electronically. Electronic transfer may come via a smart card, voucher or other portable media, or as transferred in over a network from a user data server or interleaved wagering system user account server. In many embodiments, contributions may be drawn on demand from user accounts located in servers residing on the network or in the cloud on a real time basis as the credits, elements and/or object are committed or consumed by the interleaved wagering system. Generally, RC is utilized and accounted for by the wager controller 1010; and the resources 1004 and AC 1006 are utilized and accounted for by the application controller 1012 and/or the interactive controller 1014. The user interacts (a) with an interactive application provided by the interactive controller 1014 with the interaction representing an action by the user within the context of the interactive application. The interactive controller 1014 receives the user interaction and communicates (b) the interaction to the application controller 1012. The application controller 1012 receives the interaction and determines from the interaction whether or not a wager should be triggered. If a wager should be triggered, the application controller 1012 communicates (c) wager data about a wager in accordance with a wagering proposition associated with the interaction and thereby triggers a wager. The wager controller receives the wager data and executes the wager in accordance with the wagering proposition, and consumes (d) an appropriate amount of RC 1002 for the wager. The wager controller 1010 adjusts (e) the RC 1002 based upon a wager outcome of the wager and communicates (f) the wager outcome to the application controller 1012 as to the outcome of the wager triggered by the application controller 1012. The application controller 1012 receives the wager outcome. The application controller determines what resources 1004 should be provided to the interactive controller and communicates (g) the resources 1004 to the interactive controller. The interactive controller receives the resources from the application control and integrates them into the execution of the interactive application provided by the interactive controller 1014.

In some embodiments, the application controller 1012 communicates (h) data about the wager outcome to the interactive controller. The interactive controller receives the wager outcome and displays the wager outcome to the user 1008.

In some embodiments, the application controller 1012 determines what resources and instructions to provide to the interactive controller 1014 for use by the interactive application provided by the interactive controller 1014 partially on the basis of the wager outcome. In some such embodiments, resources are provided in a case that the wager was a winning wager for the user. In other such embodiments, fewer or no resources are provided in a case of a losing wager.

In some embodiments, the application controller 1012 determines what resources to provide based on internal logic of the application controller 1012. In some such embodiments, the application controller 1012 employs a random result generator, such as a P/RNG, to generate a random result and the random result is used to determine what resources are provided to the interactive controller 1014.

In several embodiments, the application controller 1012 determines an increment or a decrement of an amount of AC 1006 using the interactions received from the interactive controller. The increment or decremented amount is communicated (i) to the interactive controller for display to the user.

In some embodiments, the application controller 1012 executes a wager of RC as a virtual currency, AC, elements or objects. In some such embodiments, the application controller 1012 employs a random result generator, such as a P/RNG, to generate a random result and the random result is used to determine a wager outcome in RC as a virtual currency, AC, elements or objects.

The following is description of an embodiment of the described collaboration where an interactive application provided by an interactive controller of an interleaved wagering system is a first person shooter game. The process begins by a user selecting a machine gun to use in the game and then fires a burst of bullets at an opponent. The interactive controller can communicate to the application controller of the user's choice of weapon, that a burst of bullets was fired, and/or the outcome of the burst. The application controller communicates to the wager controller that 3 credits (RC) are to be wagered on the outcome of a wagering event to match the three bullets consumed. The wager controller then performs the wagering event and determines the result of the wager and may determine the winnings from a paytable. The wager controller consumes 3 credits of RC for the wager and executes the specified wager. By way of example, the wager controller may determine that the user hit a jackpot of 6 credits and returns the 6 credits to the RC and communicates to the application controller that 3 net credits were won by the user.

The application controller communicates to the interactive controller to add 3 bullets to an ammunition clip. The interactive controller adds 3 bullets back to the ammo clip.

The ammunition may be added by directly adding the ammunition to the clip or by allowing the user to find extra ammunition during use. The application controller logs the new user score (AC) in the game (as a function of the successful hit on the opponent) based on the interactive controller communication, and adds 2 extra points to the user score since a jackpot has been won. The application controller then adds 10 points to the user score (AC) given the success of the hit which in this example is worth 8 points, plus the 2 extra point. Note that this example is only intended to provide an illustration of how credits flow in an interleaved wagering system, but is not intended to be exhaustive and only lists only one of numerous possibilities of how an interleaved wagering system may be configured to manage its fundamental credits.

In many embodiments, user account controller 1020, such as user account controller 150 of FIG. 1, an interleaved wagering system is used to store AC for use of the user. In such an embodiment, AC is generated by the application controller based on the user's use of the interleaved wagering system and an amount of the AC is communicated to the user account controller 1020. The user account controller stores the amount of AC between sessions. In some embodiments, the user account controller communicates an amount of AC to the application controller at the start of a session for use by the user during a session.

Gambling Hybrid Games Including Gambling Intergrated Games

In accordance with many embodiments of the invention, a gambling hybrid game provides an entertainment game as an interactive application and a gambling game. A wide array of interactive applications include explicit random events that are observable to the game's player(s) and often initiated by a player. Random events can include, but are not limited to, the drawing of cards, the rolling of a die, and the use of a spinner. These explicit random events can be singular or multiple, operating in parallel or in serial. For example, Monopoly® provided by Hasbro Inc. of Pawtucket, R.I. is played by each player rolling a pair of dice at the onset of each turn to move a game piece around the board (singular per turn, and serially between players). In Risk® provided by Hasbro Inc. of Pawtucket, R.I., two players roll dice simultaneously to establish the outcome of a battle, and the players continue to roll dice until the battle is resolved (parallel dice rolls occurring multiple times). In Scrabble® provided by Hasbro Inc. of Pawtucket, R.I., a player draws tiles at random from a pool of tiles. In War, players draw randomly ordered cards from a deck of cards and compare those cards each turn. These random events are typically initiated by a player as part of a player's turn and can drive actions such as the movement of a player piece around a board (e.g. Monopoly®), the resolution of a battle between players (e.g. Risk®), establishing whether a character successfully deploys a specific skill (e.g. Dungeons and Dragone), etc. Although the above examples discussed are board games, the same principle can be applied in computerized versions of these games.

Figure 9:
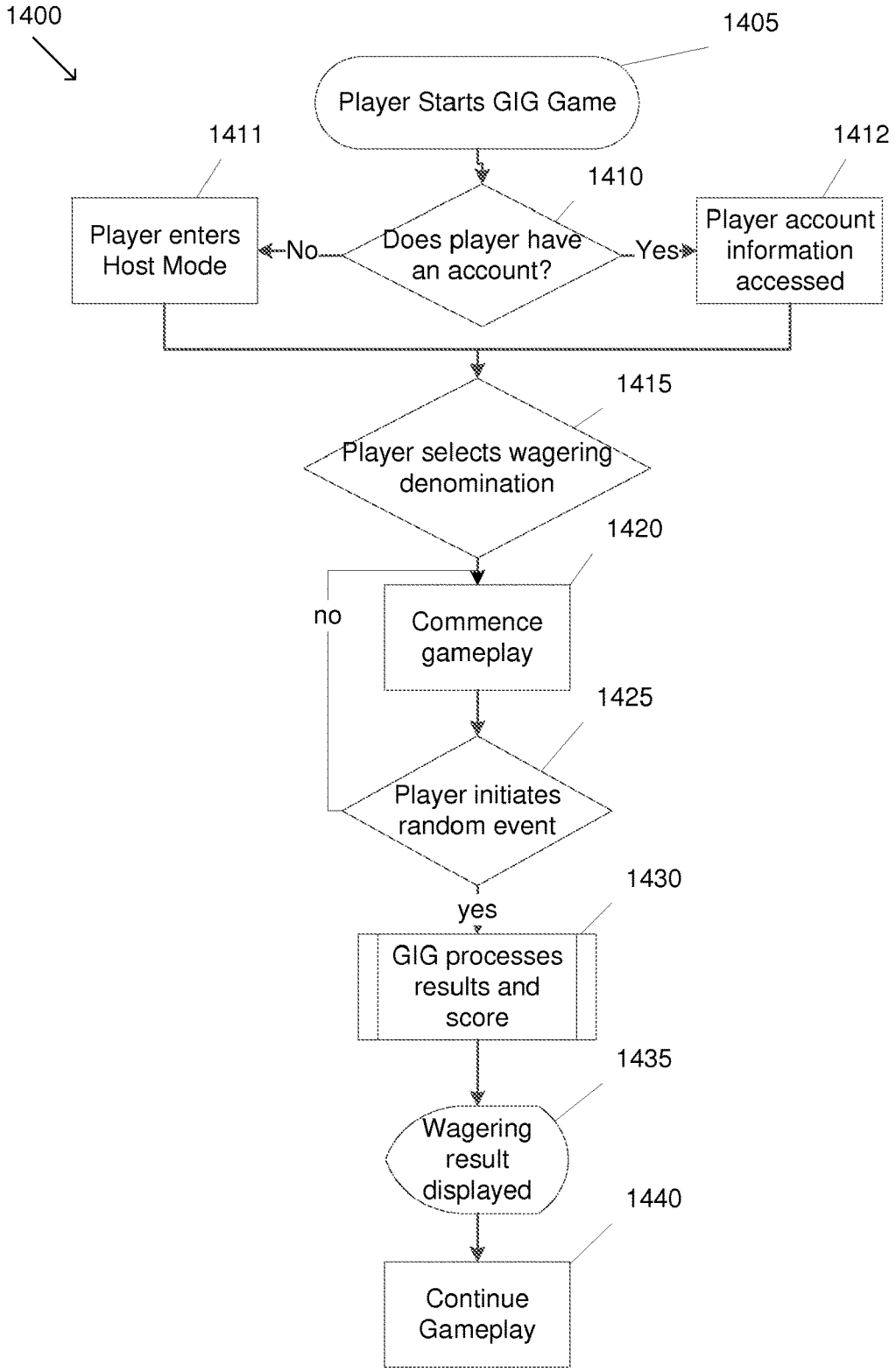
FIG. 9 illustrates an example session of an interactive application in accordance with embodiments of the invention.

In accordance with several embodiments of the invention, the explicit random events in an interactive application provided by a gambling hybrid game are harnessed to drive gambling events in a gambling game in concert with the play of the interactive application. For purposes of this discussion, a gambling hybrid game that uses the random events in an interactive application to determine the results of the gambling event and/or wagers on the gambling event are referred to as a Gambling Integrated Game (GIG). A GIG uses the random events inherent in the underlying interactive application as a gambling game where the outcome of a random event or a set of random events in the interactive application is linked to the provisions of awards to a player. Examples of awards in accordance with embodiments of the invention include, but are not limited to, in-game objects, the alteration of in-game variables, and the allocation of credits to one or more pools being collected by the game operator (i.e. casino). A flow diagram of a process for providing a gambling hybrid game with a GIG in accordance with embodiments of the invention is illustrated in FIG. 9.

In process 1400, the player begins play of the gambling hybrid game (1405). Upon starting the game, the player selects (1410) between using either a player account to provide Real World Credits (RWC) and/or game world credits (GWC) for play (1412) or may play a stand-alone or host version (1411) of the game in which RWC and/or GWC is entered on a per-play basis. Regardless of the selected type of game play, the player then chooses the denominations or wagering amount to use during game play (1415). The interactive controller then provides the game play of the interactive application (1420). During game play of the interactive application, the player initiates a random event (1425).

The results of the random event are generated and the awards and/or wager results in the gambling game based upon the random event are determined. The results of the wagers and/or awards are provided to the player and displayed as part of the game play (1435). For example, a gambling hybrid game with a gambling integrated game provides a computerized version of the game of Monopoly®. In the game, a player rolls two 6-sided die each turn. In addition to dictating how far the player moves his piece in the interactive application, the dice roll determines which one of the 36 possible permutations (where die 1 and die 2 are called out separately) or 21 permutations (where only sum of the dice is called out) corresponds to a specific monetary payout relative to the credits committed to the gambling game before the dice were "rolled" in a GIG version of Monopoly®. In accordance with some embodiments of a Monopoly® GIG, each of the 36 or 21 possible permutations correspond to at least one of a payout to the player, a possible allocation to a bonus pool, the alteration of an in-game variable, a loss of funds by the player, and a gain of funds by the player.

In accordance with some embodiments, the results of wagers and/or awards can include, but are not limited to contribution to a bonus pool that is awarded as a function of subsequent random events; a RC win for the player; a RC loss for the player; a RC draw for the player; a contribution to a bonus pool that is awarded as a function of player skill and/or as a function of a player's performance in one or more instances of the interactive application; a contribution to an interstitial credit, such as Quanta, that the player can use in the current game session and/or over multiple game sessions to alter interactive application variables; a contribution to a specific interactive application variable without player selection or input; and a contribution to a bonus pool that is applied to a subsequent competition or tournament that the player may or may not become eligible to enter based upon factors including, but not limited to, the demonstrated skill of the player in the interactive application, money committed to the gambling game, hours spent playing the game, and player club status. In accordance with some embodiments, the award and/or wager may be provided in lieu of the random event affecting the interactive application. For example, the player may gain the ability to move their piece or one of the above effects may take place in a gambling hybrid game providing a Monopoly® game as an interactive application in accordance with an embodiment of the invention. In accordance with the embodiment, the results of the random event may be affected by direct allocation of each possible random outcome to one of the above mentioned outcomes in a gambling game or a move in the interactive application. For example, a first die roll of a "2" and a second die roll of a "5" may result in a RC win and no longer provide a move of seven squares in the Monopoly game. In accordance with some embodiments, an addition of an additional random number generating element (a third die for example) is introduced into the interactive application that causes the fundamental random number generating element (the two dice) to be interpreted as either a conventional move in the underlying interactive application, or instead as one of the above effects. In accordance with a number of embodiments, the impact of the underlying explicit random number generating mechanism in the interactive application may be accumulated over multiple occurrences of the explicit random events in the interactive application. For example, rather than the outcome of a single roll of the dice by a player during a player turn in Monopoly® which would limit the outcome to one of 36 distinct outcomes, the results of multiple dice rolls accumulated across several turns may be considered at one time so that a greater number of permutations of the result are possible. For example, six rolls of the two dice by a single player or the rolls from six player turns may be used to drive the Random Effect to provide 612 possible outcomes. After the results of the random event are determined and displayed, game play of the interactive application continues (1440).

Although specific processes for providing gambling hybrid games with a GIG are discussed above with respect to FIG. 9, any of a variety of processes for providing a gambling hybrid game with a GIG can be utilized as appropriate to the requirements of specific applications in accordance with embodiments of this invention.

Figure 10:
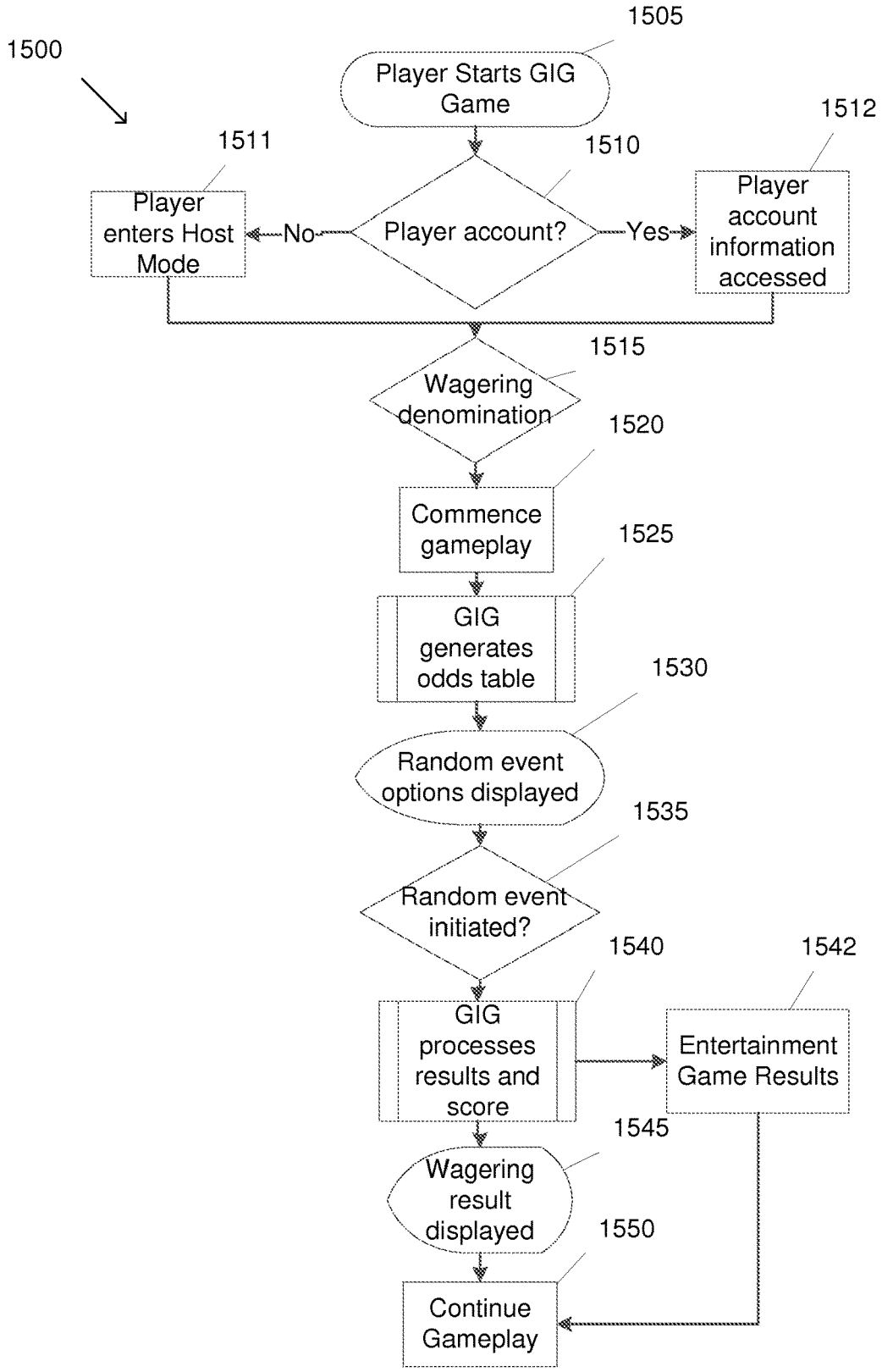
FIG. 10 illustrates an example session of an interactive application in accordance with embodiments of the invention.

In accordance with some embodiments, the interactive application in a gambling hybrid game with a GIG has different random events that may be initiated at a given time. The results of a gambling event corresponding to the random event may depend on the odds associated the random event initiated. A flow diagram of a process for providing a GIG with different odds for a random event in accordance with an embodiment of the invention is shown in FIG. 10.

In process 1500, the player begins play the gambling hybrid game (1505). Upon starting the game, the player selects (1510) between using either a player account to provide Real World Credits (RWC) and/or game world credits (GWC) for play (1512) or may play a stand-alone or host version (1511) of the game in which RWC and/or GWC is entered on a per-play basis. Regardless of the selected type of game play, the player chooses the denominations or wagering amount to use during game play (1515). The entertainment engine then provides the game play of the interactive application (1520). The odds for each random event option are then determined for the GIG (1525) and displayed to the player (1530). During game play, the player initiates a random event from the random event options (1535). The results of the initiated random event are generated and the awards in the gambling game based upon the random event are determined. The results of any wagers and/or rewards are provided to the player and displayed as part of the game play (1540). The results of the random event on game play of the entertainment are determined (1542). The determined outcomes of wagers and/or awards provided to the player based upon the random event are displayed (1545) and game play of the interactive application continues (1540). The determination of the results of the random event is performed in a manner similar to the determination described above with reference to FIG. 9.

Although a specific process for providing a gambling hybrid game with a GIG is discussed above with respect to FIG. 10, any of a variety of processes for providing a gambling hybrid game with a GIG can be utilized as appropriate to the requirements of specific applications in accordance with embodiments of this invention.

Figure 11:
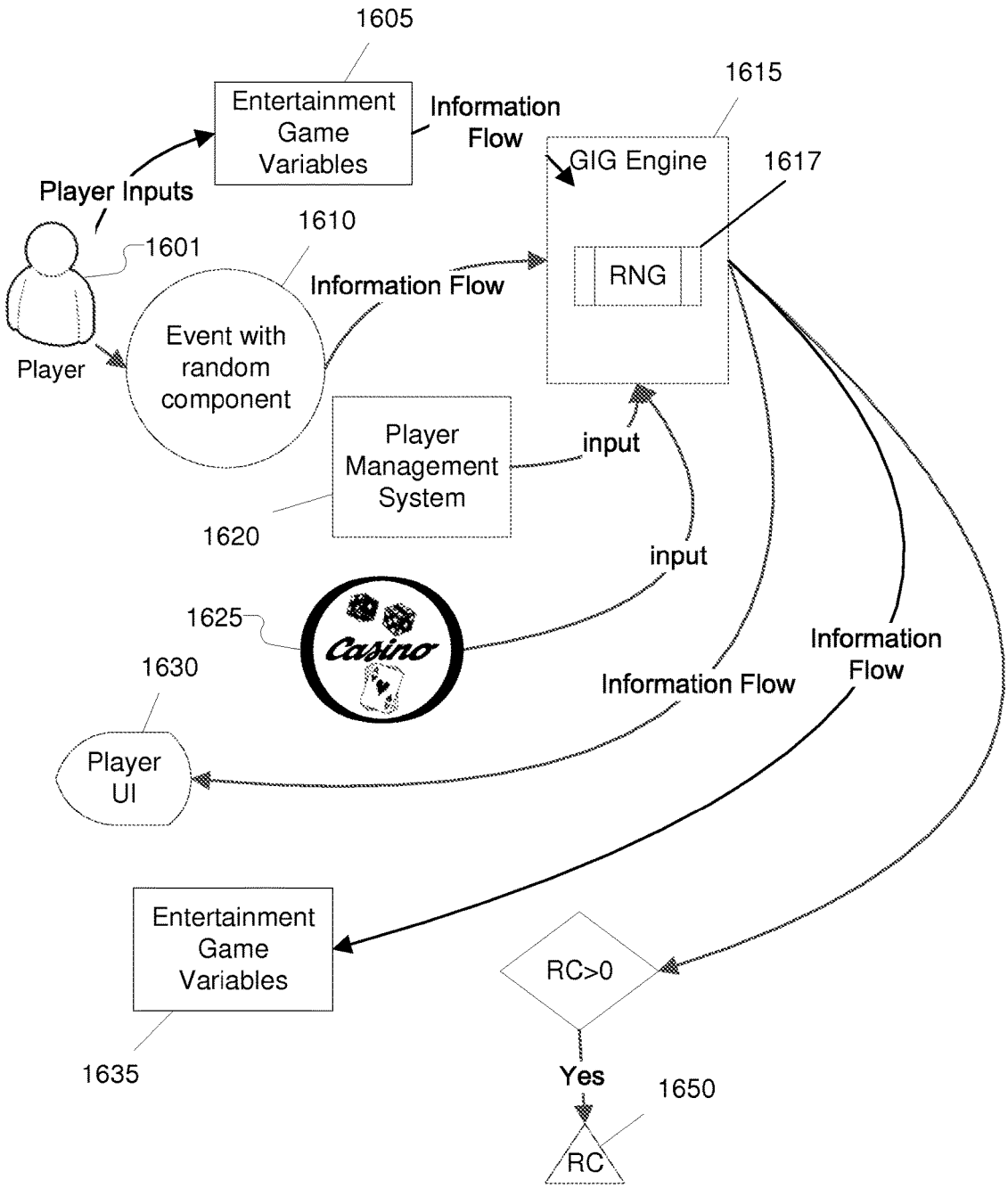
FIG. 11 illustrates an example session of an interactive application in accordance with embodiments of the invention.

In accordance with many embodiments of the invention, the determination of the payout of a wager and/or award based upon the results of a random event in the interactive application may be influenced by other information. This information includes, but is not limited to, Entertainment Game (EG) variables; player information; and casino and/or game provider information. A flow diagram showing the passing of information during the provision of a gambling hybrid game with a GIG in accordance with embodiments of this invention is illustrated in FIG. 11.

Player 1601 provides player inputs to the interactive application. The inputs cause the interactive application to update EG variables 1605 that indicate the state of the interactive application. The player inputs also initiate an event with a random component 1610. EG variables 1605 and information about the event with a random component 1610 are provided to a GIG engine. The GIG engine also receives player information from a player management system 1620 and provider information from a casino and/or a game provider 1615. Random Number Generator (RNG) 1617 can be used to determine the results of the event with a random component 1610 in the interactive application and the gambling game. The interactive application uses the results of the event with a random component to update the EG variables 1635 and the player user interface 1630. The gambling game uses the results of the event with a random component to determine the results of the gambling event 1645 and any RC 1650 rewarded for wagers based upon the results of the gambling game.

Figure 12:
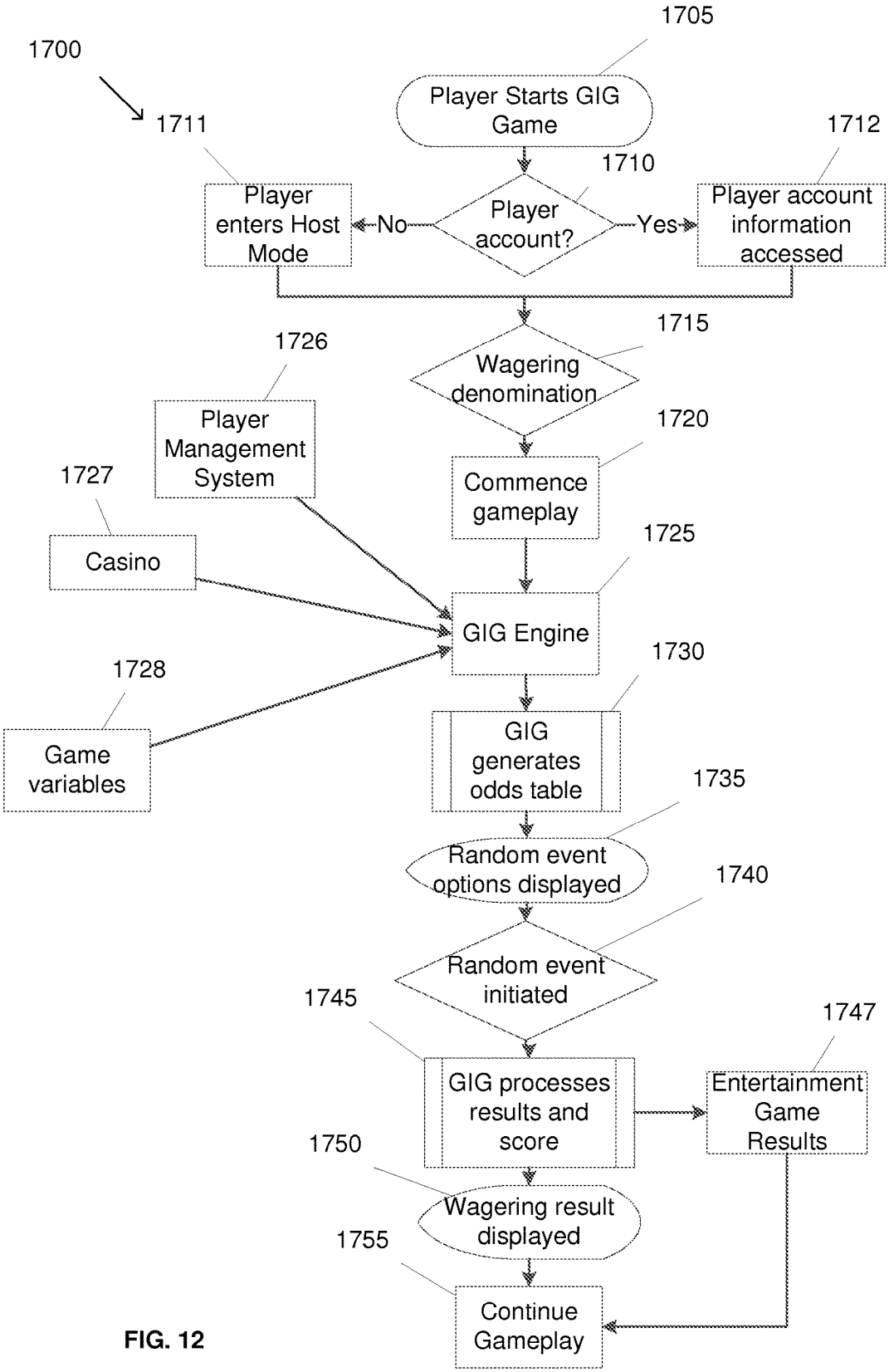
FIG. 12 illustrates an example session of an interactive application in accordance with embodiments of the invention.

A flow diagram of a process for providing a GIG that uses the results of a random event and other information to determine the results of the random event in the interactive application to determine results in a gambling event in a gambling game in accordance with an embodiment of the invention is shown in FIG. 12.

In process 1700, the player begins play of the gambling hybrid game (1705). Upon starting the game, the player selects (1710) between using either a player account to provide Real World Credits (RWC) and/or game world credits (GWC) for play (1712) or may play a stand-alone or host version (1711) of the game in which RWC and/or GWC is entered on a per-play basis. Regardless of the selected type of game play, the player chooses the denominations or wagering amount to use during game play (1715). The entertainment engine then provides the game play of the interactive application (1720). The GIG engine receives player information from player management system 1726, EG variables 1728 from the interactive controller and provider information from the casino or game provider 1727. The odds for each random event option may then be determined for the GIG using the player information, provider information, EG variables, and other interactive application information (1730) and displayed to the player (1735). During game play, the player initiates a random event from the random event options (1740). The results of the initiated random event are determined and the awards in the gambling game based upon the random event, the player information, provider information, and EG variables are determined and the results of any wagers and/or rewards are provided to the player and displayed as part of the game play (1745). The results of the random event on game play of the entertainment are determined (1747). The results of the wagers and/or awards provided to the player based upon the random event are displayed (1750) and game play of the interactive application continues (1755).

Although a specific process for providing a gambling hybrid game with a GIG is discussed above with respect to FIG. 12, any of a variety of processes for providing a gambling hybrid game with a GIG can be utilized as appropriate to the requirements of specific applications in accordance with embodiments of this invention.

Examples of Gambling Hybrid Games with a Gig

Figure 13:
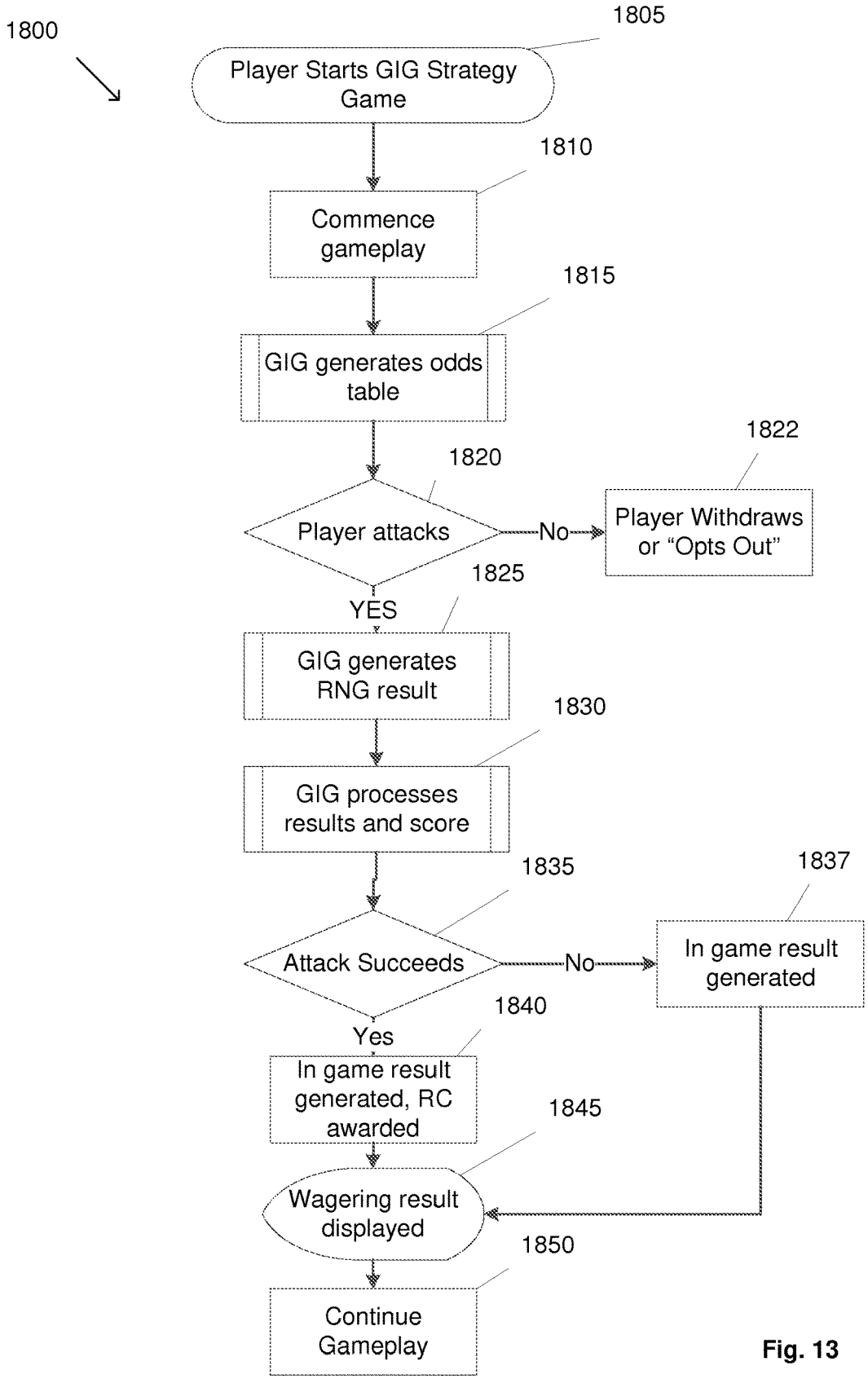
FIG. 13 illustrates an example session of an interactive application in accordance with embodiments of the invention.

In accordance with some embodiments of a gambling hybrid games with a GIG, the interactive application provided is a strategy-based game. A flow diagram of a process for providing a GIG with a strategy game as the interactive application is shown in FIG. 13. In process 1800, the player initiates the strategy-based interactive application (1805). Game play of the strategy-based game commences (1810). As game play proceeds, the GIG generates an odds table for a random event. The player then initiates the random event (1820). An example of a random event in Risk® is when a player attacks a country on the game board occupied by a troop of another player. The attack continues until the player wins or withdraws (1822). For each roll of the dice during the attack, the GIG generates a random result using the RNG (1825). The GIG then processes the results of the random event in the gambling game and the results of the random event in the interactive application (1830). If the attack fails (1837), the in-game results are recorded and game play of the interactive application continues (1850). If the attack is successful, the in-game results of the successful attack are recorded and the award and/or results of wagers in the gambling game are determined (1840). The awards and/or results of the wagers are displayed (1845) and game play of the interactive application continues (1850).

Although a specific process for providing a gambling hybrid game with a GIG providing a strategy game as the interactive application is discussed above with respect to FIG. 13, any of a variety of processes for providing a gambling hybrid game with a GIG can be utilized as appropriate to the requirements of specific applications in accordance with embodiments of this invention.

In accordance with an embodiment of a gambling hybrid game with a GIG that provides the game of Risk® as the interactive application, players engage in battles between groups of armies using one, two or three dice each, depending upon the number of armies each player is using to attack or defend. Over the course of a battle, there can be multiple rolls of the dice until one party is victorious or the attacker withdraws. The set of combinations of dice are known as a function of the number of troops each party uses in the battle. Each party is required in this example to contribute a specific sum of RC to each battle as a function of the number of troops that the party has committed to that battle as a whole in accordance with the embodiment. However, in accordance with other embodiments, RC is committed at a fixed amount per battle regardless of the number of troops committed. In accordance with still other embodiments, the amount of RC committed is a function of the number of dice rolled during each round of a battle. The combination of dice outcomes can be used to drive one or more of the following: a contribution to a pool to be paid to the winner of the specific head-to-head battle; a contribution to a tournament pool to which the players may or may not ultimately gain entry; and a contribution to a pool to be paid to the winner of the specific game. In several embodiments, there is no feedback from the gambling game to the interactive application other than that already inherent in the Risk® game. In particular, the winner of the battle gains more territory and territory cards and may therefore ultimately receive more armies at the onset of the next turn of the winner. In accordance with other embodiments, one or more of the dice outcomes may cause a player to receive an award. Examples of awards include, but are not limited to additional armies; and special features including, but not limited to, extra attack dice for an attach, better attack odds, and better defending odds.

In a particular example, Player 1 attacks Japan from Kamchatka with 10 troops. Player 2 defends Kamchatka with four troops. Therefore, Player 1 is required to commit 10 RC to the battle, and player 2 is required to commit four RC to the battle. The battle proceeds in the manner shown in the following table.

| Battle Round | Player 1 Troops at start of round | Player 2 Troops at start of round | Player 1 Dice Rolls | Player 2 Dice Rolls |
|---|---|---|---|---|
| 1 | 10 | 4 | 2, 3, 4 | 3, 6 |
| 2 | 8 | 4 | 4, 4, 5 | 2, 6 |
| 3 | 7 | 3 | 2, 1, 3 | 5, 3 |
| 4 | 5 | 3 | 6, 5, 1 | 4, 5 |
| 5 | 5 | 1 | 3, 4, 2 | 4 |
| 6 | 4 | 1 | 6, 3, 4 | 5 |
| 7 | 4 | 0 | N/A | N/A |

As shown in the table, Player 1 takes over the country after six rounds of battle having lost six of his initial troops and Player 2 has lost all four of his troops. As a result of the battler the following random effects result in accordance with the embodiment:

- A Victory Bonus—Player 1 receives a credit back from her commitment as a function of having won the battle. 1 credit returned to player 1;
- A Strong Defender Bonus—Player 2 receives a credit back from his commitment as a function of having lost fewer troops than player 1. One credit to player 2; and
- Game Victory Pool—1 credit from the attacking player (Player 1) is committed to a pool at the onset of the battle that will be awarded to the ultimate winner of the Risk® game.

The gambling outcome for Player 1 in the example is determined in the following manner. 8 RC from Player 1 are committed to the random outcome that is ultimately determined by the numerical sequence {2,3,4,4,4,5,2,1,3,6,5,1,3,4,2,6,3,4}. The numerical sequence is looked up in a table that can be dynamically generated at the onset of the battle. The table reflects all the possible outcomes of the engagement (including either player withdrawing before being defeated) with regards to rolls of Player 1. Prizes are allocated to each possible numerical combination in the table as a function of a prescribed distribution of outcomes dictated by the game. The prizes may be RC; in-game variables; in-game objects; or other items of value in accordance with the embodiment. The outcome of the process may be represented to Player 1 graphically through a variety of means including, but not limited to, a graphical representation of a slot machine or other gambling game. In the specific example, Player 1 loses the gambling game and is not awarded any RC.

The gambling outcome for Player 2 is determined in the following manner. 3 RC from Player 2 are committed to the random outcome that is ultimately determined by the numerical sequence {3,6,2,6,5,3,4,5,4,5}. The numerical sequence is looked up in a table that can be dynamically generated at the onset of the battle, and which reflects all the possible outcomes of that engagement (including Player 2 withdrawing before being conquered) with regards to the rolls of Player 2. Prizes are allocated to each possible numerical combination in the table as a function of a prescribed distribution of outcomes dictated by the game. The prizes may be RC; in-game variables; in-game objects; or other items of value in accordance with the embodiment. The outcome of this process may be represented to Player 2 graphically through a variety of means including, but not limited to, a graphical representation of a slot machine or other gambling game. In this specific example, Player 2 wins the gambling game and is awarded 10 RC.

In the net, Player 1 loses 9 RCs net as a result of the battle and Player 2 gains 7 RCs. Further, 1 RC is allocated to a pool for the ultimate winner of the Risk® game.

In accordance with another embodiment of a gambling hybrid game with a GIG and providing Risk® as the interactive application, an attack by Player 1 on a country protected by Player 2 is performed in the following manner. When player 1 attacks player 2 with a given number of troops on each side, the probability of Player 1 winning is at a known maximum. The probability can be less in so far as Player 1 may withdraw without completing the battle. However, maximum probability of Player 1 winning is known, and more specifically, the likelihood of Player 1 winning with N troops remaining is known. A following table can be constructed and shown to Player 1 before (or after) troops are committed to the battle given the number of troops that Player 1 and Player 2 each have committed to the battle (ten and four respectively). The following table shows the odd of Player 1 winning with N troops remaining.

| N | Percentage Odds of Winning with N troops remaining |
|---|---|
| 10 | 0.04% |
| 9 | 0.4% |
| 8 | 6% |
| 7 | 12% |
| 6 | 14% |
| 5 | 18% |
| 4 | 21% |
| 3 | 15% |
| 2 | 14% |
| 1 | 5% |

The above percentages are for exemplary purposes only and do not add to 100% because there is also the prospect of the Player 1 losing the battle. The following table adds a third column and an additional data point (the case of withdrawal or loss) to the above table to show Player 1 the credits awarded for a 10 credit bet based on the outcome of the battle. This table will be generated by the game logic with input from the casino, regulator, and/or other providers to reflect the desired gambling performance/volatility of the game. In accordance with this embodiment, only the attacking party will have a gambling game initiated as a function of committing troops to the battle. However, it is possible to provide a similar gambling game to the defending party using a similar process in accordance with some embodiments. Furthermore, the percentage odds in the second column could be represented to the player as odds as opposed to percentages in accordance with some embodiments. For example, the table could show "1-in-500" instead of "0.2%".

| N | Percentage Odds of Winning with N troops remaining | Payout on10 committed credits |
|---|---|---|
| 10 | 0.2% | 1000 |
| 9 | 4% | 250 |
| 8 | 12% | 100 |
| 7 | 11% | 11 |
| 6 | 10% | 10 |
| 5 | 7% | 8 |
| 4 | 5% | 1 |
| 3 | 5% | 0 |
| 2 | 4% | 0 |
| 1 | 3% | 0 |
| LOSS OR WITHDRAWAL | 36.8% | 0 |

In the above table, the percentages are for exemplary purposes only.

Player 1 commits to the battle after looking at the above table and the battle plays out in step-wise fashion where the attacker decides whether to continue or withdraw after each roll. In accordance with the embodiment, the attacker's funds are committed, and withdrawal at any time leads to a complete loss of the committed funds. However, the game may provide the player with an "opt out" after each round where the player would lose some but not all of the committed credits in accordance with some embodiments. For example, Player 1 may want to "opt out" after a single round of the battle in response to a roll of the three die that led to the loss two troops. Player 1 may "opt out" at the cost of 5 RC or some other substantial penalty).

Once the battle is complete, Player 1 is paid out according to the above table. As in the previous embodiment, a portion of the funds committed by the player may also be allocated to a number of different pools. For example, a single credit may be allocated to a pool to be awarded to the overarching winner of the Risk® game in accordance with the embodiment. Another credit may be awarded to the defender for winning the battle in accordance with the embodiment. If the defender wins the battle the credit, as with all, may be allocated from an overarching pool as controlled by the game and/or casino; or may be directly shifted from Player 1 to Player 2 depending on the embodiment. Another credit may be allocated to a tournament pool in accordance with the embodiment. Allocations of credits played in a bonus round that relates to skill and/or gambling (i.e. luck) can also be made in accordance with some embodiments. Each type of allocation the funds can be drawn directly from player contributions or an overarching marketing pool that is not explicitly tied to the flow of credits during a given game session.

After Player 1 is paid out according to the above table, play continues as before. In accordance with this example, game play continues by Player 1 continuing the turn until complete. Player 2 then drafts armies, places the armies on the board, attacks adjacent enemy territories (and gambles)

as desired, and then moves troops before ending his turn. The process is repeated for each player (including computer driven players) in the game until the game is completed.

In accordance with another embodiment of a gambling hybrid game with a GIG having Risk® as the interactive application, the Risk® game may be implemented in a GIG context where the aforementioned table operates not in context of a payout for a specific battle victory scenario (e.g. a win with 7 troops remaining) but to pay out as a function of winning with at least X troops remaining. This may be simpler to convey to the player. The table for determining payouts is shown in the following table where the percentages herein are exemplary only and not meant to be representative of the actual odds associated with the outcomes in a Risk® game.

| Player 1 Battle Outcome | Percentage Odds | Payout on10 committed credits |
|---|---|---|
| Win with 10 troops remaining | 0.2% | 1000 |
| Win with 6+ troops remaining | 35% | 15 |
| Win with 6 > x > 3 troops remaining | 15% | 12 |
| Win with 3 or fewer troops remaining | 10% | 5 |
| Lose or withdraw | | 0 |

One skilled in the art will recognize that the player need not be exposed to the odds explicitly when showing the possible payouts.

In accordance with still another embodiment of a gambling hybrid game with a GIG having board strategy game as the interactive application, a given battle consists of a number of rounds, or "attacks" made by the attacking player. For each attack, the attacking player can claw back a portion of a wager committed to the gambling game. The claw back is paid only if the player wins (or in some implementations wins or draws) the attack round and the player is paid as a function of the # of troops attacked relative to the # of troops defending as shown in the following general equation.

$$\text{Claw Back per Attack Round} = f(\#\text{ of troops attacking}, \#\text{ of troops defending})$$

The following is an example of a specific clawback formula for game play in accordance with the embodiment:

$$A = \#\text{ of troops attacking}$$

$$D = \#\text{ of troops defending}$$

$$W = RC \text{ (or } VC\text{) committed to gambling game}$$

$$\text{Claw Back per Attack Round} = C * W * \left(\frac{D}{A}\right) \text{ where } D < A$$

$$\text{Claw Back per Attack Round} = C * W * \left(\frac{A}{D}\right) \text{ where } D > A$$

Where C is defined as $$C = 0.1 * \left(\frac{1}{n}\right)$$

$n$ = attack round in the given battle (i.e. 1, 2, 3, etc.)

In accordance with some embodiments, the claw back process can be limited by the game logic and/or the casino to persist only for a maximum of n rounds (e.g. 10). The above is a single example, and it is possible to construct any other manner of formulaic approach, including approaches that increase the claw back with each ongoing attack round, rather than decrementing it.

Beyond the claw back process, a payout to a player winning the battle is established as a function of the # of die "rolled" during the battle at the end of the battle in accordance with a number of embodiments. A series of tiers may be set as a function of the number of die rolled and prizes are allocated to each tier in accordance with some embodiments. A table dictating the prizes for each tier is used to establish the payout in accordance with many of the embodiments. The prizes can vary as a function of the ultimate performance of the die rolls relative to a given table. The prizes may also vary from table to table to account for the number of die rolls in a battle. For example, a table for a battle that entailed 5 die rolls for the attacker would likely have a much lower maximum payout than a table that reflected a battle that entailed 20 die rolls.

An example of tables in accordance with an embodiment of the invention that account for the different amount of die rolls in a battle is given below. The payouts are different because of the amount of RC committed is based on the number of die rolled during the battle in accordance with the embodiment. Each die roll result (e.g. a 1, 2, 3, 4, 5 or 6) of a player is added together to ascertain a player's score. The score is then cross-referenced against a table to establish a payout based on the number of die rolls by the player. The first table shows a table for 20 die rolls in accordance with embodiments of the invention.

| Dice Roll Score for 20 Rolls | Payout on 20 committed credits |
|---|---|
| 110 <= X | 5,000 |
| 100 <= X < 110 | 2,000 |
| 80 <= X < 100 | 100 |
| X = 20 | 20,000 |
| X < 80, X ≠ 20 | 0 |
| Lose or withdraw | NIL |

The following table is for a battle that only entailed 5 dice rolls. The payouts are less than payouts on the first table because the odds associated with the various outcomes are much greater than in the 20 die case.

| Dice Roll Score for 5 Rolls | Payout on 5 committed credits |
|---|---|
| 27 < X | 500 |
| 25 <= X <= 27 | 100 |
| 20 <= X < 25 | 10 |
| X = 5 | 1000 |
| X < 20, X ≠ 5 | 0 |
| Lose or withdraw | NIL |

In addition to the gambling mechanisms in a GIG described for the above embodiments, GWC may be accumulated as a function of battles won in accordance with some embodiments. In many embodiments, any battle won would generate the same amount of GWC. In accordance with many embodiments, the payout of GWC is a function of the ratio of the number of initial troops of the winner of the battle relative to number of initial troops of the loser. GWC may also be awarded to a player losing a battle if the player's performance in the battle was "heroic" in accordance with a number of embodiments. For example, the player destroyed 20 attacking troops before losing the 3 defending troops. The amount of GWC and/or the player's ultimate status at the end of the game (1st place, 2nd, etc.) may dictate in whole or in part the awarding of a fixed or variable cash prize and/or count towards entry into a tournament (i.e. a player may need a fixed amount of GWC accumulated through Risk® play to gain entry) in accordance with some embodiments of the invention. Other variables may also introduced by the casino could also affect the prize in accordance with a number of embodiments.

Figure 14:
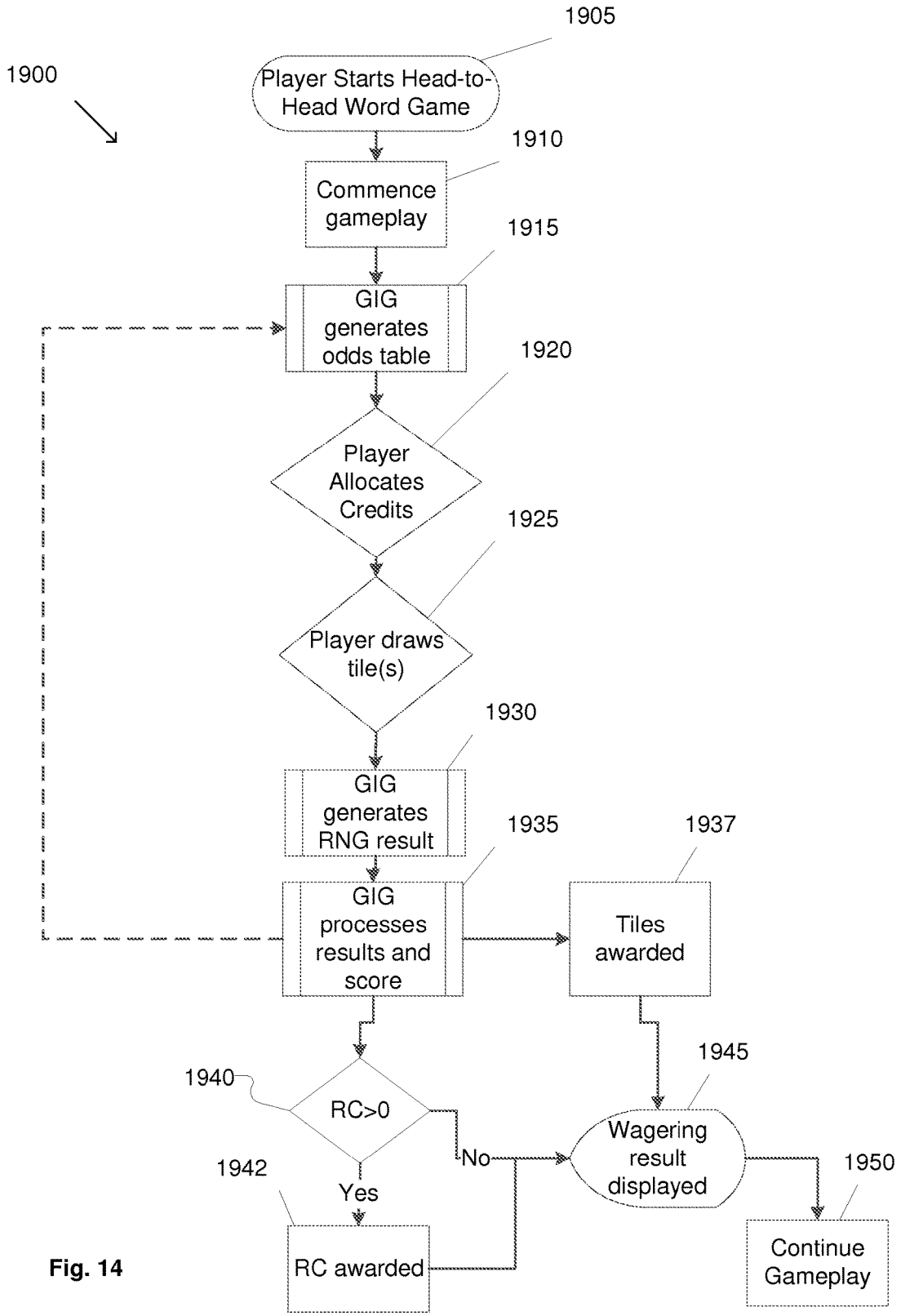
FIG. 14 illustrates an example session of an interactive application in accordance with embodiments of the invention.

A second example of a gambling hybrid game with a GIG in accordance with embodiments of this invention provides a word game as an interactive application. In a word game, a player randomly selects tiles of letters from a pool of tiles and attempts to place words on a game board using the selected tiles. An example of a word game is Scrabble®. The GIG drives gambling events based upon the random nature receiving tiles from the pool. At the time the tiles are selected, the odds associated with pulling any specific combination of letters from the pool are known. As such, gambling propositions can be offered to the player each time that she selects tiles from the pool as part of the overarching game play. As with any GIG game, the player can be offered a prescribed gambling game, and/or have the option to choose from one or more gambling games in accordance with embodiments of the invention. A process for providing gambling hybrid game with a GIG game based upon a word game in accordance with embodiments of the invention is shown in FIG. 14.

In process 1900, the player initiates the gambling hybrid game with a word game as the interactive application (1905). Game play of the word game commences (1910). At the beginning of a player's turn, the GIG generates odds tables for pulling a specific combination of letters (1915). The player then allocates wagers to a bet on one or more of the specific combinations of letters. The player then receives the tiles with letters from the pool of tile (1925) based upon the results of RNG provided by the GIG (1930). The GIG then processes the results of the tiles received (1937) by the player and resolves any wagers and/or awards based upon the tiles received (1940). Depending on the results, the process may be repeated to provide other wagers and/or random events. The results of the wager (1940) and any RC won based wagers (1942) are then displayed to the player (1945) and game play continues (1950).

Although a specific process for providing a gambling hybrid game with a GIG providing a word game as the interactive application is discussed above with respect to FIG. 14, any of a variety of processes for providing a gambling hybrid game with a GIG can be utilized as appropriate to the requirements of specific applications in accordance with embodiments of this invention.

For example, a player turn may occur as follows. A player receives three tiles from the pool to replace tiles used to form a word on the game board. To obtain the tiles, player commits three RC to one or more gambling games based upon previous decisions by the player in the context of casino provided choices. The GIG offers the player a high volatility, a mild volatility and a low volatility proposition as follows: a high volatility proposition is "Draw A-A-A and win 2000 credits per credit bet"; a medium volatility proposition is "Draw two vowels and win 2 credits per credit bet"; and a low volatility proposition is "Draw three consonants and win 10 credits per credit bet".

The player can allocate the three credits in any of the following manners: one of the three credits to each of the above propositions; two credits to one proposition and the third credit to a second proposition; or all three credits to a single proposition. In accordance with a number of embodiments, the game shows the player the odds associated with each available bet. In accordance with many embodiments, the player may not be provided choices. Instead, the player is provided a pre-structured table of potential outcomes such as the following table. In accordance with some embodiments, the percentage odds can be constructed given the number of tiles that need to be drawn, and the tiles remaining in the bag with blank tiles considered as wild cards. The player may or may not be shown the column "Percentage Odds of Drawing this Tile Set" depending on the embodiment.

| Tiles Pulled (order is significant) | Percentage Odds of Drawing this Tile Set | Payout on 3 committed credits |
|---|---|---|
| A-A-A | 0.1% | 250 |
| Two vowels and one consonant | 36% | 3 |
| Three consonants | 12% | 4 |
| Three vowels | 12% | 4 |
| C-O-W | 0.005% | 3,000 |
| D-O-G | 0.003% | 10,000 |
| Three vowels | 12% | 4 |
| All others | 17% | 0 |

One skilled in the art will recognize that the above percentages are for illustrative purposes only and the exact percentages can change as game play proceeds. During each turn, the player will see a new set of payout possibilities immediately before drawing tiles from the bag. In accordance with some embodiments, display of the table may be initiated by the player using a button; an on-screen control; and/or some other mechanism. In general, the GIG can structure the payouts and select the winning options to provide the same overarching expected payout per gambling game in accordance with many embodiments. In a number of embodiments, the volatility can vary from the onset of the game towards the end of the game. During game play of certain games, such as "Words With Friends", the number of tiles in the bag diminishes as the game progresses causing the range of outcomes to narrow. As a result, it may not be possible to provide an equivalent distribution of outcomes or volatility as when the game commenced.

In accordance with some embodiments of a gambling hybrid game with a GIG and providing a word game as the interactive application, or any GIG, it is also possible to offer gambling propositions that span multiple turns of the same player or multiple turns inclusive of more than one player. Because of the dependencies across player turns, and the fact that it is unknown how many tiles will be drawn in subsequent turns, this specific aspect may not be applicable in Words with Friends. However, spanning gambling propositions across multiple turns may be practical in other interactive applications where the explicit random elements are consistent from turn to turn. For example, in the game of LIFE®, the player spins the same spinner each turn, generating a random number between 1 and 10.

Other Features of a Gambling Hybrid Game with a Gig

In accordance with some embodiments, tournament entry for play of gambling hybrid games with a GIG can be governed by overall GWC won, such that GIG games can each have a schema for awarding points for a player's in-game performance. Tournament entry can also be governed by a player's skill rating such that bands of skill can be established and players are given access to enter tournaments as a function of their demonstrated skill in accordance with a number of embodiments. Other requirements, such as number of games played, funds committed to games, a player's status vis-à-vis a casino's player's club, etc. can all impact eligibility to enter a tournament where the tournaments being be either for playing GIG game, or for playing the underlying interactive application without the GIG component. Skill ratings can be established using a number of systems, including ELO or modified ELO systems that account for the gambling outcomes experienced by the player to various extents.

In accordance with some embodiments, head-to-head betting is also available in a gambling hybrid game with a GIG game. Odds can be set as a function of a player's skill rating, experience, or other factors. In accordance with a number of embodiments, players can set their own bet structures as a function of their knowledge about one another, and/or the subject of the bet (i.e. outright win vs. a specific in-game achievement, etc.).

Provision of a Gambling Hybrid Game with a Gig

In accordance with several embodiments of this invention, the interactive controller, application controller, and wager controller of a gambling hybrid game provides a GIG. The interactive controller provides an interactive application in which randomized events are utilized to implement the game rules of the interactive application. During the play of the interactive application, game events are communicated by the interactive controller to an application controller. The application controller receives the game events and determines that a resolution to a randomized event is needed by the interactive controller. The application controller communicates a request to the wager controller for a randomized outcome. The wager controller receives the request and determines a randomized outcome. The randomized outcome includes a gambling outcome that is a result of a wager in accordance with a gambling proposition or gambling game involving real or virtual credits. The randomized outcome also includes random outcome information that is used by the application controller to resolve the randomized event in the interactive application. The randomized outcome is communicated by the wager controller to the application controller. In some embodiments, the application controller uses the randomized outcome information to resolve the randomized event for the interactive controller. The application controller then communicates a resolution to the randomized event to the interactive controller. The interactive controller receives the resolution to randomized event from the application controller and implements the resolution within the interactive application.

In some embodiments, the application controller does not resolve the randomized event for the interactive controller. Instead, the application controller communicates the random outcome information to the interactive controller and the interactive controller generates the resolution to the randomized event.

In some embodiments, the application controller determines the random outcome information instead of the wager controller.

Figure 15:
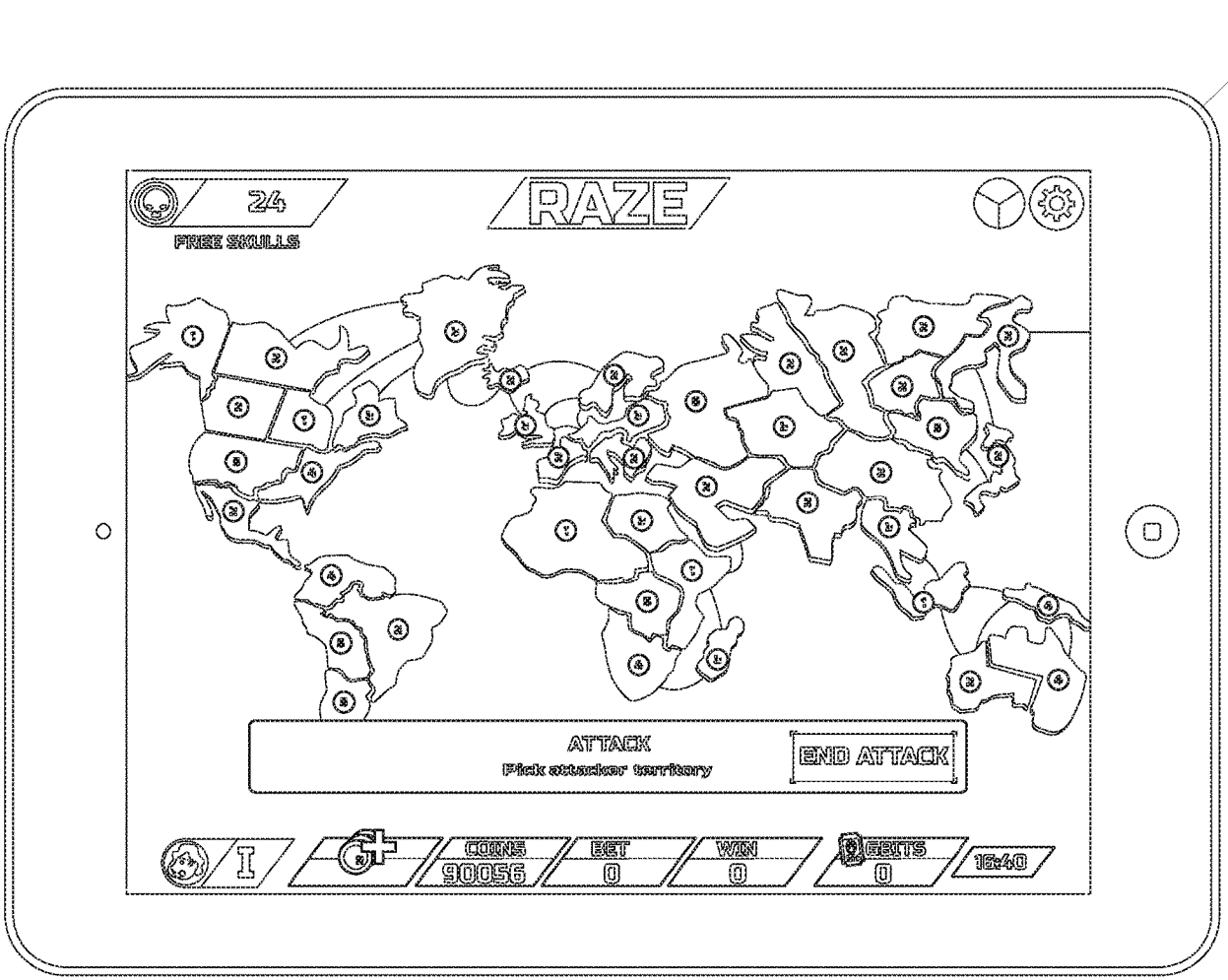
FIG. 15 illustrates a user interface in accordance with embodiments of the invention.

FIG. 15 illustrates an example interactive display of an interactive application in accordance with embodiments of the invention. Throughout an initial gameplay instance, users allocate their resources to different locations in turn, in accordance with embodiments of the invention using interactive display 2100. Following exhaustion of all possible locations available for allocation, users may allocate their remaining resources to locations in which their resources already reside. In some embodiments, users may effectively bolster their depositories of resources in locations that they deem important. In some embodiments, upon beginning a round of a session of the interactive application, a user is awarded a number of in-game credits based on the number of locations that a player controls. For example, if the user controls 15 locations, the user is awarded 45 resources. The user is given an opportunity to purchase various game resource altering actions with in-game credits. In accordance with possible embodiments of the invention, game resource altering actions may vary from bolstering a player's resources to diminishing another player's resources; diminishing and bolstering actions may be purposefully targeted or enacted by chance, both in number and location of resources affected. Having selected a resource altering action, the user's resources are bolstered or improved. In some embodiments, a number of resources to be added is based on a random event. In this example, the random event is displayed on the right. In some embodiments, an action's description and symbolic image preface the random event display. Throughout the session of the interactive application, users may select resources with which to attack neighboring users' resources. Users engage in this interaction with a goal of positioning resources in each possible location of the game board. By possessing resources in each possible location, the user controls the game board and defeats opposing users.

Figure 16:
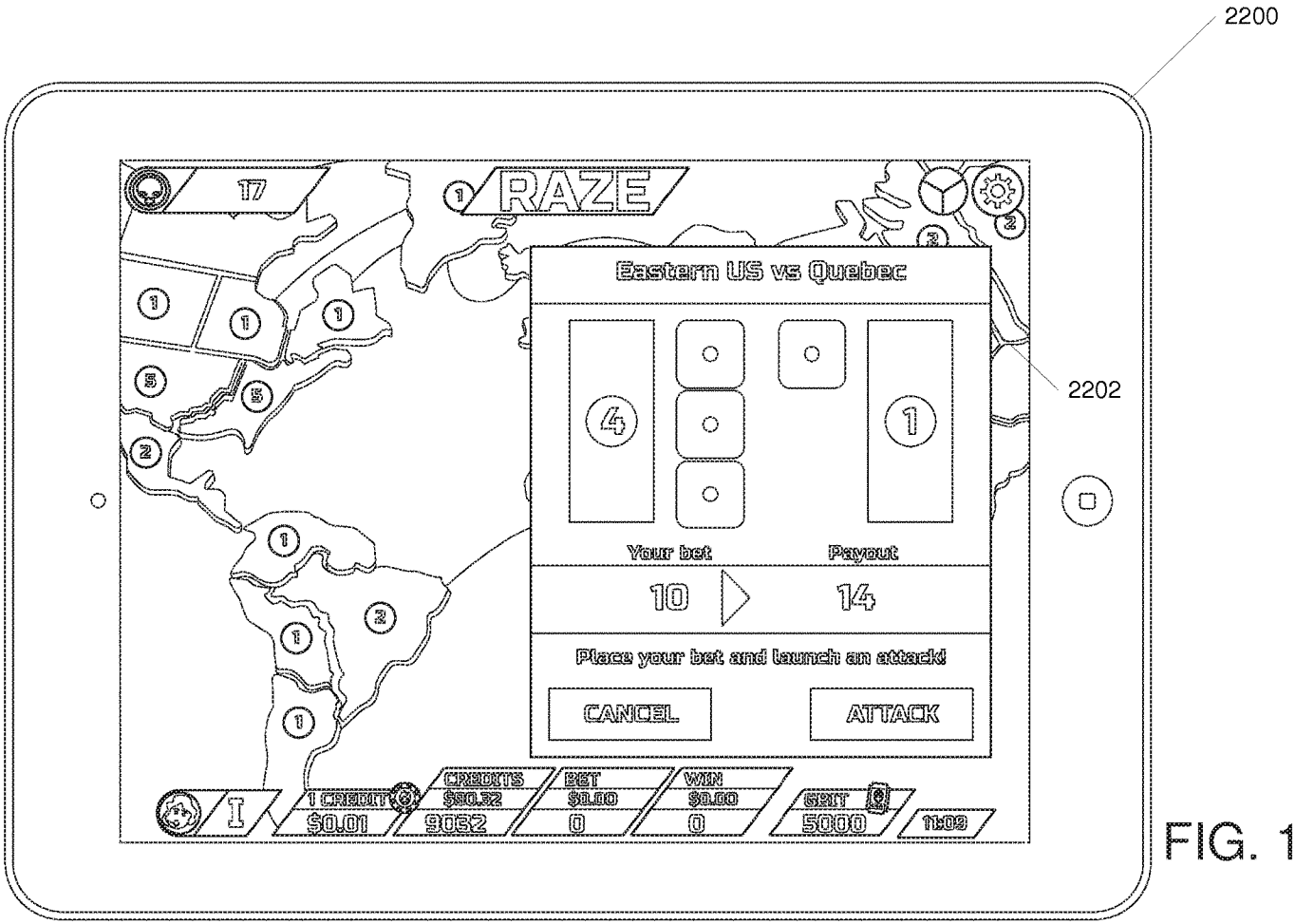
FIG. 16 illustrates a comparison event result display in accordance with embodiments of the invention.

FIG. 16 illustrates an example session of an interactive application in accordance with embodiments of the invention. The user is presented with a descriptive display 2200. Application telemetry relating to the user's resources and corresponding dice for a random comparison event is displayed to the user 2210. In some embodiments, based on the results of the random comparison event, resources are eliminated from the user with the lower dice score. In some embodiments, a wager selector is present, displaying options for a user to select a desirable wager size and its corresponding possible payout based on odds of a proposed wager event.

In some embodiments, once a desired play and wager are selected, random values are generated and compared between users, the number of which is based on the number of resources available in a play. If the user manages to roll values greater than all of an opponent's values, the user not only wins the comparison event but wins a wager event as well. If the user only manages to partially defeat an opponent's values, the wager is cancelled and the user's credit balance remains unaffected. If the user fails to defeat any of an opponent's values, both the wager and comparison are lost. If the user defeats all of an opponent's values, the opponent loses a number of resources equivalent to the number of values that were defeated in a comparison round. If the user only partially defeats an opponent's values, both the player and opponent lose resources for each value that was defeated. If the user fails to beat any of an opponent's values, the user loses a number of resources equivalent to the number of values which the user failed to defeat. Play may continue in this fashion until either the user's or an opponent's resources have been exhausted in the targeted locations. There may be no limit to the number of times the user engages in comparison events (and correspondingly, wager events) in a given turn. Gameplay effectively interleaves in-game resource allocation and risk management with the risk associated with wagering real currency. The user's skill at strategizing and deciding which risks are acceptable and which are not acts as a determinant for success in interactive applicationplay. In accordance with embodiments of the invention, interleaved skill and wagering gameplay results in three resources for a player to manage their incurred risk and allocate: deployable resources to be used in gameplay, in-game credits with which to purchase resource altering actions, and real-currency credits which are both used in wagers and enabling comparison gameplay.

Upon completion of a comparison event, the user is presented with a summary of the results of the comparison event. The user may be rewarded for successful comparison events with both in-game credits and virtual currency credits. When the user has completed all comparison and wager events, the user is given an opportunity to move resources from one location to a neighboring location. In some embodiments, the user's turn concludes with completion of this instance.

During opponents' turns, the user is presented with a summary regarding what the user's opponents' plays entail, furthering deliverance of game telemetry to the user. The user is given an opportunity to skip these summaries if the user wishes to do so. In some embodiments, a session of the interactive application is completed when a single user has resources positioned in each possible location of the game board.

Upon detection of an inserted ticket, a main menu may be displayed. If an indication to join a session is received, a joinable sessions menu is presented. If a selection of a session is received, the corresponding session is presented. In some embodiments, if no game is selected, a main menu is displayed. In some embodiments, if an indication to resign from the session is received, an updated menu is displayed. If an indication to resume a session is received, a menu of sessions that are able to be resumed is displayed. Upon receiving selection of a session, the session is displayed. If no session is selected, the main menu is displayed. If an indication to create a session is received, a menu with various session creation options is displayed. If an indication to adjust application options is received, a continually updating session creation menu is displayed. If these indications are not received then the main menu is displayed. If an indication confirming session creation is received, a session using the selected parameters is generated and displayed. In some embodiments, if an indication for a "quick start" session is received, then a session with initially randomly allocated resources is generated and displayed.

In some embodiments, upon initially displaying an interactive application session, resource allocation inputs are received corresponding to location acquisition. Upon receiving resource allocation input, an updated application is displayed. Resource allocation inputs are received and an updated display is presented until all possible locations have been exhausted. Upon exhaustion of all possible locations, the user may bolster resources in already occupied locations. Upon exhaustion of available resources, an appropriate amount of in-game credits are allocated to the users.

In some embodiments, the user is presented with an opportunity to enter a menu containing various resource altering actions, all of which are purchasable with in-game credits. If an input is received confirming the user's desire to enter this menu, a menu containing various resource altering actions is displayed. If an indication to select a resource altering action at random is received, a resource alteration is selected at random and updated application telemetry is displayed. If a targeted resource alteration indication is received, a number of resources to be affected at random is calculated and resource alteration instructions are received. Updated application telemetry is displayed. If an indication of the user's desire not to alter resources is received, a comparison event menu is displayed.

Figure 17:
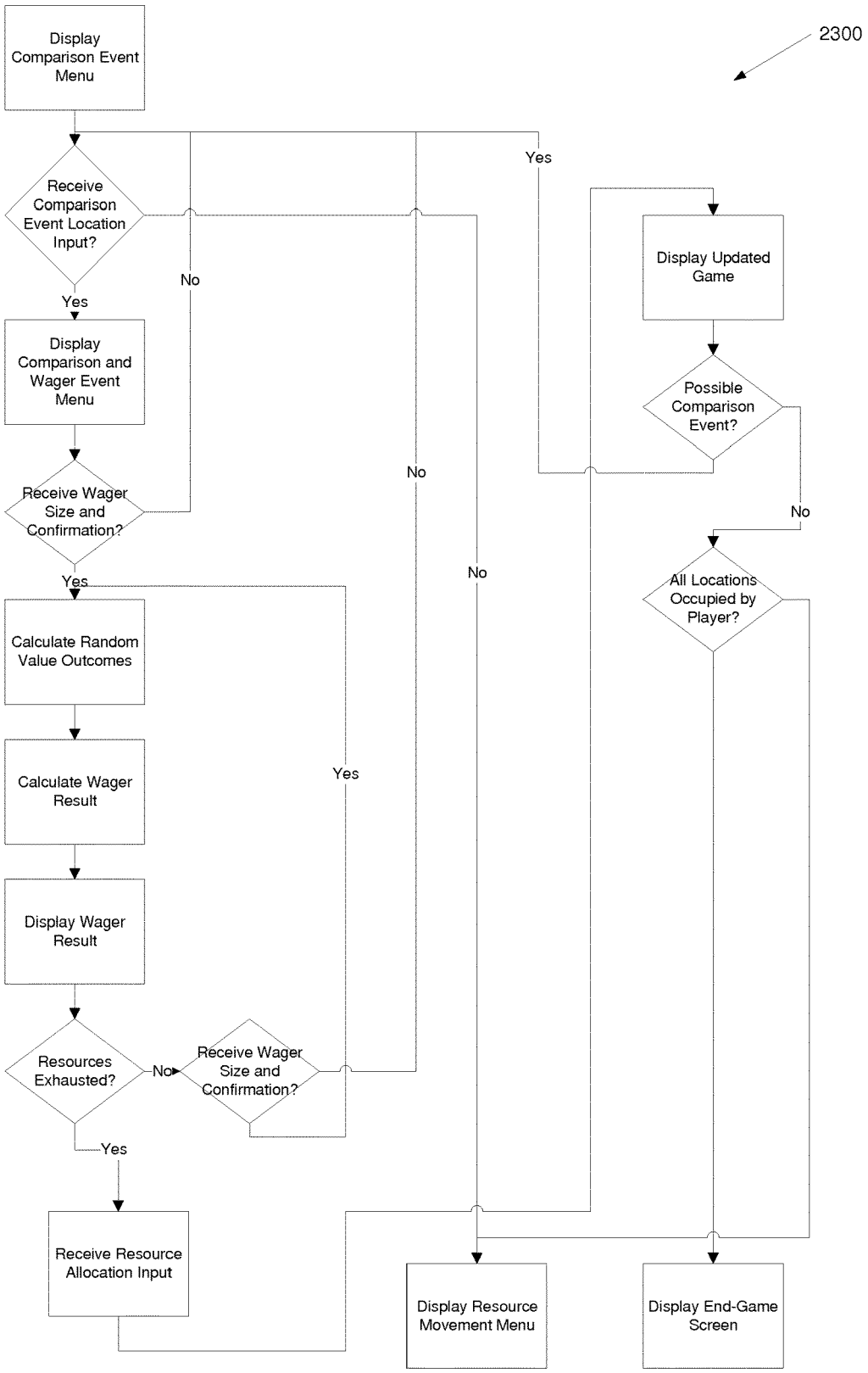
FIG. 17 illustrates a wager event process in accordance with an embodiment of the invention.

FIG. 17 illustrates a wager event process in accordance with an embodiment of the invention. In the process 2300, users are presented with an opportunity to engage in comparison and wager events. If a comparison event location input is received, a comparison event and a wager event menu are displayed. If a wager size selection and intent to wager confirmation are received, a wager result is determined and displayed. If resources in question have not been exhausted, wager events may be repeated until one of the comparing user's resources have been exhausted. Upon resource exhaustion, a resource allocation input is received and an updated application status is displayed. The user may engage in as many comparison events (and accordingly wager events) as the user desires. If all possible comparison events have been exhausted and the user does not have a resource in every possible location, or the user does not wish to engage in a comparison event, a resource movement menu is displayed. If the user possesses a resource in each possible location, an end-game screen is displayed.

In some embodiments, a user may be presented an opportunity to move resources from one location to a neighboring location. If an indication to move resources and a number of resources to move are received, an updated game representation is displayed. Upon completion of a resource movement or if the user does not move any resources, a summary of other users' moves are displayed. Upon round termination and the beginning of another round of play, an appropriate amount of in-game credits are allocated to users.

In various embodiments, upon detection of a ticket insertion by a wager controller, the wager controller messages a display main menu message the interactive controller via the application controller. Upon receiving a message to display the main menu, the interactive controller displays the main menu. The interactive controller then creates and displays the interactive application.

Figure 18:
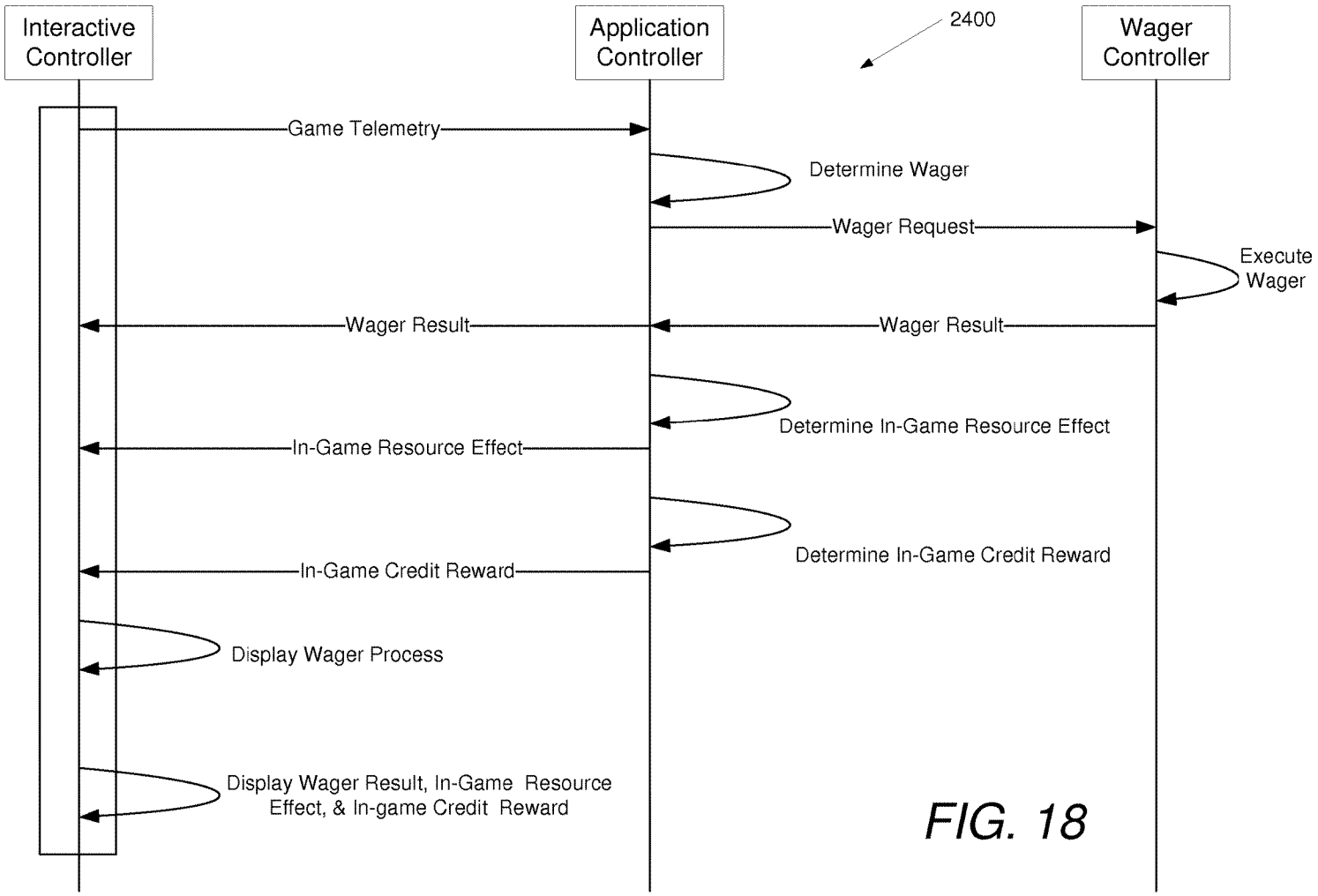
FIG. 18 illustrates a gameplay and wagering process in accordance with an embodiment of the invention.

FIG. 18 illustrates a gameplay and wagering process in accordance with an embodiment of the invention. In process 2400, an interactive controller continually sends application telemetry to an application controller. Upon determination of a wager, the application controller messages a wager request to a wager controller. The wager controller executes the requested wager and communicates the wager result to the application controller, which relays the wager result to the interactive controller. Having received the wager result, the application controller determines a corresponding in-game resource effect. The application controller communicates a determined and appropriate resource effect to the interactive controller. The application controller determines an in-game credit reward and communicates this reward to the interactive controller as well. The interactive controller displays a wager process before displaying the wager result, in-game resource effect, and in-game credit reward. These communication processes continue throughout the session of the interactive application.

Figure 19:
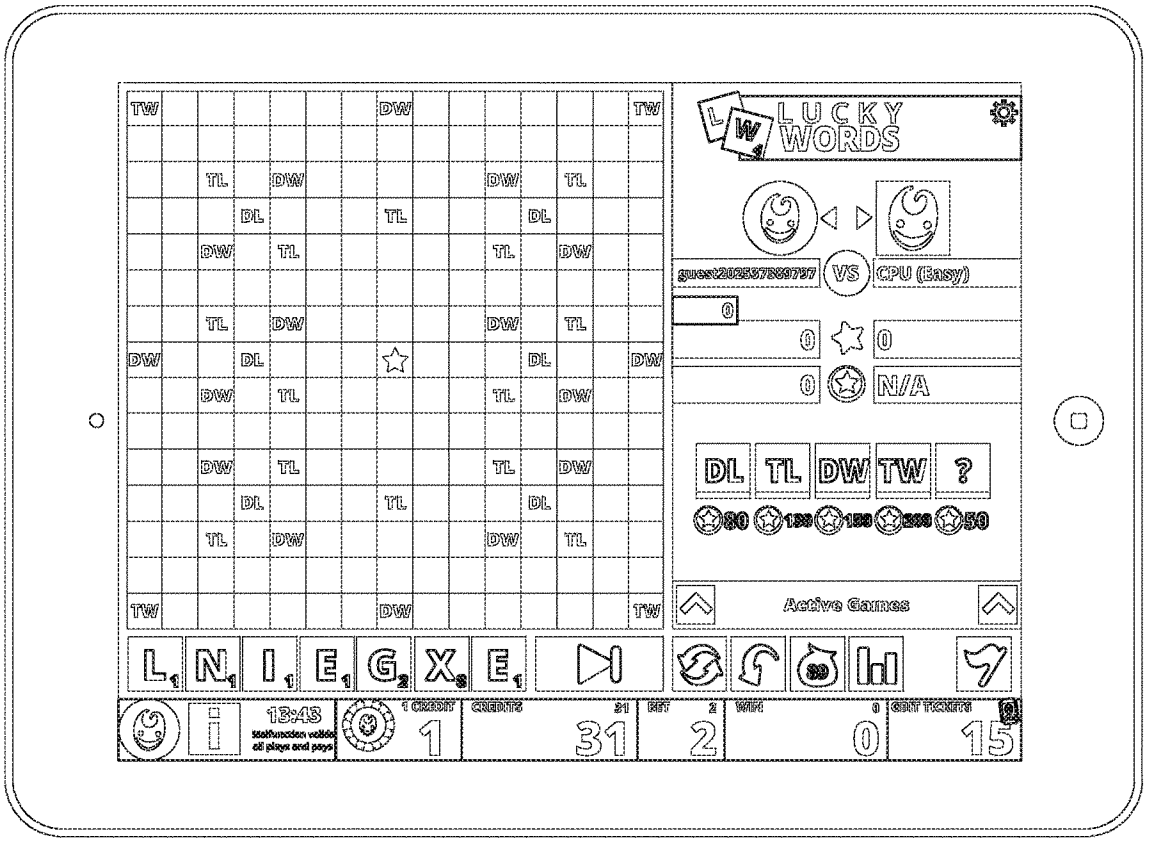
FIG. 19 a gameplay instance of element manipulation in accordance with embodiments of the invention.

FIG. 19 illustrates a gameplay instance of element manipulation in accordance with embodiments of the invention. A user uses a user interface 2500 and interacts with elements on the right side of the screen, and is able to access a menu displaying each of the user's currently running games. This allows the user to quickly ascertain statuses of multiple gameplay scenarios, as well as easily move from one scenario to another.

In some embodiments, play may occur with a user selecting elements from an element inventory and placing them on a game board, the game board having spaces for the elements. For example, the elements may be tiles of letters with corresponding values. The user does this with a goal, but not a requirement, of creating a synthesis of highest possible value producible from the user's element inventory. For example, the synthesis of tiles with letters may create a word. In some embodiments, whether a synthesis of tiles results in a word is determined by a dictionary.

A play's value, in accordance with some embodiments of the invention, is determined by a summation of the point value of a synthesis's elements. There exist in some embodiments, game boards with positions that possess special attributes of multiplying element and synthesis values. The user may keep these spaces in mind when playing, as a synthesis played on one section of the board may be worth twice or thrice that if played elsewhere; it would be inefficient for the user to waste the user's resources playing words where they are valued least. In some embodiments, the user may place and replace elements and purchasable score operators as many times as the user likes before reaching a satisfying play and confirming it.

After a play is made (e.g., placing a number of tiles on the board to form a word), a wagering event is activated. In some embodiments, this wagering event is done in the style of a slot machine styled in accord with the embodiments of the invention. However, instead of spinning with the goal of creating patterns of symbols in traditional slot style, an assembly of a five-element synthesis that forms a word is desired.

The user may adjust the credit amount risked on the wager. In some embodiments, the number of credits that the user may wager for any given wager event is determined by the initiating play. In some embodiments, the user may only bet a number of credits that does not exceed the number of elements used in the initiating play. For example, if the user plays a 5-letter word, the user may not exceed 5 credits in the corresponding wager. In some embodiments, a maximum wager may be seven credits, seven being the number of elements in the element inventory at any given time. In some embodiments, the number of elements used may not be the number of maximum credits allowed to be wagered, but instead may be a factor in determining the maximum credits allowed to be wagered. For example, if the user uses 5 elements, the maximum number of credits allowed to be wagered may be 10 credits, and if the user uses 7 elements, the maximum number of credits allowed to be wagered may be 35 credits. The rate of increase of maximum number of credits per element may not be linear. The rate may be exponential, to further incentivize the user to create a long word.

A spin's value may be determined by a summation of the individual element values. The user may additionally be granted an in-game currency award equivalent to the spun elements' summed scores, regardless of if a legitimate synthesis has been achieved or not. In-game currency may be used by the user to purchase various score-altering and play-altering items to facilitate execution of the interactive application. Upon a successful formation of a synthesis in the spin, the user is granted a real-currency return. A number of real-currency credits won is determined by a paytable predicated upon a spun synthesis's score and its wager amount. A real-currency reward display is positioned underneath a wager display, signified by use of a credit symbol introduced in a casino bar. An in-game currency reward display is rendered across from a real-currency display, differentiated by use of a distinct symbol in accordance with possible embodiments of the invention. A user is given an option to view the paytable as well as initiate a wager event. While a wager event is in progress, the user is given an option to stop wager event elements if the user so desires.

In some embodiments, following a wager event, its result is conveyed via a result screen. An outcome's value is tallied and an outcome's in-game currency and real-currency returns are deposited in their corresponding depositories. A user may use the user's in-game currency to purchase various score and play altering items, placement of which is left to the user's discretion. Awarding the user in-game currency through wager events provides a resource management component to gameplay that transcends simply making the highest use of a randomly generated inventory. The user is now given resources to allocate and use at the user's discretion with a goal of earning more points than an opposing user. Furthermore, allocation of a resource through a wager event interleaves skill elements of the interactive application with chance gameplay of a wagering game. This interleaving of the skill-based game and the chance-based game is further compounded by a wager's maximum value being determined by a number of elements used in an initiating play. The interleaving of the skill-based game and the wagering game produces a single, cohesive, deliverable game incorporating risk from wagering with aspects associated with skill-based gameplay.

At a conclusion of an interactive application session, a summary result screen is displayed, relating information such as, but not limited to: the score, the user's highest scoring play, and various application telemetry viewing options. When satisfied, the user may return to a main menu after viewing the results screen.

In various embodiments, upon detection of a ticket's insertion, a difficulty selection menu is displayed. Upon receiving input regarding a difficulty selection, a game is created and displayed.

Figure 20:
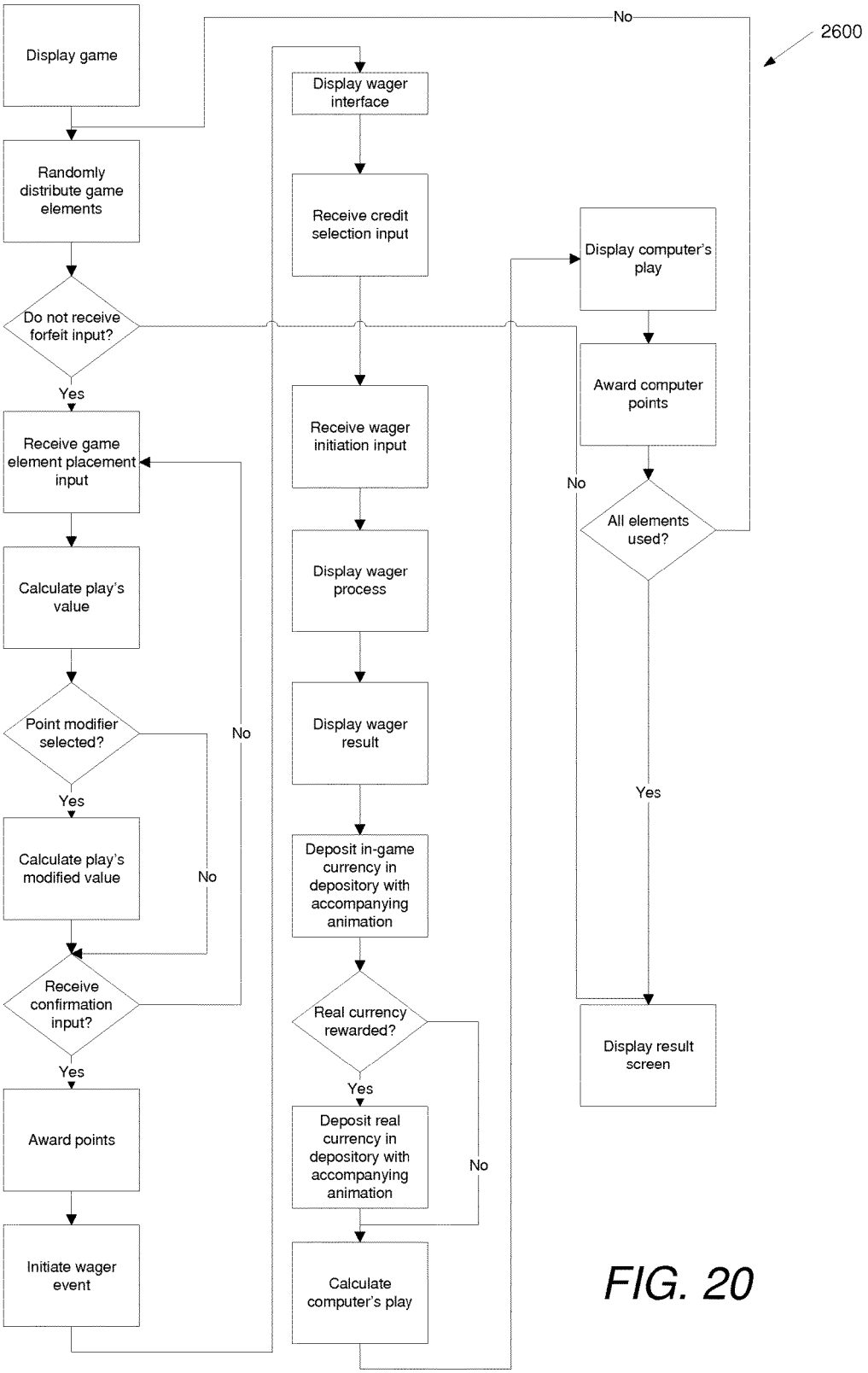
FIG. 20 illustrates another wager event an gameplay process in accordance with embodiments of the invention.

FIG. 20 illustrates a process in accordance with embodiments of the invention. In process 2600, various playable elements are distributed randomly to users. If a forfeit input is not received, element placement inputs are received. Throughout, a play's possible score is calculated and shown to a user based on the element placement. If an input corresponding to a point modifier is received, a modified play value is calculated. If a confirmation input is received, points are awarded to the user. If a confirmation input is not received, element inputs are received and scores are calculated until such time that the confirmation input is delivered.

Upon receiving a confirmation of play of the placed elements, a wager display interface may be presented to the user. A credit selection input is received followed by a wager confirmation. Upon receiving wager confirmation, the interactive controller communicates, to the application controller, application telemetry. For example, the application telemetry may indicate that a word was formed, the number of letters in the word, the value of the word, and the wager amount. The application controller, upon receiving the indication that a word was formed, communicates a wager request to the wager controller. The application controller may also communicate the wager amount to the wager controller. The wager controller receives the wager request and in response, generates a wager result. The wager result is communicated to the application controller. The application controller receives the wager result.

A wager process is then displayed followed by a wager result display. In some embodiments of the invention, a wager process display may resemble a slot-style game with a goal of creating a five-letter word. An amount of in-game currency, dependent upon the wager's result in some embodiments of the invention, is accredited to a user and deposited in an appropriate depository. If a real-currency return has been earned, the real-currency return is deposited in its corresponding depository. If a user is playing a computer-controlled opponent, possible plays for the computer-controlled opponent are calculated before a final play is shown and its corresponding value accredited to the computer-controlled opponent. If all elements have not been used, elements are distributed randomly again and play continues. If all elements have been exhausted, the result screen is displayed.

In some embodiments, if a user wins, credit is awarded before returning to the menu.

In various embodiments, when the wager controller detects that a ticket has been inserted, the wager controller communicates to the application controller to initiate a display difficulty selection menu process by the interactive controller. Upon reception of the initiation indication, the interactive controller creates and displays a session of the interactive application.

While the above description may include many specific embodiments of the invention, these should not be construed as limitations on the scope of the invention, but rather as examples of embodiments thereof. It is therefore to be understood that the present invention can be practiced otherwise than specifically described, without departing from the scope and spirit of the present invention. Thus, embodiments of the present invention described herein should be considered in all respects as illustrative and not restrictive.

What is claimed:

1. An interleaved wagering system, comprising:

an interactive controller operatively connected to an application controller, the interactive controller configured to:

provide an entertainment game;

generate a visual display of the entertainment game;

distribute, to the application controller, a first player input;

receive, from the application controller, an odds table;

generate a visual display of the odds table;

distribute, to the application controller, a player game selection;

distribute, to the application controller, a second player input;

receive, from the application controller a resource update;

receive, from the application controller, a wager result;

update the entertainment game based on the resource update;

update the visual display of the interactive application with the wager result and the resource update;

the application controller operatively connecting the interactive controller and a wager controller, the application controller constructed to:

receive, from the interactive controller, the first player input;

determine the odds table based on the first player input;

distribute the odds table to the interactive controller;

receive, from the interactive controller, the second player input;

determine whether a wager is triggered based on the second player input;

when the wager is triggered, distribute a wager request to the wager controller;

receive, from the wager controller, the wager result;

determine the resource update based on the wager result;

distribute the wager result to the interactive controller;

distribute the resource update to the interactive controller;

the wager controller operatively connected to the application controller, the wager controller constructed to:

receive, from the application controller, the wager request;

determine the wager outcome based on the wager request using a random number generator; and distribute, to the application controller, the wager outcome.

2. The interleaved wagering system of claim 1, wherein the interactive controller and the application controller are constructed from the same device, and wherein the application controller is operatively connected to the wager controller by a network.

3. The interleaved wagering system of claim 1, wherein the wager controller and the application controller are constructed from the same device, and wherein the application controller is operatively connected to the interactive controller by a network.

4. The interleaved wagering system of claim 1, wherein the application controller is operatively connected to the wager controller by a network, and wherein the application controller is operatively connected to the interactive controller by a network.

* * * * *